US006687476B2

(12) United States Patent
Goseki et al.

(10) Patent No.: US 6,687,476 B2
(45) Date of Patent: Feb. 3, 2004

(54) DEVELOPER-CARRYING MEMBER, METHOD FOR REGENERATION THEREOF AND DEVELOPING APPARATUS

(75) Inventors: Yasuhide Goseki, Yokohama (JP); Masayoshi Shimamura, Yokohama (JP); Yasutaka Akashi, Yokohama (JP); Kenji Fujishima, Yokohama (JP); Kazunori Saiki, Yokohama (JP); Satoshi Otake, Numazu (JP); Naoki Okamoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/043,349

(22) Filed: Jan. 14, 2002

(65) Prior Publication Data

US 2002/0176931 A1 Nov. 28, 2002

(30) Foreign Application Priority Data

| | | |
|---|---|---|
| Jan. 16, 2001 | (JP) | 2001-007456 |
| Nov. 7, 2001 | (JP) | 2001-342185 |
| Dec. 27, 2001 | (JP) | 2001-398440 |

(51) Int. Cl.[7] ..... G03G 15/08; G03G 15/09

(52) U.S. Cl. ..... 399/109; 399/265; 399/276; 399/279; 29/895

(58) Field of Search ..... 29/895; 148/518; 399/109, 159, 265, 276, 279, 286

(56) References Cited

U.S. PATENT DOCUMENTS

| | | | | |
|---|---|---|---|---|
| 4,957,840 | A | 9/1990 | Sakashita et al. | 430/106.6 |
| 4,989,044 | A | 1/1991 | Nishimura et al. | |
| 5,137,796 | A | 8/1992 | Takiguchi et al. | 430/106.6 |
| 5,175,070 | A | 12/1992 | Tanikawa et al. | 430/122 |
| 5,175,586 | A | 12/1992 | Goseki et al. | |
| 5,202,731 | A | 4/1993 | Tanikawa et al. | |
| 5,274,426 | A | 12/1993 | Goseki et al. | |
| 5,286,917 | A | 2/1994 | Unno et al. | 118/651 |
| 5,618,647 | A | 4/1997 | Kukimoto et al. | 430/106.6 |
| 5,712,837 | A | 1/1998 | Horigome et al. | 369/59 |
| 5,849,453 | A | 12/1998 | Mikuriya et al. | 430/125 |
| 5,860,050 | A | 1/1999 | Shimamura et al. | 399/276 |
| 6,115,575 | A | 9/2000 | Kinoshita et al. | 399/286 |
| 6,122,473 | A | 9/2000 | Goseki et al. | 399/286 |
| 6,178,306 | B1 * | 1/2001 | Mizoguchi et al. | 399/276 |
| 6,341,420 | B1 * | 1/2002 | Swartz et al. | 29/895.32 |

FOREIGN PATENT DOCUMENTS

| | | |
|---|---|---|
| JP | 1-112253 | 4/1989 |
| JP | 1-277265 | 11/1989 |
| JP | 2-284158 | 11/1990 |
| JP | 5-6089 | 1/1993 |
| JP | 5-66680 | 3/1993 |
| JP | 8-36341 | 2/1996 |
| JP | 8-171724 | 7/1996 |
| JP | 8-240981 | 9/1996 |
| JP | 10-31367 | 2/1998 |
| JP | 11-174891 | 7/1999 |

* cited by examiner

*Primary Examiner*—Hoang Ngo
(74) *Attorney, Agent, or Firm*—Fitzpatrick, Cella, Harper & Scinto

(57) ABSTRACT

A used developer-carrying member having a resin coating layer on a substrate is regenerated through a step of scraping the resin coating layer of the used developer-carrying member to form a developer-carrying member surface having unevenness showing a central line-average roughness Ra of at most 0.8 $\mu$m, and a step of coating the developer-carrying member surface having the unevenness with a coating layer of a resinous composition comprising at least a binder resin and electroconductive fine powder. The regenerated developer-carrying member can be reinstalled in a developing apparatus and subjected to repetitive electrophotographic image forming cycles.

36 Claims, 13 Drawing Sheets

DEVELOPER-CARRYING MEMBER, METHOD FOR REGENERATION THEREOF AND DEVELOPING APPARATUS

FIELD OF THE INVENTION AND RELATED ART

The present invention relates to a developer-carrying member for developing a latent image formed on a latent image-bearing member to form a toner image in electrophotography, electrostatic recording or magnetic recording. More specifically, the present invention relates to a method for regeneration of such a developer-carrying member, a regenerated developer-carrying member and a developing device including such a regenerated developer-carrying member.

Many electrographic methods have been known heretofore. Generally, an electrical latent image is formed on an electrostatic latent image-bearing member (photosensitive member) comprising a photoconductor material by various means, and is developed with a toner (developer) to form a toner image (visible image), which is then transferred onto a transfer(-receiving) material, such as paper, as desired, and then fixed onto the transfer material by application of heat, pressure, or heat and pressure to form a copy or a print. In recent years, printers and facsimile apparatus are popularly formed as machines using electrophotography in addition to conventional copying machines. The developing schemes are roughly divided into the two-component developing scheme using carrier particles and the mono-component developing scheme not using such carrier particles. The mono-component developing schemes include the magnetic mono-component developing scheme wherein a developer comprising toner particles containing magnetic powder is conveyed under the action of a magnetic force, and the non-magnetic monocomponent developing scheme wherein a developer containing no magnetic powder is carried on a developer-carrying member under the action of a triboelectric charge. In the magnetic mono-component developing scheme, the magnetic material may be used also as a colorant, without using a colorant such as carbon black.

In the two-component developing scheme, carrier particles such as glass beads or iron powder are necessary, and a device for detecting a toner concentration to replenish a necessary amount of toner is necessary for maintaining a constant toner concentration in the developer, so that the entire developing device tends to be large and heavy. In the two-component developing scheme, the toner component is liable to be attached onto the carrier, thus causing a spent carrier, so that it becomes necessary to exchange the carrier. In the mono-component developing scheme, such a carrier or related device is not required, so that the entire developing device can be made smaller and lighter, and the maintenance operation is not required for a long period since carrier exchange is not required. Because of necessity of the magnetic powder, in the magnetic mono-component developing scheme, it becomes difficult to effect clear color toner formation, whereas the two-component developing scheme is preferably used for color development since the developing state can be finely controlled by the density detection device.

As for printer devices, LED printers and LBP printers become predominant in the market, and high resolutions (e.g., 600, 800 and 1200 dpi) are being required. Accordingly, a developing scheme achieving a high resolution is required. Further, a digital machine is becoming predominant for also copying machines, and is made appliable to multi-functional use so as to be also usable as a facsimile apparatus or a printer, so that the difference between a copying machine and a printer is becoming less. A high-resolution and high-definition developing scheme is also required in multi-function machines. For example, Japanese Laid-Open Patent Application (JP-A) 1-112253 and JP-A 2-284158 have proposed to use a small-particle size toner, and toners having central particle sizes of ca. 5–9 $\mu$m are becoming predominant as high resolution is required.

The developer-carrying member used in the above-mentioned developing schemes has been conventionally formed by shaping, e.g., a metal, alloy or a compound, into a cylinder, and treating the surface thereof by electrolysis, blasting or filing so as to provide a prescribed surface roughness. A portion of developer present close to the surface of such a developer-carrying member in a developer layer formed on the developer-carrying member by a regulating member is liable to have a very high charge and therefore attracted to the developer-carrying member surface by a strong image force. In such a case, an upper layer of toner is not provided with a sufficient opportunity of triboelectrification, thus being liable to have an insufficient charge. Under such circumstances, sufficient development and transfer cannot be achieved, thus being liable to result in images accompanied with image density irregularity and scattering of character images.

In order to prevent the occurrence of such a developer having an excessive charge or strong attachment of the developer, it has been proposed to form a film of a resin containing an electroconductive substance such as carbon graphite or a solid lubricant such as graphite disposed therein on the developer-carrying member in, e.g., JP-A 01-277265, JP-A 05-006089, and JP-A 05-066680.

Such a developer-carrying member heaving a resinous coating layer, when used in a process cartridge, is used up to the consumption of the developer in the cartridge, or when used in a developing device operated by replenishing a developer as desired, is used up to the end of the life of the developing device, in a copying machine, a printer or a facsimile apparatus including such a process cartridge or a developing device. Accordingly, a thermosetting type resin having a good wear resistance has been preferably used as the resin for binding the electroconductive fine particles or the solid lubricant.

On the other hand, in order to retain a suitable level of toner conveying performance on a developer-carrying member (also called a developing sleeve), the developer-carrying member surface is required to have an appropriate degree of surface roughness. Accordingly, the resinous coating layer surface is intentionally roughened to adjust a developer-carrying amount.

However, in view of a long period of continual use, it is difficult to prevent the change in surface roughness, and the developer carrying amount is inevitably changed correspondingly. Further, along with the surface roughness change, the developer-carrying member is liable to be soiled with deteriorated developer. Accordingly, a developer-carrying member used throughout the life of a cartridge or a developing device is difficult to satisfy image forming performances attained at its initial use, and has been disposed simultaneously at the end of the life of the cartridge or the developing device.

In recent years, however, the reduction of waste product is becoming an urgent matter, and the re-utilization of even a functional material for electrophotography, such as a developer-carrying member, is required. For example, it has been proposed to remove the resinous layer on the. developer-carrying member surface by a cutting means, such as a cutting bite and re-apply a surface processing, such as blasting or resin coating, similarly as on a fresh tube. However, the resin layer removal by bite cutting is accompanied with a difficulty that a surface resin layer is very difficult to cut. More specifically, the resin is liable to be attached onto a cutting bite to fail in uniform cutting, and the bite has to be exchanged at a very high frequency. Further, the use of a grindstone has also been proposed, but the grinding therewith is hindered by stopping-up with the resin. Several proposals have been made of blasting for removal of such a surface resin layer on a developer-carrying member. For example, JP-A 08-171724 has disclosed to remove a surface resin layer by blasting after removing the flange of a developing roller. Further, JP-A 11-174891 has also disclosed that it is possible to peel off a resinous surface coating layer by blasting or grinding. However, a detailed method thereof is not disclosed. The removal of a resinous coating layer by blasting is accompanied with several problems.

Hitherto, it has been known to use a hollow or solid cylinder of aluminum, stainless steel, brass or shaped resin, as a substrate of a developer-carrying member. Such a substrate is used after processing at a high accuracy so as to obtain high-quality image through an electrophotographic developing method.

For example, in a jumping developing method wherein a latent image-bearing member and a developer-carrying member are disposed with a prescribed gap therebetween, and a developer is formed in a layer at a thickness smaller than the gap and is used to develop a latent image formed on the image-bearing member while applying a developing bias voltage between the image-bearing member and the developer-carrying member, it is difficult to obtain uniform images unless the constant gap is retained between the latent image-bearing member and the developer-carrying member. For example, if a constant gap is not retained between the image-bearing member and the developer-carrying member, thereby resulting in a substantial fluctuation in gap during a rotation of the developer-carrying member relative to a vertical surface, there are encountered image defects, such as pitch irregularity or periodical density irregularity in solid black or halftone images, line width irregularity of line images or developer scattering around character images. Such a gap fluctuation should be suppressed to at most 30 $\mu$m ordinarily, and at most 15 $\mu$m for a laser beam printer or a digital machine for reproducing a high-definition graphic image. Among substrate materials usable for the developer-carrying member substrate, aluminum is suitably used because of lightness and high-accuracy processability.

However, in the case of removing a resin coating formed on an aluminum substrate by blasting, the following problems are liable to occur. Blasting with too strong a force results in deformation of the aluminum substrate to provide a larger gap fluctuation after the blasting than the original substrate. When a regenerated developer-carrying member is produced by using such a regenerated substrate and is used in a developing device, the above-mentioned image defects of pitch irregularity, line-width irregularity and scattering are liable to occur. Further, as too large a surface roughness occurs after the resin coating layer removal by blasting, it becomes difficult to form a resin coating layer surface having a uniform and suitable surface roughness thereon for regeneration, thus being liable to cause peeling-off or a lowering in surface roughness of the resins coating layer. This also adversely affects the image uniformity. On the other hand, too low a blasting force fails in removal of the resin coating layer as the resin coating layer inherently has a certain wear resistance.

As a method of removing such a resin coating layer other than the blasting mentioned above, a method of dissolving the resin coating layer with an organic solvent has been proposed as disclosed in JP-A 10-031367. The JP-reference particularly discloses the use of a mixture of water and a water-immiscible solvent having a larger specific gravity than water for dissolving and peeling the resin coating layer in order to prevent the evaporation of the organic solvent. According to this method, it is possible to dissolve and peel the coating layer to some extent, but this becomes difficult in the case of a large layer thickness or depending on a resin constituting the coating layer. Particularly, in the case of a coating layer of a thermosetting resin, it is difficult to find an organic solvent having a high dissolving power to the resin to allow the peeling of the resin layer in many cases.

As another method, a method of wiping and removing a resin coating layer with a fibrous material, such as cloth or felt, as disclosed in JP-A 08-036341. According to this method, however, it is only possible to apply a wiping force capable of removing toner affixed and remaining on the resin coating layer on a used developer-carrying member, and it is insufficient to abrade and peel the resin coating layer.

Accordingly, a method of regenerating a developer-carrying member is desired for providing a regenerated developer-carrying member free from difficulties in image formation, such as image defects as mentioned above, and for suppressing the amounts of waste materials.

SUMMARY OF THE INVENTION

An object of the present invention is to provide a method of regenerating a developer-carrying member and a regenerated developer-carrying member capable of providing high-definition images free from pitch irregularity, line-width irregularity, scattering, and further, blotch, ghost or fog.

Another object of the present invention is to provide a method of regenerating a developer-carrying member and a regenerated developer-carrying member capable of peeling or abrasion of a resin coating layer on the surface and capable of retaining high-definition images even after a long period of use.

A more specific object of the present invention is to provide a method of removing a surface resin coating layer on a developer-carrying member so as not to cause inadequacy regarding gap fluctuation or surface roughness and forming a fresh resin coating layer thereon to provide a regenerated developer-carrying member capable of providing high-definition images comparable to those obtained by a fresh developer-carrying member.

A further object of the present intention is to provide a developing device including such a regenerated developer-carrying member.

A still further object of the present invention is to provide a method capable of reducing waste materials and reducing the costs for Introduction of a developer-carrying member and a developing device.

According to the present invention, there is provided a method of regenerating a used developer-carrying member having a resin coating layer on a substrate, comprising:

scraping the resin coating layer of the used developer-carrying member to form a developer-carrying member surface having unevenness showing a (central line-average roughness Ra of at most 0.8 $\mu$m and coating the developer-carrying member surface having the unevenness with a coating layer of a resinous composition comprising at least a binder and electro-conductive fine powder.

The present invention further provides a regenerated developer-carrying member obtained through the above-mentioned method, and also a developing apparatus including such a regenerated developer-carrying member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
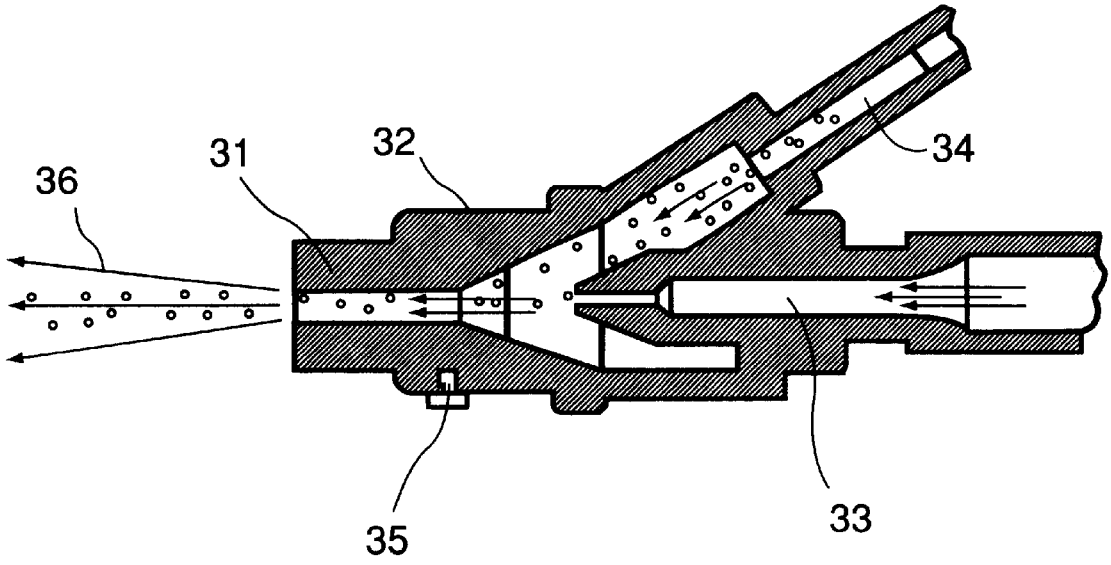
FIG. 1 is a schematic enlarged sectional illustration of a nozzle portion of a blasting device used in the invention.

In the regeneration method for a used developer-carrying member having a resin coating layer on a substrate, the resin coating layer of the used developer-carrying member is scraped or scoured off to form unevenness on a developer-carrying member surface showing a central line-average roughness Ra of at most 0.8 $\mu$m, more preferably at most 0.7 $\mu$m and the developer-carrying member surface having the unevenness is coated with a coating layer of an electroconductive resin composition comprising at least a binder resin and electroconductive fine powder. Preferred examples of the method may include the following.

A. A method of scraping the resin coating layer of the used developer-carrying member with abrasive particles to scrape off the resin layer and forming unevenness on the developer-carrying member surface showing a center line average roughness Ra of at most 0.8 $\mu$m, and forming on the surface an electro-conductive resin coating layer of a resinous composition comprising at least a binder resin and electro-conductive fine powder.

B. A method of blasting the resin coating layer of the used developer-carrying member having a cylindrical substrate with particles having an average particle size of 15–250 $\mu$m together with air at a discharge pressure of $1\times10^5$ Pa–$5\times10^5$ Pa through a nozzle having an inner diameter which is 0.15–1 times the outer diameter of the substrate to scrape off at least a part of the resin coating layer, thereby forming a surface having unevenness showing a central line-average roughness Ra of at most 0.8 $\mu$m, and coating the surface with a conductive resin coating layer of a resinous composition comprising at least a binder resin and electroconductive fine powder.

C. A method of subjecting the used developer-carrying member having a cylindrical substrate to a liquid honing treatment of ejecting a liquid containing particles having an average of 115–100 $\mu$m together with air at a discharge pressure of $1\times10^5$ Pa–$5\times10^5$ Pa through a nozzle having an inner diameter of 0.5–1.0 times the substrate outer diameter onto the resin coating layer of the developer-carrying member to scrape off at least a part of the resin coating layer, thereby forming a surface having unevenness showing a central line-average roughness Ra of at most 0.8 $\mu$m, and coating the surface with a conductive resin coating layer of a resinous composition comprising at least a binder resin and electroconductive fine powder.

D. A method of disposing abrasive particles on the resin coating layer of the used developer-carrying member so that at least a portion of the abrasive particles are movable relative to a support therefor, moving the abrasive particles relative to the resin coating layer to scrape off at least a part of the resin coating layer, thereby forming a surface having unevenness showing a central line-average roughness Ra of at most 0.8 $\mu$m, and coating the surface with a conductive resin coating layer of a resinous; composition comprising at least a binder resin and electroconductive fine powder.

E. A method of scraping the resin coating layer of the used developer-carrying member having a cylindrical substrate with an abrasive tape having a surface showing a ten point-average roughness of 6.0–30 $\mu$m formed by binding abrasive particles with a binder resin abutted against the resin coating layer at an abutting pressure of $1.0\times10^{5-5.0\times10}$ Pa to scrape off at least a portion of the resin coating layer, thereby forming a surface having unevenness showing a central line-average roughness Ra of at most 0.8 $\mu$m, and coating the surface with a conductive resin coating layer of a resinous composition comprising at least a binder resin and electroconductive fine powder.

The regeneration method for a used developer-carrying member according to the present invention is appliable not only to actually used developer-carrying member recovered from users but also to developer-carrying members which have not been actually used but should be regenerated because of user's desire of exchange, failure to passing the examination due to, e.g., inadequate resin coating layer formation, etc. Herein, these developer-carrying member to be regenerated by the method of the present invention are inclusively represented by a term of "used developer-carrying member" for convenience of explanation and easiness of comprehension Ordinarily, a developing device or a cartridge of an electrophotographic image forming apparatus, such as a copying machine and a printer, recovered from the market, contains some amount of residual developer (toner), and some toner is attached onto the developer-carrying member, so that the toner has to be removed from the developer-carrying member. Unless some degree of toner removal is performed, some difficulties are encountered such that blasting abrasive particles are soiled with the toner, and the substrate of a developer-carrying member after removal of the surface resin coating layer is soiled with toner and abrasive particles, thus obstructing the resin coating in a subsequent step. If the remaining toner is small in amount, it can be removed and recovered together with the peeled refuse of the resin coating layer of the developer-carrying member by a separation device, such as a cyclone, as an ancillary device to an abrasive particle circulating apparatus of the blasting apparatus.

The toner removal may be performed by, e.g., blasting with compressed air, washing with water at an ordinary or an elevated pressure, washing with an alkaline or acid water, washing with water containing a surfactant washing with a solvent, or a combination of these. In ordinary cases, such residual toner can be almost completely removed by discharging compressed air from an air gun onto all over the surface of the developer-carrying member (hereinafter sometimes referred to as a "(developing) sleeve"). The compressed air pressure in this instance may preferably be at most $5.0\times10^5$ Pa, more preferably at most $4.0\times10^5$ Pa. This is because too high a compressed air pressure is liable to increase the gap fluctuation of the sleeve similarly as in blasting described hereinafter.

Next, some description will be made on a blasting device used in the present invention with reference to FIGS. 1 to 3. FIG. 1 illustrates a blasting step for a developing sleeve according to the present invention. Referring to FIGS. 1 and 3, a blasting nozzle 31 is held by a nozzle holder 32, within which is disposed an ejection nozzle 33 for ejecting compressed air as a high-speed accelerated air stream. Further, at the ejection port of the ejection nozzle 33, abrasive particles 36 are supplied through an inlet port 34 so as to be sucked by the action of the accelerated air. The blasting nozzle 31 is affixed by a screw 35 and can be exchanged as desired by loosening the screw 35. Further, the nozzle holder 32 is affixed to a fixing support 40 so as to be vertically movable by a ball-screw 39 (FIG. 3). On the other hand, a sleeve 38 is supported rotatably in an indicated arrow direction by a rotation motor (not shown), and masking members 37 are attached onto both end parts of the sleeve 38.

In such a blasting device, accelerated ejection air is passed through the ejection nozzle 33 to cause a negative pressure in the nozzle holder 32, whereby the abrasive particles 36 are sucked through the abrasive inlet port 34 and passed through the blasting nozzle 31 together with compressed air to be discharged to the atmosphere. The thus ejected abrasive particles 36 are caused to impinge onto the rotating sleeve 38 surface to scrape off the resin coating layer on the sleeve 38 surface. Further the blasting nozzle holder 32 is moved vertically (i.e., upwards and downwards) together with the fixing support 40 by the ball screw 39, thereby blasting the entire surface of the sleeve 38.

Figure 2:
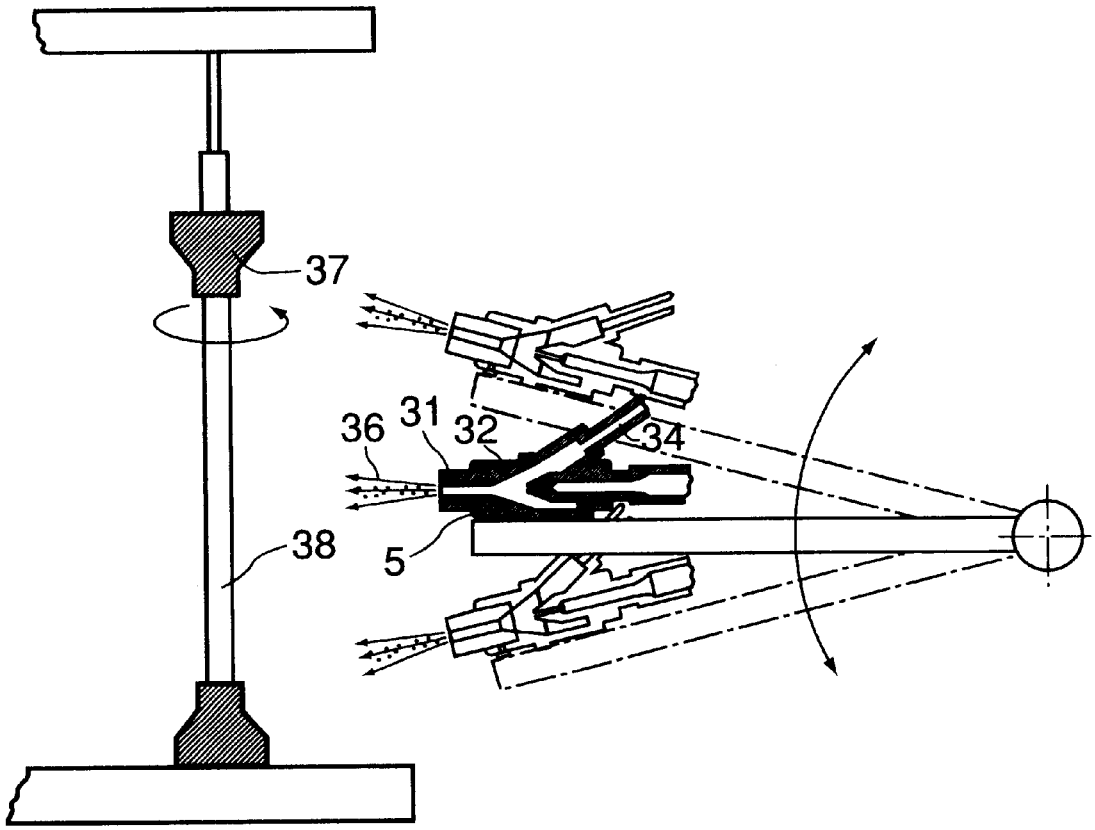
FIGS. 2 and 3 each illustrate a relative movement of such a blasting nozzle relative to a rotating sleeve (developer-carrying member).
Figure 3:
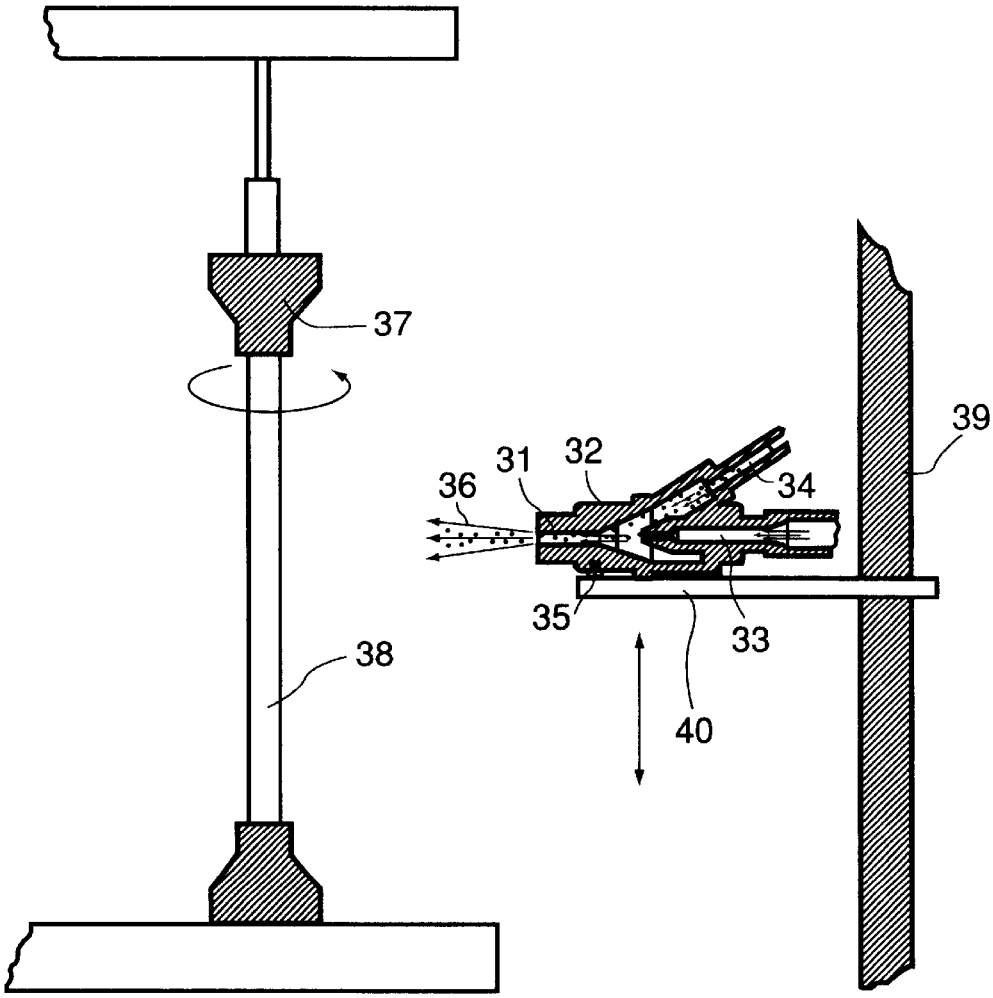

Instead of the vertically movable blasting nozzle device shown in FIG. 3, it is possible to use a blasting nozzle device which is swingable about an axis to blast the entire surface of a sleeve 38 as shown in FIG. 2.

Figure 4:
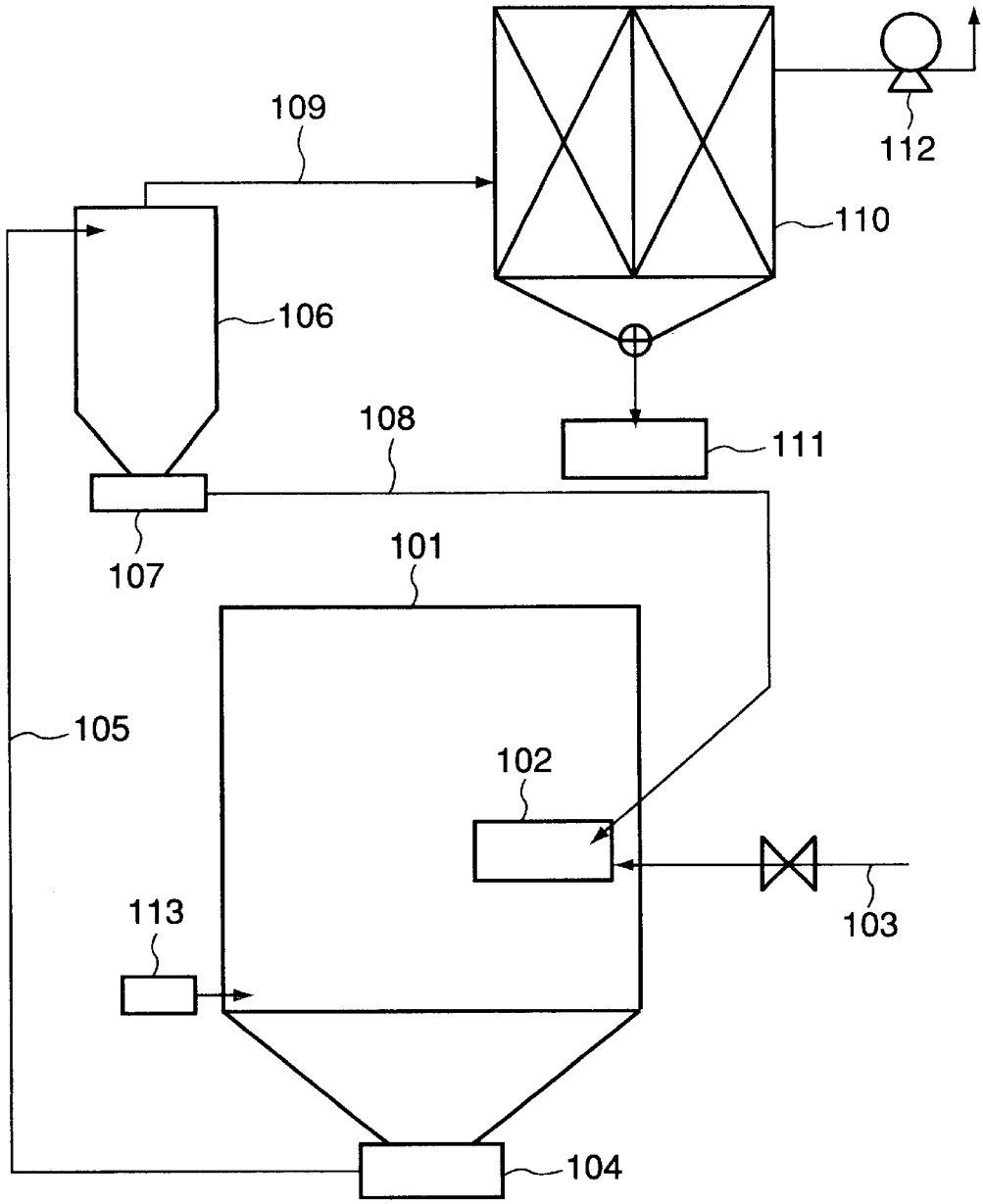
FIG. 4 is a system diagram showing a material flow in a blasting apparatus used in the invention.

FIG. 4 is a system diagram for illustrating a material flow in a blasting operation using a blasting nozzle device as illustrated in FIGS. 1 to 3 (i.e., FIGS. 1 and 2 or FIGS. 1 and 3). Referring to FIG. 4, inside a blasting apparatus 101, a blasting nozzle device 102 as illustrated in FIGS. 1 to 3 is disposed, and compressed air is supplied through an inlet port 103 to the nozzle device 102. Abrasive particles used for the blasting and powder of the scraped resin coating layer fall to a discharge port 104 and sent through a pipe 105 to a cyclone 106 under the action of sucking air caused by a blower 112 accompanying a bag filter 110. In the cyclone 106, the abrasive particles having relatively large particle sizes fall to and are recovered at a discharge port 107 and then recycled through a pipe 108 to the nozzle device 102 for blasting again. On the other hand, fine powder of the scraped resin layer having relatively small particle sizes is conveyed through a pipe 109 to the bag filter 110 and separated thereat from the suction air to be recovered by a recovery unit 111. In view of some loss due to abrasion and pulverization of the abrasive particles, fresh abrasive particles are replenished through a replenishing port 113.

In the present invention, it is important to appropriately set the blasting conditions for removing the resin coating layer of a used developer-carrying member. Thus, the conditions should be set so as to effectively remove the resin coating layer while obviating the deformation of the developer-carrying member substrate and the formation of unnecessary surface unevenness on the scraped substrate surface after removal of the resin coating layer.

In the present invention, solid particles used as the abrasive particles should preferably have an average particle size (weight-average particle size) of 15–25 $\mu$m. If the average particle size is below 15 $\mu$m, it becomes difficult to attain a sufficient scraping or scouring effect because of a substantial air resistance even when discharged at a strong air pressure, or a long blasting time is required even if a sufficient scraping is possible. Further, because of too small an average particle size, the abrasive particles are liable to be not satisfactorily recovered by the cyclone 106 but be sent to the bag filter 110 together with the scraped powder of the resin coating layer to be removed thereat at a higher possibility, in the blasting apparatus system. On the other hand, at an average particle size exceeding 25 $\mu$m, the substrate is liable to be deformed to provide a larger gap fluctuation due to association of an air pressure and the particle pressure. Further, the substrate surface after the resin coating layer removal is liable to have too large a surface roughness so that it is difficult to have an appropriate level of surface roughness after the coating with a fresh resin coating layer. The resin coating layer thus formed is liable to have a low durability and cause abrasion or peeling during a repetitive use thereafter.

In the present invention, the nozzle for discharging abrasive particles may preferably have an inner diameter which is 0.15–1.0 times the cylindrical substrate outer diameter. Below 0.15 times, the abrasive particles are liable to impinge onto a localized part on the substrate, thus causing ununiform and unstable scraping to result in a worse gap fluctuation. On the other hand, above 1.0 times, a high blasting pressure is required in order to achieve a uniform discharge of abrasive particles, thus being liable to excessively deform the substrate to result in a larger gap fluctuation and ununiform surface shapes due to an increased number of particles impinging onto the cylindrical substrate at angles close to the tangential lines of the substrate. Further, the efficiency of abrasive particle impingement onto the substrate becomes worse, and the dust density is increased to result in insufficient separation by the cyclone.

The blasting nozzle sectional shape may ordinarily be circular but can be deformed to e.g., an elliptical shape. In the latter case, it is preferred that the nozzle is caused to have a sectional shape confronting a cylindrical substrate giving in inner diameter of at most 1.0 times the substrate outer diameter in a direction perpendicular to the substrate extension and a nozzle aperture having a sectional area of 0.15–1.0 times the sectional area of the substrate based on the outer diameter of the substrate.

It is preferred to adopt a blasting pressure of $1\times10^5$ Pa–$5\times10^5$ Pa. Below $1\times10^5$ Pa, not only the scraping force is lowered but also the discharge state becomes ununiform, thus being liable to resulting in scraping irregularity. On the other hand, above $5\times10^5$ Pa, the substrate is liable to be deformed to result in a larger gap fluctuation. A suppressed blasting pressure of at most $4\times10^5$ Pa is preferred.

By satisfying the above conditions, it is ssible to scrape off the resin coating layer to provide a surface having uniform unevenness showing a central line-average roughness Ra of at most 0.8 $\mu$m without causing an increase in gap fluctuation, thus resulting in a gap fluctuation of at most 30 $\mu$m, preferably at most 15 $\mu$m.

In the present invention, it is preferred that the resin coating layer on the substrate is completely scraped off, but the continuation after removal of the resin coating layer can result in embedding of abrasive particles at the substrate surface to obstruct a fresh resin coating layer formation thereon. Accordingly, the substrate after the blasting can retain a remaining portion of resin coating layer thereon if it satisfies a required surface roughness.

As for abrasive particles used in the blasting, solid particles having a certain level of hardness, including those of glass (beads), silica, steel (balls), ferrite, alumina, silicon carbide, zirconia, alumina-zirconia, boron carbide, solid solution such as alumina-titanium oxide, complex oxide such as aluminum borate; resins, such as phenolic resin, melamine resin and nylon; magnetic particles comprising phenolic resin and magnetic particles; and resin particles containing various fillers.

In the present invention, the solid particles used as blasting abrasive particles may preferably have a true density of 0.8 g/cm$^{3-5.0}$ g/cm$^3$, more preferably up to 4.0 g/cm$^3$. At a true density of below 0.8 g/cm$^3$, the abrasive particles are liable to be affected by atmospheric pressure even when discharged at a high air pressure, thus failing to exhibit a sufficient scraping effect or requiring too long a processing time even if the scraping is performed. Further, because of too low a true density, the abrasive particles can fail to be recovered by the cyclone 106 but can be sent together with the scraped powder of the resin coating layer to the bag filter 110 to be removed thereat at an increased percentage. On the other hand, at a true density in excess of 5.0 g/cm$^3$, the substrate is liable to be deformed to provide a larger gap fluctuation due to association of an air pressure and the particle pressure. Further, the substrate surface after the resin coating layer removal is liable to have too large a surface roughness so that it is difficult to have an appropriate level of surface roughness after the coating with a fresh resin coating layer. The resin coating layer thus formed is liable to have a low durability and cause abrasion or peeling during a repetitive use thereafter. Further, the circulation of the abrasive particles within the blasting system can be obstructed to result in unstable discharge, leading to irregular scraping.

The cylindrical substrate may preferably be rotated about its axis at a constant velocity while being blasted. The speed of the rotation can be determined arbitrarily depending on the substrate since the peripheral speed varies depending on the substrate outer diameter, but may preferably be set to be ca. 50–150 rpm. Too low a rotation speed is liable to result in irregular scraping or a larger gap fluctuation. The upper limit is not crucial, but too high a rotation speed may require increased apparatus accuracy and strength resulting in an increase in processing cost in view of an air pressure applied thereto.

In the blasting operation, the blasting nozzle tip may preferably be moved in a direction of the substrate axis extension as shown in FIG. 2 or 3 with a distance of 10–400 mm from the substrate surface. At a larger inclination from the substrate axis extension, the resin coating layer can be scraped irregularly to result in oblique streaks in images formed by using the regenerated developer-carrying member in some cases.

The number of blasting nozzle(s) (or gun(s)) used in the blasting apparatus may be one or a plurality (e.g., ca. 2–4), but each blasting nozzle (tip) should be moved in the substrate axis extension direction.

The abrasive particle discharge rate depends on a true density of the abrasive particles and may preferably be in a range of 1 g/sec–50 g/sec for each gun, e.g., in the case of glass beads having a true density of 2.5 g/cm$^3$. Too small a discharge rate is liable to result in irregular scraping. Too large a discharge rate is liable to result in difficulties, such as an excessively large discharge air pressure, a larger gap fluctuation similarly as in the case of too large a true density and too large an average particle size of the abrasive particles, and abrasion particle separation failure at the cyclone 106 due to the increase in circulation flow rate.

After the resin coating layer removal, it is preferred to add a step of removing abrasives particles and scraping refuse of resin coating layer attached to the substrate. Such removal of solid particles can be effected by blowing with compressed air to the substrate. In case where an oily attachment is present in addition to such solid attachment, which can adversely affect a subsequent resin coating layer formation (as by adhesion obstruction), it is preferred to wash the substrate with a solvent or a solution. In a preferred embodiment, the substrate after the resin coating layer removal may be first washed with a surfactant solution under heating or application of ultrasonic wave and then washed with warm water.

Next, the regeneration method based on liquid honing will be described with reference to FIGS. 11 to 14.

Washing steps prior to and after the honing step may be performed similarly as in the above-mentioned blasting-regeneration method.

Figure 11:
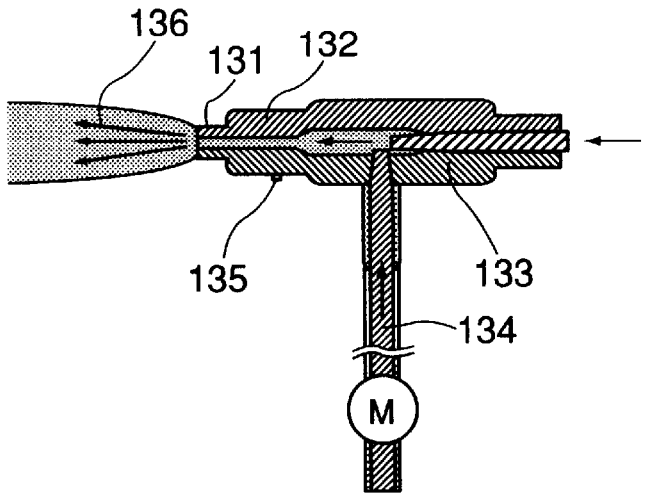
FIG. 11 is a schematic enlarged sectional illustration of a nozzle portion of honing device used in the invention.
Figure 12:
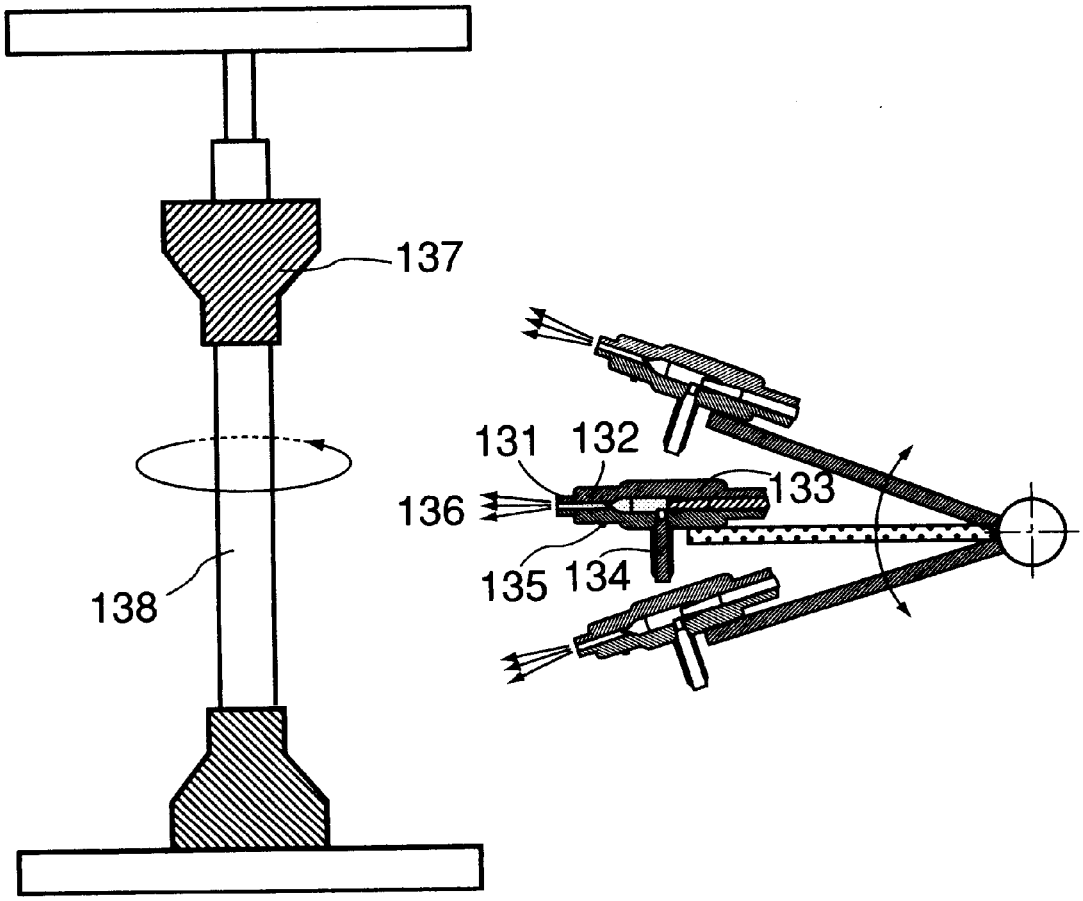
FIGS. 12 and 13 each illustrate a relative movement of such a honing nozzle relative to a rotating sleeve (developer-carrying member)
Figure 13:
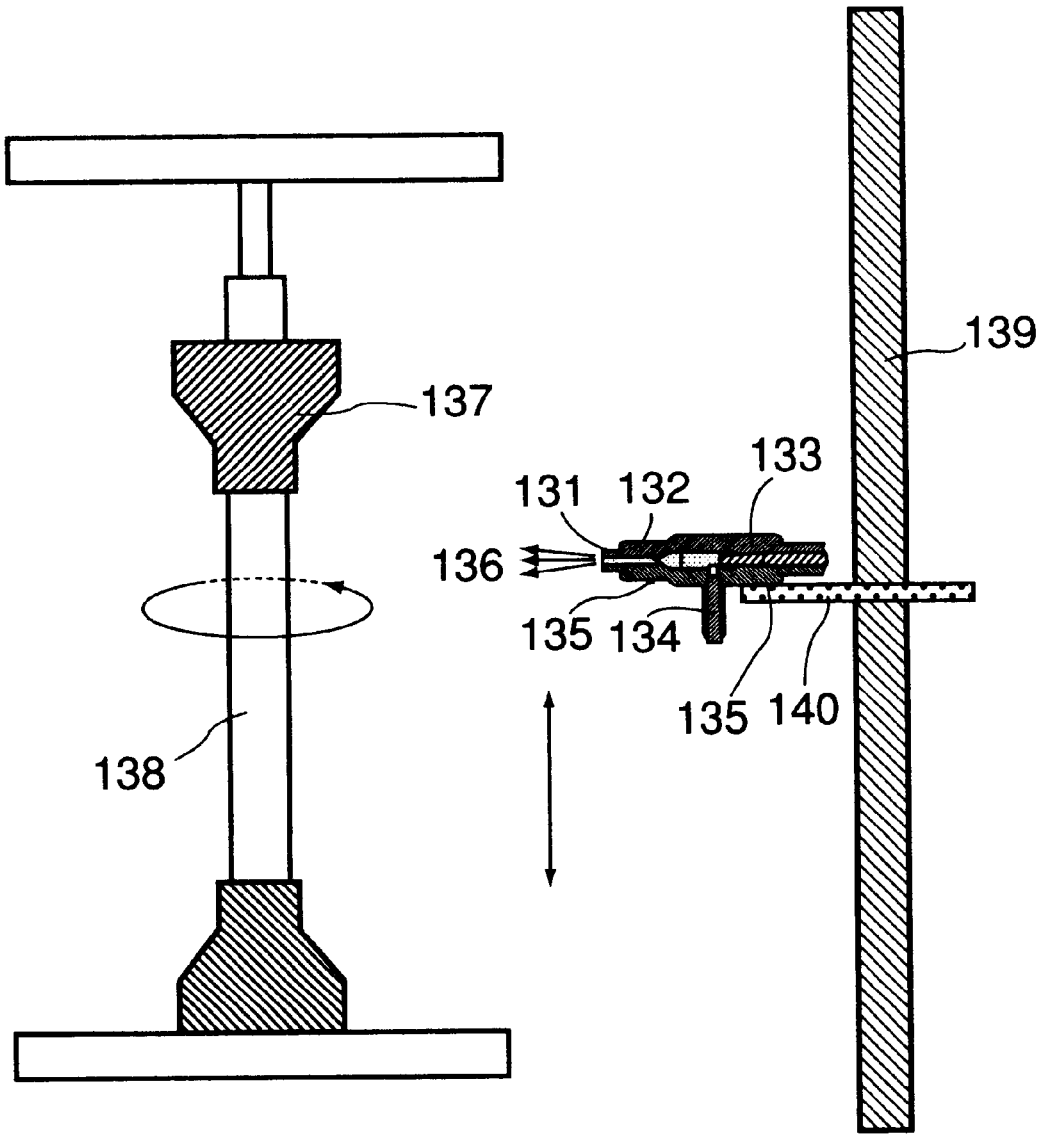

FIGS. 11 to 13 illustrate a honing system used in the present invention. FIG. 11 illustrates a honing nozzle for regenerating a used developing sleeve according to the present invention. Referring to FIG. 11, a honing nozzle 131 is held by a nozzle holder 132 within which is disposed an ejection nozzle 133 for ejecting compressed air as a high-speed accelerated air stream. Further, at the ejection port of the ejection nozzle 133, a liquid (representative water) 136 containing particles is supplied through an inlet port 134 and accelerated by the air from the nozzle 133 to be ejected onto a sleeve 138 FIG. 12 or FIG. 13). The honing nozzle 131 is affixed by a screw 135 and can be exchanged as desired by loosening the screw 135. Further, the nozzle holder 132 is affixed to a fixing support 140 so as to be vertically movable by a ball screw 139 (FIG. 13). On the other hand, the sleeve 138 is supported rotatably in an indicated arrow direction by a rotation motor (not shown), and masking members 137 are attached onto both end parts of the sleeve 138.

In such a honing device, the particle-containing liquid 136 accelerated by the compressed air is caused to impinge onto the rotating sleeve 138 surface to scrape off the resin coating layer on the sleeve 138. Further, the nozzle holder 132 is moved vertically (i.e., upwards and downwards) together with the fixing support 140 by the ball screw 139, thereby honing the entire surface of the sleeve 138 (FIG. 13).

Instead of the vertically movable honing nozzle device shown in FIG. 13, it is possible to use a honing nozzle device which is swingable about an axis to hone the entire surface of a sleeve 138 as shown in FIG. 12.

Figure 14:
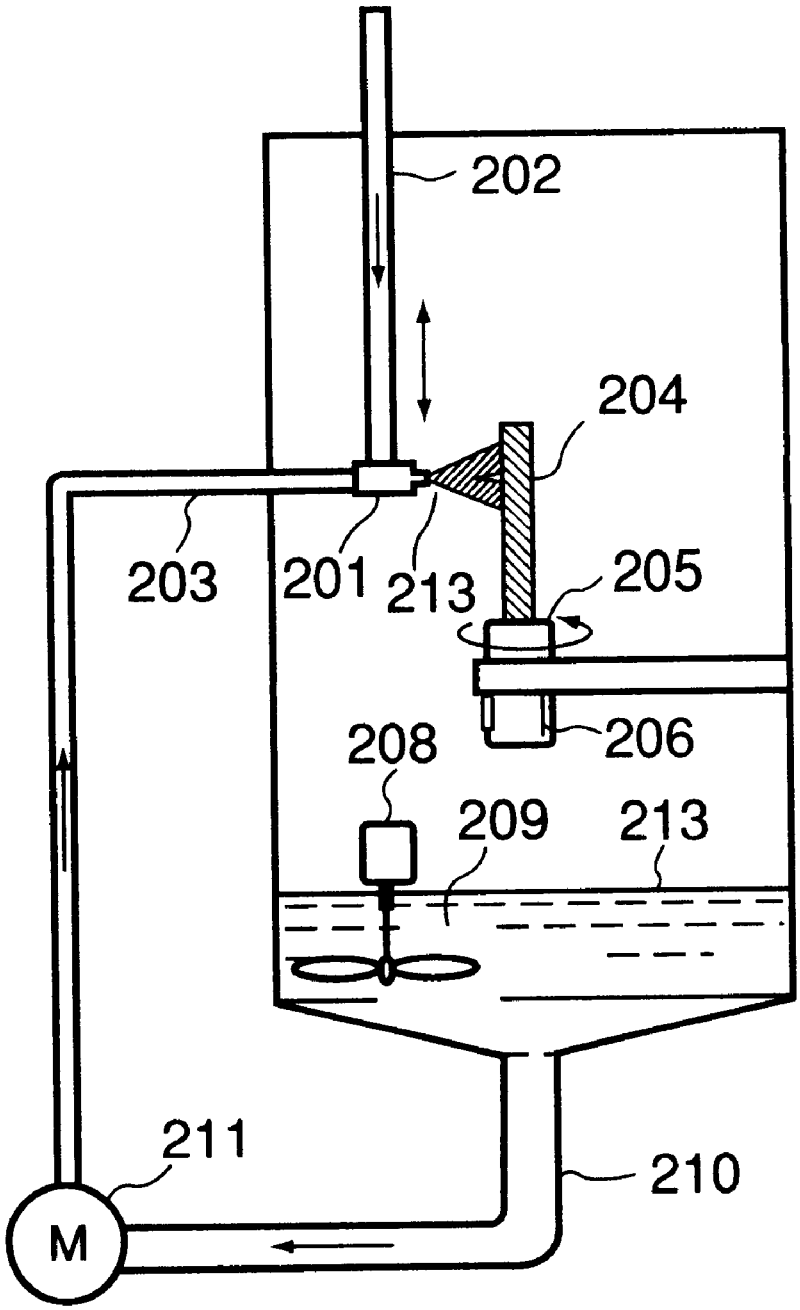
FIG. 14 illustrates a honing system including a honing nozzle device as illustrated in FIGS. 11 to 13.

FIG. 14 illustrates an entire honing system including a honing nozzle device as illustrated in FIGS. 11 to 13 (i.e., FIGS. 11 and 12 or FIGS. 11 and 13) and a material flow in a honing operation. Referring to FIG. 14, a particle-containing liquid 213 accelerated by compressed air is ejected out of a nozzle 201 and impinged onto a sleeve 204 surface to scrape off the resin coating layer thereon. The sleeve 204 is supported by a masking member 205 and rotated by a motor 206 in an indicated arrow direction. The nozzle 201 is vertically moved along a shaft 202 to effect the honing over the entire surface of the sleeve 204. The particle-containing liquid 213 ejected out of the nozzle 201 is recovered in the honing deice bottom and uniformly stirred by a stirring blade 209 and a motor 208 and then withdrawn through a pipe 210 connected to the bottom and resent by a pressurizing pump 211 through a pipe 203 to the nozzle 201.

In the honing liquid, honing particles may be dispersed in a proportion of 2–20% by volume based on the honing liquid, i.e., the total of the particles and a suspension liquid (representatively, water). Below 2%, the scraping or scouring efficiency is lowered. Above 20%, the flowability of the honing liquid becomes worse to provide a lower discharge rate through the nozzle, thus also lowering the scraping or scouring efficiency.

A better honing efficiency is generally attained at a smaller distance between a honing nozzle 201 tip and a sleeve 204, but too small a distance is liable to result in a honing irregularity in the system of moving the nozzle while rotating the sleeve 204. Accordingly, a distance of 10–400 is preferred. Honing particles discharged out of the nozzle are caused to moderately impinge onto the sleeve 204 under the influence of water discharged simultaneously therewith. As a result, the impact by the particles is milder than in the dry sand blasting using the suspension liquid (water), thus causing less gap function increase and less breakage of the particles. Further, because of the washing effect exerted by the discharged suspension liquid, the remaining of particles ejected into or embedded at the substrate surface is reduced, thus suppressing the occurrence of surface defects, such as projections, liable to cause image defects, after the formation of a fresh resin coating layer following the scraping of the coating layer.

In the present invention, it is important to appropriately set the honing conditions for removing the resin coating layer of a used developer-carrying member. Thus, the conditions should be set so as to effectively remove the resin coating layer while obviating the deformation of the resin coating layer substrate and the formation of unnecessary surface unevenness on the scraped or honed surface after removal of the resin coating layer.

In the present invention, solid particles used as honing particles should preferably have an average particle size (weight-average particle size) of 15–100 $\mu$m. If the average particle size is below 15 $\mu$m, it becomes difficult to attain a sufficient scraping or scouring effect because of too small a mass even when discharged together with the liquid at a strong air pressure, or a long honing time is required even if a sufficient scraping is possible. On the other hand, at an average particle size exceeding 100 $\mu$m, the substrate is liable to be deformed to provide a larger gap fluctuation due to association of an air pressure and the liquid and particle pressures. Further, the substrate surface after the resin coating layer removal is liable to have too large a surface roughness so that it is difficult to have an appropriate level of surface roughness after the coating with a fresh resin coating layer. The resin coating layer thus formed is liable to have a low durability and cause abrasion or peeling during a repetitive use thereafter.

In the present invention, the nozzle for discharging the particle-containing honing liquid may preferably have an inner diameter which is (0.50–1.0 times the cylindrical substrate outer diameter. Below 0.5 times, the honing particles are liable to impinge onto a localized part on the substrate, thus, causing ununiform and unstable scraping to result in a larger gap fluctuation. On the other hand, above 1.0 times, a high air pressure is required in order to achieve a uniform discharge of the honing liquid, thus being liable to excessively deform the substrate to result in a larger gap fluctuation and ununiform surface shapes due to an increased number of particles impinging onto the cylindrical substrate at angles close to the tangential lines of the substrate. Further, the efficiency of honing particle impingement onto the substrate becomes worse to result in insufficient scraping of the resin coating layer.

The honing nozzle sectional shape may ordinarily be circular but can be deformed to e.g., an elliptical shape. In the latter case, it is preferred that the nozzle is caused to have a sectional shape confronting a cylindrical substrate giving an inner diameter of at most 1.0 times the substrate outer diameter in a direction perpendicular to the substrate extension and a nozzle aperture having a sectional area of 0.5–1.0 times the sectional area of the substrate based on the outer diameter of the substrate.

It is preferred to adopt a honing air, pressure of $1\times10^5$ Pa–$5\times10^5$ Pa. Below $1\times10^5$ Pa, not only the scraping force is lowered but also the discharge state becomes ununiform, thus being liable to resulting in scraping irregularity. On the other hand, above $5\times10^5$ Pa, the substrate is liable to be deformed to result in a larger gap fluctuation, and embedding of the honing particles at the substrate surface is liable to occur. A suppressed honing air pressure of at most $4\times10^5$ Pa is preferred.

By satisfying the above conditions, it is possible to scrape off the resin coating layer to provide a surface having uniform unevenness showing a central line-average roughness Ra of at most 0.8 $\mu$m without causing an increase in gap fluctuation, thus resulting in a gap fluctuation of at most 30 $\mu$m, preferably at most 15 $\mu$m.

In the present invention, it is preferred that the resin coating layer on the substrate is completely scraped off, but the continuation after removal of the resin coating layer can result in embedding of honing abrasive particles at the substrate surface to obstruct a fresh resin coating layer formation thereon. Accordingly, the substrate after the honing can retain a remaining portion of resin coating layer thereon if it satisfies a required surface roughness.

As for abrasive particles used in the honing, solid particles having a certain level of hardness, including those of glass (beads), silica, steel (balls), ferrite, alumina, silicon carbide, zirconia, alumina-zirconia, boron carbide, solid solution such as alumina-titanium oxide, complex oxide such as aluminum borate; resins, such as phenolic resin, melamine resin and nylon; magnetic particles comprising phenolic resin and magnetic particles; and resin particles containing various fillers.

In the present invention, the solid particles used as honing abrasive particles may preferably have a true density of 0.8 g/cm$^3$–5.0g/cm$^3$, more preferably up to 4.0 g/cm$^3$. At a true density of below 0.8 g/cm$^3$, even when discharged at a high air pressure, it becomes difficult to attain a sufficient scraping effect, or too long a processing time is required even if the scraping is performed. On the other hand, at a true density in excess of 5.0 g/cm$^3$ the substrate is liable to be deformed to provide a larger gap fluctuation due to association of an air pressure and the liquid and particle pressures. Further, the substrate surface after the resin coating layer removal is liable to have too large a surface roughness so that it is difficult to have an appropriate level of surface roughness after the coating with a fresh resin coating layer. The resin coating layer thus formed is liable to have a low durability and cause abrasion or peeling during a repetitive use thereafter. Further, the circulation of the abrasive particles within the honing system can be obstructed and the particle content in the honing liquid becomes unstable due to sedimentation to result in irregular scraping.

The cylindrical substrate may preferably be rotated about its axis at a constant velocity during the honing. The speed of the rotation can be determined arbitrarily depending on the substrate since the peripheral speed varies depending on the substrate outer diameter, but may preferably be set to be ca. 50–150 rpm. Too low a rotation speed is liable to result in irregular scraping or a larger gap fluctuation. The upper limit is not crucial, but too high a rotation speed may require increased apparatus accuracy and strength resulting in an increase in processing cost in view of an pressures of honing liquid and discharge air applied to the substrate.

In the honing operation, the honing nozzle tip may preferably be moved in a direction of the substrate axis extension as shown in FIG. 12 or 13. At a larger inclination from the substrate axis extension, the resin coating layer can be scraped irregularly to result in oblique streaks in images formed by using the regenerated developer-carrying member in some cases.

The number of honing nozzle(s) (or gun(s)) used in the honing apparatus may be one or a plurality (e.g., ca. 2–4), but each honing nozzle (tip) should be moved in the substrate axis extension direction.

Next, a method of disposing abrasive particles on the resin coating layer of a used developer-carrying member so thath at least a portion of the abrasive particles are movable relative to a support therefor, and moving the abrasive particles relative to the developer-carrying member to scrape off at least a portion of the resin coating layer, will be described.

Prior to operation of the method, the used developer-carrying member may be subjected to toner removal similarly as in the above-mentioned methods.

Figure 15:
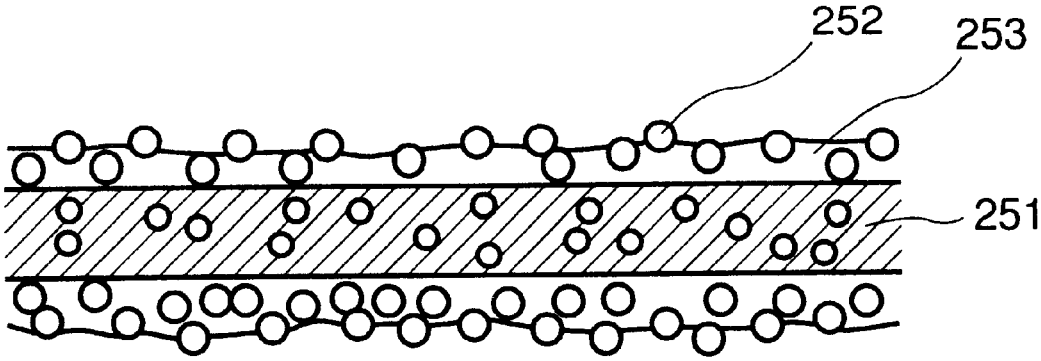
FIG. 15 is a schematic sectional view of an abrasive sheet member comprising a porous support sheet impregnated with a liquid containing abrasive particles dispersed therein and carrying the abrasive particles in a state such that at least a portion of the abrasive particles are movable relative to the support sheet.

In this method, abrasive particles are disposed on a support so that a portion or all of the abrasive particles are movable relative to the support, and the abrasive particles are moved relative to the developer-carrying member to scrape off at least a portion of the resin coating layer. The abrasive particles can be disposed either in a dry state or in a wet state. For example, it is possible to use abrasive particles disposed on a support formed by application of the abrasive particles dispersed in a liquid and evaporating the liquid. It is particularly preferred to use an abrasive member formed by impregnating a porous support sheet with a dispersion liquid or paste containing abrasive particles on the support. FIG. 15 is a schematic sectional view of an example of such an abrasive member. Referring to FIG. 15, a support sheet 251 is impregnated with a liquid or paste medium 253 containing abrasive particles 252 dispersed therein. The abrasive particles 252 are present on the surface and within the porous support sheet 251 and flowability held in the medium 253. The support sheet 251 may comprise any material which has a strength durable in the scraping of the resin coating layer of the developer-carrying member, is uniform in thickness and other properties, has good affinity with the medium 253 and is resistant to dissolution or corrosion. The support sheet 251 may for example comprise a plastic film, paper or pulp sheet or a porous sheet. Foam sheets, unwoven cloth or woven cloth or fiber-planted film having an elasticity and bulkiness may also be preferably used.

The abrasive particles 252 may preferably have an average primary particle size of 0.01–50 $\mu$m, further preferably 1.0–40 $\mu$m. If the average primary particle size is below 0.01 $\mu$m, the scraping function thereof onto the resin coating layer of the developer-carrying member is liable to be insufficient. On the other hand, if the average primary particle size exceeds 50 $\mu$m, the abrasive particles may exhibit a sufficient scraping function to the resin coating layer but the scraping power is liable to be excessive to scrape or damage the substrate of the developer-carrying member, thus resulting in surface unevenness exceeding a central line-average roughness Ra exceeding 0.8 $\mu$m. The abrasive particles may preferably have a Mohs hardness of at least 3. If the Mohs hardness is belows, the scraping function to the resin coating layer is liable to be insufficient. The abrasive particles may for example comprise SiC, silica, alumina, titanium oxide, $Cr_2O_3$, $Fe_2O_3$, ZrC, strontium titanate, silicon carbide, diamond, zirconia, zircon, soda glass, or tungsten carbide.

In a preferred embodiment, a support sheet is impregnated with a liquid or paste medium containing abrasive particles, so that at least a portion (i.e., a portion or all) of the abrasive particles are movable, thereby providing an abrasive member (or abrasive sheet). The liquid or paste medium may comprise water, an organic solvent or low-viscosity oil, or any material capable of uniformly dispersing the abrasive particles therein without dissolving the abrasive particles. Examples of dispersion medium other than water, may include: alcohols, such as methanol, ethanol and isopropyl alcohol; ketones, such as methyl ethyl ketone; and aromatic liquids, such as xylene and toluene.

Figure 16:
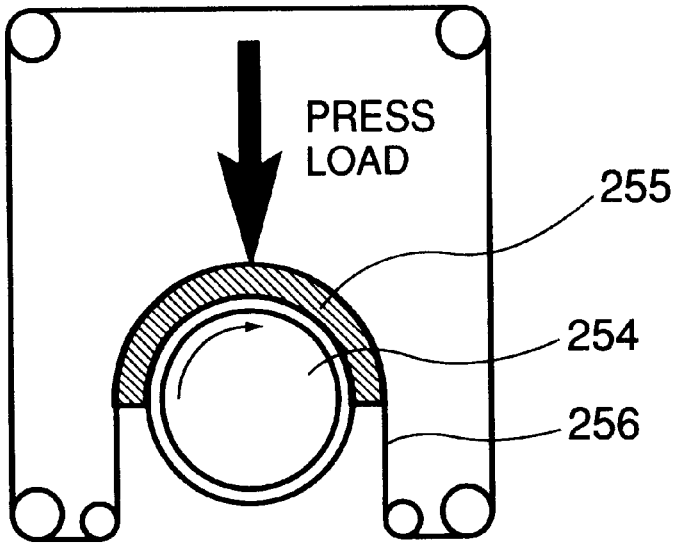
FIG. 16 illustrates a scraping system using an abrasive sheet member of FIG. 15.

Next, a step of scraping the resin coating layer of the developer-carrying member with such an abrasive member carrying the abrasive particles on at least a surface contacting the developer-carrying member of support sheet in a state where at least a portion of the abrasive particles are movable relative to the support sheet by moving the abrasive member relative to the developer-carrying member, will be described. FIG. 16 illustrates such a scraping step sing such an abrasive sheet. Referring to FIG. 16, a used cylindrical developer-carrying member (sleeve) 254 is moved in its longitudinal direction while rotating the developer-carrying member 254 in a clockwise direction (as indicated) or in a counterclockwise direction. During the movement, the resin coating layer of the developer-carrying member 254 is rubbed with an abrasive sheet member 255 receiving a pressing load exterted by an endless belt 256 of, e.g., steel to be scraped off to provide a surface having uniform unevenness showing a central line-average roughness Ra of at most 0.8 μm without causing an increase in gap fluctuation or substrate surface damages.

In the present invention, it is preferred that the resin coating layer on the substrate is completely scraped off, but the continuation of scraping after removal of the resin coating layer can result in scraping of or scars at the substrate surface to obstruct a fresh resin coating layer formation thereon. Accordingly, the substrate after the scraping can retain a remaining portion of resin coating layer thereon if it satisfies a required surface roughness.

Next, a regeneration method by scraping with an abrasive tape will be described in some detail.

As a pre-treatment, the remaining toner attached to the used developer-carrying member may be removed in order to obviate possible plugging of the abrasive tape and soiling of the substrate after removal of the resin coating layer.

It is also possible to roughly scrape off only a surface portion of the resin coating layer by one or more of blasting, honing or abrasion prior to the scraping by such an adhesive tape.

Figure 17:
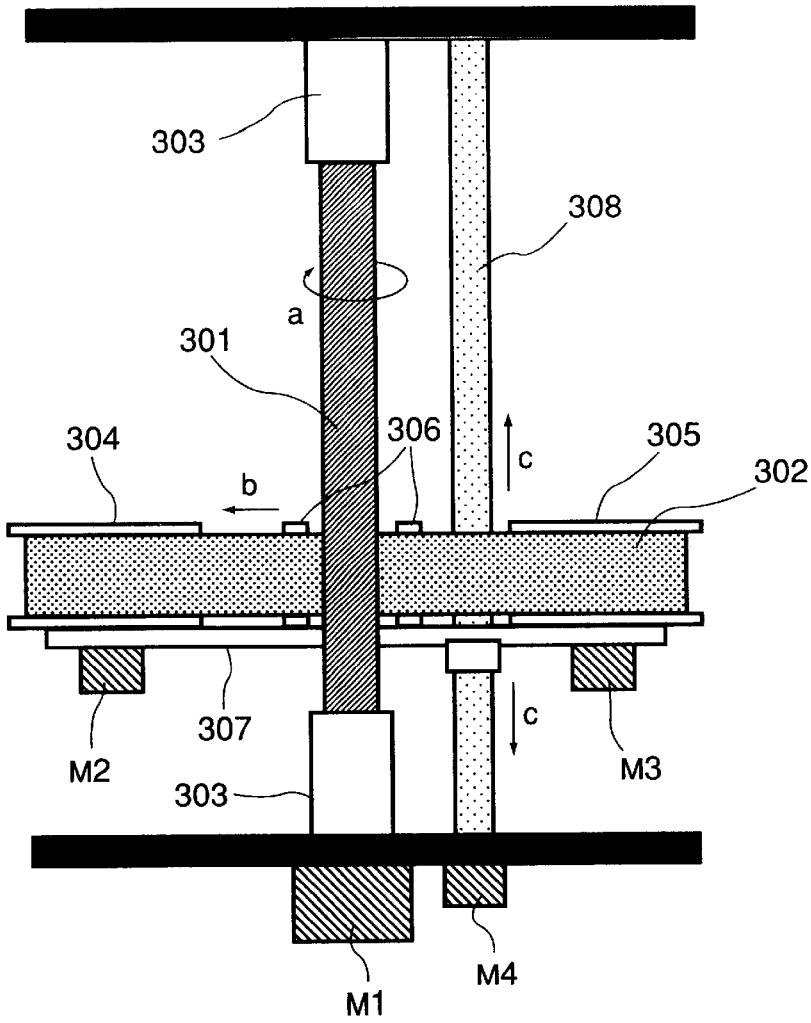
FIGS. 17 and 18 are a front view and a schematic plan view, respectively, of a scraping system using an abrasive tape.

FIGS. 17 (front view) and 18 (schematic top view) of a scraping system using such an abrasive tape. Referring to these figures, a used cylindrical developing sleeve 301 to be regenerated is supported to be rotatable at a constant speed in an indicated arrow a direction by a rotation motor M1 while being covered with masking members 303 at both ends thereof. An abrasive tape 302 is moved along supporting bars 306 in an indicated arrow b direction perpendicular to the extension of the sleeve 301 so as to contact the sleeve 301 over a certain contact angle θ. The abrasive tape 302 is fed from a tape feed roller 305 rotated in an indicated arrow d direction at a constant speed by a motor M3 and wound up about a winding roller 304 rotated in an indicated arrow d direction at an equal speed by a motor M2, while exerting a prescribed pressing force onto the sleeve 301. Further, a tape feeding mechanism 307 including the feed and winding rollers 305 and 304 is supported by a supporting pole 308 so as to be movable vertically, i.e., along an extension of the sleeve 301, in indicated arrow c directions. In order to recover the scraped powder of the resin coating layer from the sleeve 301, a dust-collecting device (not shown) may be disposed.

During the operation of the scraping system, the abrasive tape 302 is pressed at a prescribed pressure against the developing sleeve 301 rotated at a constant speed, and moved and wound up at a constant speed, thereby uniformly scraping the resin coating layer on the developing sleeve 301 with a continually refreshed surface. Further, by vertically moving the tape feeding mechanism 307 at an adjusted speed, the resin coating layer on the developing sleeve 301 can be scraped all over the axially extending length. Without being specifically restricted to the one shown in FIGS. 17 and 18, the scraping system or device of the present invention is characterized as one including an abrasive tape comprising at least abrasive particles bound with a binder resin and having a ten point-average surface roughness Rz of preferably 6.0–30 μm is pressed against a resin coating layer formed on an axially rotating hollow or solid cylindrical substrate at a pressure of $1.0\times10^5$–$5.0\times10^5$ Pa to scrape at least a portion of the resin coating layer, thereby providing a surface leaving unevenness exhibiting a central-line average roughness of at most 0.8 μm.

It is important to appropriately set the scraping conditions or removing the resin coating layer of a used developer-carrying member. Thus, the conditions should be set so as to effectively remove the resin coating layer while obviating the deformation of the developer-carrying member substrate and the formation of unnecessary surface unevenness on the scraped substrate surface after removal of the resin coating layer.

It is preferred that the developing sleeve is axially rotated at a constant speed. The revolution speed may be appropriately selected in view of a peripheral speed varying depending on the sleeve substrate diameter but may preferably be selected in a range of 500–1500 rpm so as to effect a uniform scraping. At a smaller rotation speed, the rotation is liable to be ununiform in connection with an abrasive tape abutting pressure described below to cause irregular scraping or increased gap fluctuation. The upper limit is not particularly restricted, but too large a rotation speed is liable to sever the abrasive tape 302 due to a heat of rubbing with the abrasion tape.

The abrasive tape surface may preferably have a surface ten point-average roughness Rz of 6.0–30 μm. If Rz is below 6.0 μm, it becomes difficult to attain a sufficient scraping effect even when scraped at a strong abutting pressure, or a long processing time becomes necessary even if the scraping is possible. If Rz exceeds 30 μm, the sleeve substrate is liable to be deformed due to an interaction with the abrasive tape abutting pressure, thus increasing a gap fluctuation. Further, the substrate surface after the resin coating layer removal is liable the have too large a surface roughness so that it is difficult to have an appropriate level of surface roughness after the coating with a fresh resin coating layer. The resin coating layer thus formed is liable to have a low durability and cause abrasion or peeling during a repetitive use thereafter. However, for the purpose of roughly scraping only an upper layer portion of the resin coating layer, an abrasive tape having an Rz exceeding 30 μm, and for the purpose of post treatment for providing a uniform surface roughness, an abrasive tape having an Rz below 6.0 μm can be used.

According to our study, the scraping or abrasive force of an abrasive tape is better correlated with Rz than a central line-average roughness Ra, so that Rz is used to represent a roughness of the abrasive tape.

The abrasive tape my preferably be abutted to a used developing sleeve at a pressure of $1.0\times10^5$–$5.0\times10^5$ Pa. Below $1.0\times10^5$ Pa, the scraping power is lowered to result in an unstable scraping amount or scraping irregularity. On the other hand, above $5.0\times10^5$, the sleeve substrate is liable to be deformed to result in an increased gas fluctuation. An abutting pressure of at most $4.0\times10^5$ Pa is preferred.

The abrasive tape abutting pressure values described herein are based on values measured by operating an abrasive tape feeding unit (307 in FIG. 7) as mentioned or pressing an abrasive tape against an abutting load measurement member placed in the position of a developing sleeve (301) set on a push-pull scale ("PSM10K-Type", made by K.K. Imada) to measure a load (kg-f) exerted by the abrasive tape 302 when the abrasive tape 302 is linearly held between the supporting rollers 306, and converting the measured load (kg-f) into an SI-unit value.

By satisfying the above conditions, it is possible to scrape off the resin coating layer to provide a surface having uniform unevenness showing a central line-average roughness Ra of at most 0.8 μm without causing an increase in gap fluctuation, thus resulting in a gap fluctuation of at most 30 μm, preferably at most 15 μm.

In the present invention, it is preferred that the resin coating layer on the substrate is completely scraped off, but the continuation after removal of the resin coating layer can result in embedding of abrasive particles at the substrate surface to obstruct a fresh resin coating layer formation thereon. Accordingly, the substrate after the scraping can retain a remaining portion of resin coating layer thereon if it satisfies a required surface roughness.

The abrasive tape may preferably have a form of sheet or film comprising abrasive particles bound together with at least a binder onto a support sheet.

The binder resin may comprise a thermoplastic resin, a thermosetting resin, a reactive resin, an electron beam-curable resin, an ultraviolet ray-curable resin, a visible curable resin or a mixture of these, which per may be known heretofore, optionally together with additives, such as a dispersing agent, a lubricant, an anti-static agent, an antioxidant, an anti-mold agent, a colorant or a solvent.

The abrasive particles used in the abrasive tape may comprise any abrasive particles having a hardness larger than that of the resin coating layer on the sleeve support. If the abrasive particles have a hardness lower than the resin coating layer, a sufficient scraping effect cannot be attained even at a large abutting pressure. The abrasive particles may comprise a material, such as α-alumina, silicon carbide, chromium oxide, cerium oxide, non-magnetic iron oxide, diamond, γ-alumina, α.β-alumina, fused alumina, corundum, artificial diamond, garnet, emery (principally comprising corundum and magnetite), silica, silicon nitride, boron nitride, molybdenum carbide, boron carbide, tungsten carbide and titanium carbide. Among these, particles of alumina or silicon carbide are preferably used in view of popularity.

The abrasive particles may preferably have particle sizes suitable for providing an abrasive tape with a ten point-average surface roughness Rz of 6.0–30 μm. It is further preferred to use abrasive particles having an average particle size of 3.0–30 μm. If the average particle size is below 3.0 μm, the number of particles projecting above the binder resin layer becomes smaller, so that uniform scraping becomes difficult, and it becomes difficult to provide prescribed ten point-average surface roughness Rz suitable for scraping. On the other hand, if the average particle size is above 30 μm, a larger amount of binder resin is required in order to provide a prescribed surface roughness and a larger resin layer thickness is required, so that the resultant abrasive tape becomes rigid and the fitting of the tape onto the sleeve becomes difficult. Further, as the unevenness picth of the abrasive particles becomes larger, the uniform scraping becomes difficult, thus making it difficult to suppress the surface roughness Ra of the sleeve after the scraping to at most 0.8 μm. It is preferred to use abrasive particles having a sharp particle size distribution.

The abrasive particles may have a shape which is plate-like, block-like, angular, acicular or spherical, while it may be restricted by material thereof in some cases.

The abrasive tape may comprise a base sheet of various materials, examples of which may include: polyesters, such as polyethylene terephthalate, polyethylenenaphthalate; polyolefins, such as polypropylene; cellulose derivatives, such as cellulose triacetate, and cellulose diacetate; vinyl resins, such as polyvinyl chloride; polycarbonate, polyimide, polyamide, polysulfone, polyphenylsulfone, polybenzoxazole; metals, such as aluminum and copper; glass and ceramic.

The abrasive tape may have, e.g., a thickness of 10–100 μm and a width of 5 cm±1 cm as sizes suitable for handling, but may basically have any thickness not readily severable under an abutting pressure as mentioned above, and any width not exceeding a coating width (or length) of the resin coating layer on the sleeve substrate.

The abrasive tape may preferably be moved (i.e., fed and wound) in a circumferential direction of the sleeve while exerting a scraping action along with the sleeve rotation. The tape feeding speed is not particularly restricted, but too low a feed speed is liable to result in plugging of the abrasive tape leading to an unsufficient scraping function. The upper limit is not particularly restricted, but too large a feed speed is economically disadvantageous. The tape feeding direction b may preferably be counter to a circumferential moving direction due to rotation of the sleeve substrate 301 so as to exert a large scraping effect.

During the scraping operation, it is preferred that the abrasive tape is moved vertically in a direction c of the sleeve axis extension. The moving speed is not particularly restricted, but too small a moving speed is liable to result in scraping irregularity and too large a moving speed is liable to increase the processing cost.

During the scraping operation it is preferred that the abrasive tape (302) contacts the sleeve (301) at a contact angle θ (FIG. 18) of at least 90 deg. If the contact angle is below 90 deg., the abrasive tape contacts the sleeve with a relatively small area, thus being liable to achieve a sufficient scraping effect and result in a scraping irregularity.

The sleeve after the scraping operation can be subjected to one or more of post treatments, such as blasting, honing, cutting or polishing for providing a desired surface roughness.

After the resin coating layer removal, it is preferred to add a step of removing abrasive particles and scraping refuse of resin coating layer attached to the substrate. Such removal of solid particles can be effected blowing with compressed air to the substrate. In case where an oily attachment is present in addition to such solid attachment, which can adversely affect a subsequent resin coating layer formation (as by adhesion obstruction), it is preferred to wash the substrate with a solvent or a solution. In a preferred embodiment, the substrate after the resin coating layer removal may be first washed with a surfactant solution under heating or application of ultrasonic wave and then washed with warm water.

Next, the electroconductive resin coating layer of the developer-carrying member will be described in detail.

The binder resin constituting the electroconductive resin coating layer may comprise a known resin, examples of which may include: phenolic resin, epoxy resin, polyamide resins, polyester resin, polycarbonate resin, polyolefin resin, silicone resin, fluorine-containing resin, styrene resin, vinyl resin, cellulose resin, melamine resin, urea resin, polyurethane resin, polyimide resin, and acrylic resin. In view of mechanical strength, a curable or setting-type resin is preferred, but it is possible to use a thermoplastic resin having a sufficient mechanical strength.

The resin coating layer formed on a developer-carrying member substrate (sleeve substrate) should preferably be electroconductive in order to prevent the sticking of developer onto the developer-carrying member and the charging failure of developer from the developer-carrying member surface due to excessive charge of the developer. More specifically, the resin coating layer may preferably have a volume resistivity of at most $10^4$ ohm.cm, more preferably at most $10^3$ ohm.cm. Above $10^4$ ohm.cm, the charging failure of developer is liable to occur, thus resulting in blotchy, spotty or ripple images.

In order to provide the above-mentioned volume resistivity to the resin coating layer, it is preferred to incorporate an electroconductive substance in the coating layer. Examples of such an electroconductive substance may include: fine powders of metals, such as aluminum, copper, nickel and silver; metal oxides, such as antimony oxide, indium oxide, tin oxide, titanium oxide, zinc oxide, molybdenum oxide, and potassium titanate; carbon fiber; carbon black, inclusive of furnace black, lamp black, thermal black, acetylene black and channel black; and graphite; and metal fibers.

Among the above, carbon black, particularly electroconductive amorphous carbon, is suitably used in view of excellent electroconductivity, easiness of obtaining arbitrary electroconductivity by controlling the addition amount thereof, and good dispersibility when formulated into a paint. Such an electroconductive substance may preferably be added in an amount of 1–100 wt. parts per 100 wt. parts of the binder resin. Below 1 wt. part, it is ordinarily difficult to lower the resistivity to a desired level, and the attachment of a toner onto the resin coating layer of the developer-carrying member is liable to occur. Above 100 wt. parts, the strength, particularly the wear resistance, of the coating layer is liable to be lowered especially in the case of using electroconductive fine powder having particle sizes of sub-micron order.

In the resin coating layer, it is possible to incorporate solid particles in the resin coating layer so as to provide surface unevenness. Examples of such solid particles may include particles of: vinyl polymers or copolymers such as polymethyl methacrylate, polyethyl acrylate, polybutadiene, polyethylene, polypropylene, and polystyrene; other resins, such as benzoguanamine resin, phenolic resin, polyamide, fluorine-containing resin, silicone resin, epoxy resin, and polyester resin; oxides, such as alumina, zinc oxide, silica, titanium oxide, and tin oxide; carbides; imidazole compounds; and resin particles subjected to an electroconductivity-imparting treatment. The inclusion of an imidazole compound is also effective for triboelectrification of the toner.

Spherical resin particles are effective for providing a uniform and suitable level of surface roughness by inclusion of a relatively small amount thereof and may suitably be formed by suspension polymerization or dispersion polymerization. Such spherical resin particles may for example comprise: acrylic resins, such as polyacrylate and polymethacrylate; polyamide resins, such as nylon; polyolefin resins, such as polyethylene and polypropylene; silicone resins, phenolic resins, polyurethane resins, styrene resins, and benzoguanamine resins. Such spherical resin particles may also be obtained by subjecting resin particles produced through pulverization to a thermal or physical sphering treatment.

Such spherical resin particles can be used after attaching or affixing inorganic fine powder to the surface thereof. Such inorganic fine powder may comprise, e.g., oxides such as $SiO_2$, $SiTiO_2$, $CeO_2$, CrO, $Al_2O_3$, ZnO, MgO and $TiO_2$; nitrides such as $Si_3N_4$; carbides, such as SiC; and sulfate salts and carbonate salts, such as $CaSO_4$, $BaSO_4$ and $CaCO_3$.

Such inorganic powder may have been treated with a coupling agent so as to improve the adhesion with the resin and impart hydrophobicity to the particles. Examples of the coupling agent may include: silane coupling agents, titanate coupling agents and zircoaluminate coupling agents. More specifically, examples of such a silane coupling agent may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramthyldisiloxane, 1,3-diphenyltetramethyldisiloxane, and dimethylpolysiloxane having 2 to 12 siloxane units per molecule and containing each one hydroxyl group bonded to Si at the terminal units.

By attaching such inorganic fine powder to the spherical resin particles, it is possible to improve the dispersibility of the particles, and the surface uniformity, the anti-soiling characteristic, the toner triboelectrification characteristic and the anti-wear resistance of the resin coating layer.

It is also preferred to use electroconductive spherical particles so as to improve the anti-soiling resistance and anti-wearing resistance of the spherical particles. Examples of such electro-conductivity-imparted spherical particles may include: particles of metal oxides such as titanium oxide, niobium oxide, manganese oxide and lead oxide, or barium sulfate, surface-coated with a good conductivity-substance, such as tin oxide; and insulating metal oxides, such as zinc oxide, copper oxide and iridium oxide, doped with a metal having a different oxidation number.

The electroconductive spherical particles may preferably have a volume resistivity of at most $10^6$ ohm.cm. Above $10^6$ ohm.cm, the toner soiling prevention effect is liable to be insufficient.

The added spherical particles may preferably have a true density of at most 3 g/cm$^3$. Above 3 g/cm$^3$, as the dispersibility of the spherical particles in the resin coating layer is liable to be insufficient, it becomes difficult to provide the coating layer with a uniform surface roughness, the uniform toner charging performance and the strength of the coating layer become insufficient, and also the particles are liable to fail in exhibiting their own anti-soiling effect and wear resistance.

Examples of the electroconductive spherical particles may include: spherical carbon particles, spherical resin particles surface-treated with a conductive substance, and spherical resin particles containing electroconductive fine particles dispersed therein.

Among the above-mentioned particles, it is preferred to use electroconductive particles inclusive of electroconductive spherical particles as disclosed in, e.g., JP-A 08–240981. Because of electroconductivity, charge is less liable to be accumulated on the particle surface, thus alleviating the toner attachment and improving the toner charging performance. The particles may preferably have a volume resistivity of at most $10^6$ ohm.cm, more preferably $10^{-}$to $10^6$ ohm.cm. Above $10^6$ ohm.cm, the toner soiling or melt attachment is liable to occur with spherical particles exposed to the surface by wearing of the coating layer, and quick and uniform charging becomes difficult.

Spherical particles are preferred because of a reduced contact area with the developer-carrying member (developing sleeve) regulation member abutted thereto, thus alleviating the increase in sleeve rotation torque and toner attachment due to friction with the regulation member. This effect is pronounced especially when electroconductive spherical particles are used.

A preferred class of electroconductive spherical particles may be obtained by calcining resinous spherical particles or mesocarbon microbeads for carbonization and/or graphitization to obtain spherical carbon particles having a low-density and good conductivity. The resinous spherical particles may comprise, e.g., phenolic resin, naphthalene resin, furanesin, xylene resin, divinylbenzene polymer, styrene-divinylbenzene copolymer, or polyacrylonitrile. The mesocarbon microbeads may be obtained by washing spherulite generated during heating calcination of medium pitch with a large quantity of solvent, such as tar, medium oil or quinoline.

In a preferred method of obtaining such electroconductive spherical particles, spherical resin particles of, e.g., phenolic resin, naphthalene resin, furan resin, xylene resin, divinylbenzene polymer, styrene-divinylbenzene copolymer or polyacrylonitrile, are surface-coated with a bulk mesophase pitch by a mechano-chemical process, and the coated particles are heat-treated in an oxidizing atmosphere and then calcined for carbonization and/or graphitization in an inert gas atmosphere or under vacuum. The spherical carbon particles obtained according to this method are preferred because of a coating having a higher crystallinity due to graphitization and an improved conductivity.

The spherical carbon particles obtained by any of the above methods can have a controlled conductivity by changing the calcining condition and are preferably used in the present invention. The spherical carbon particles can be further plated with electroconductive metal and/or metal oxide, as desired, in order to provide a further enhanced conductivity within an extent of not causing an excessively large true density of the resultant conductive spherical particles.

The surface treatment of base or core spherical resin particles with an electroconductive substance may also be performed by mechanically blending such core particles with electroconductive fine particles having a smaller particle size than the core particles to attach the electroconductive fine particles uniformly about the core particles under the action of van der Waals force and electrostatic force and softening the core resin particle surface due to a local temperature increase caused, e.g., by a mechanical impact force, to form a uniform coating layer of electroconductive fine particles on the core resin particles. The base or core resin particles may preferably comprise spherical organic resin particles having a small true density, e.g., particles of resins, such as polymethyl methacrylate, acrylic resin, polybutadiene resin, polystyrene resin, polyethylene, polypropylene, polybutadiene, or copolymers of these resins, benzoguanamine resin, phenolic resin, polyamide resin, nylon, fluorine-containing resin, silicone resin, epoxy resin, and polyester resin. The electroconductive fine particles may preferably have a particle size which is at most ⅛ of that of the core particles so as to form a uniform layer of the electroconductive fine particles.

Spherical resin particles containing electroconductive fine particles uniformly dispersed therein may be formed, e.g., through a process wherein electroconductive fine particles are knead for dispersion with a binder resin, and the kneaded particles are pulverized into a desired particle size, followed by mechanical and thermal treatments for sphering; or a process wherein electroconductive fine particles, a polymerization initiator and other additives are added to a polymerizable monomer and uniformly dispersed by a dispersing machine to form a monomer composition, which is then suspended in a prescribed particle size by a stirrer in an aqueous medium containing a dispersion stabilizer and polymerized to obtain electroconductive fine powder-dispersed spherical resin particles. The thus-obtained electroconductive fine powder-dispersed spherical resin particles can be further provided with a further enhanced electroconductivity by mechanically blending the resin particles with electroconductive fine particles having a smaller particle size than the resin particles to attach the electroconductive fine particles uniformly about the resin particles under the action of van der Waals force and electrostatic force and softening the resin particle surface due to a local temperature increase caused, e.g., by a mechanical impact force, to form a uniform coating layer of electroconductive fine particles oil the electroconductive fine powder-dispersed resin particles.

The spherical particles may preferably have a number-average particle size of 0.3–30 μm, Below 0.3 μm, it is difficult to provide uniform surface unevenness, and in order to provide a large surface roughness, an excessively large addition amount is required to result in a resin coating layer which is brittle and has an extremely low wear resistance. On the other hand, above 30 μm, the particles are liable to excessively protrude out of the developing sleeve surface, so that an excessively thick developer is liable to be formed thereon to result in lower or ununiform developer charges, and points of electrical leakage to the photosensitive drum are liable to be formed under the application of a developing bias voltage.

The average particle size values are based on values measured by using a Coulter counter ("Multisizer II", made by Coulter Electronics, Inc.) equipped with an aperture of 100 μm (or 50 μm for particles of below 3.0 μm). Particle sizes of electroconductive particles were measured by using a particle size meter ("Model LS-230", made by Coulter Electronics, Inc.) equipped with a liquid module.

The resin coating layer on the developer-carrying member can contain a charge controls agent, as desired, which may be selected from those used in toner particles described hereinafter.

Figure 8:
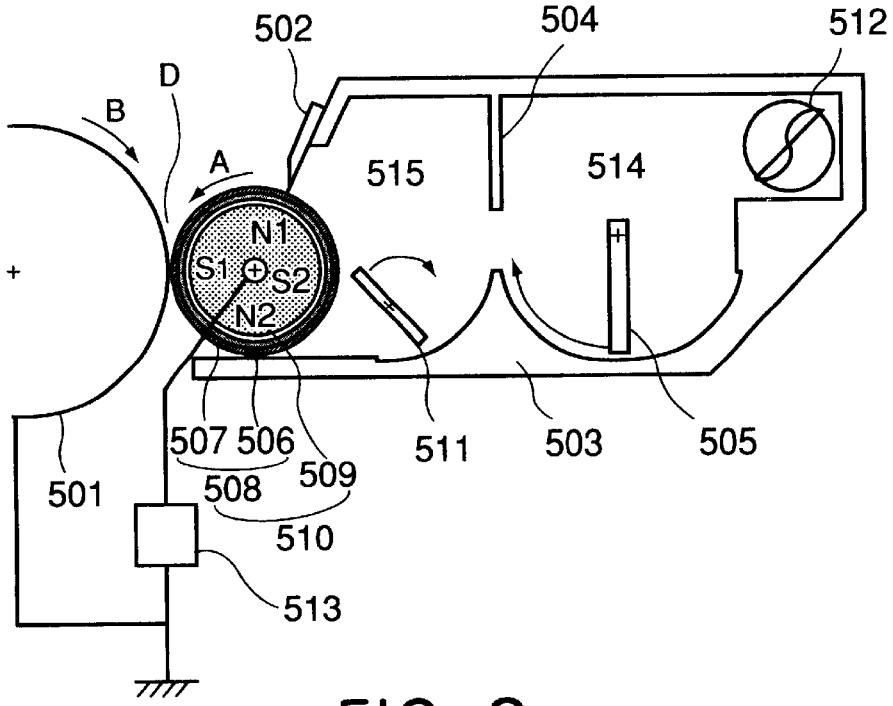
FIGS. 8 to 10 each illustrate an organization of a developing device.
Figure 9:
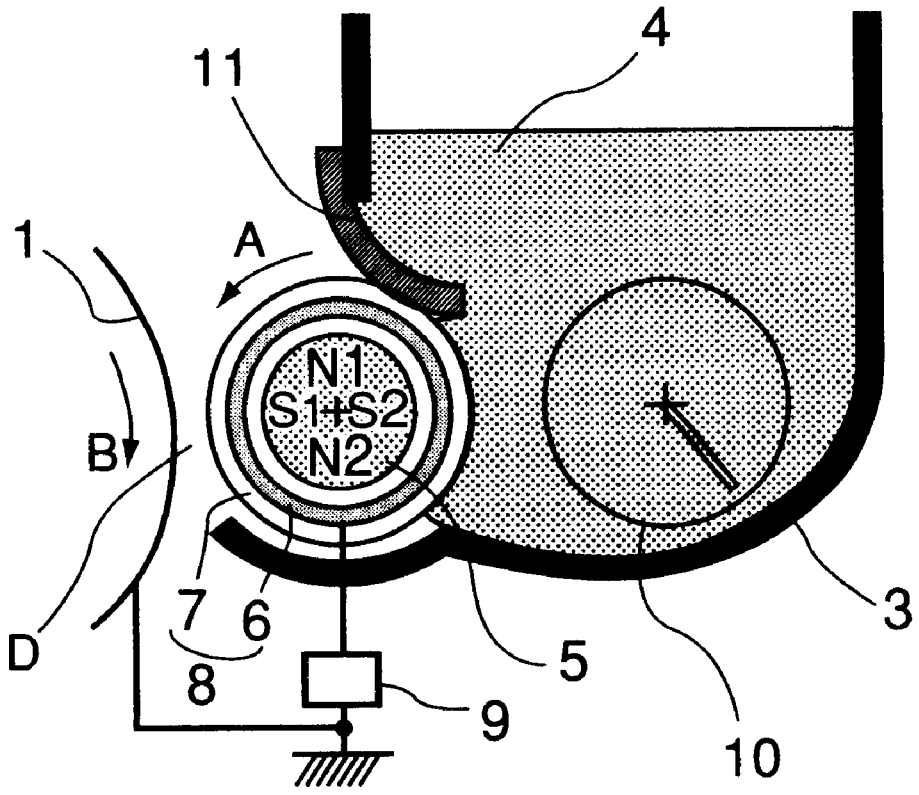
Figure 10:
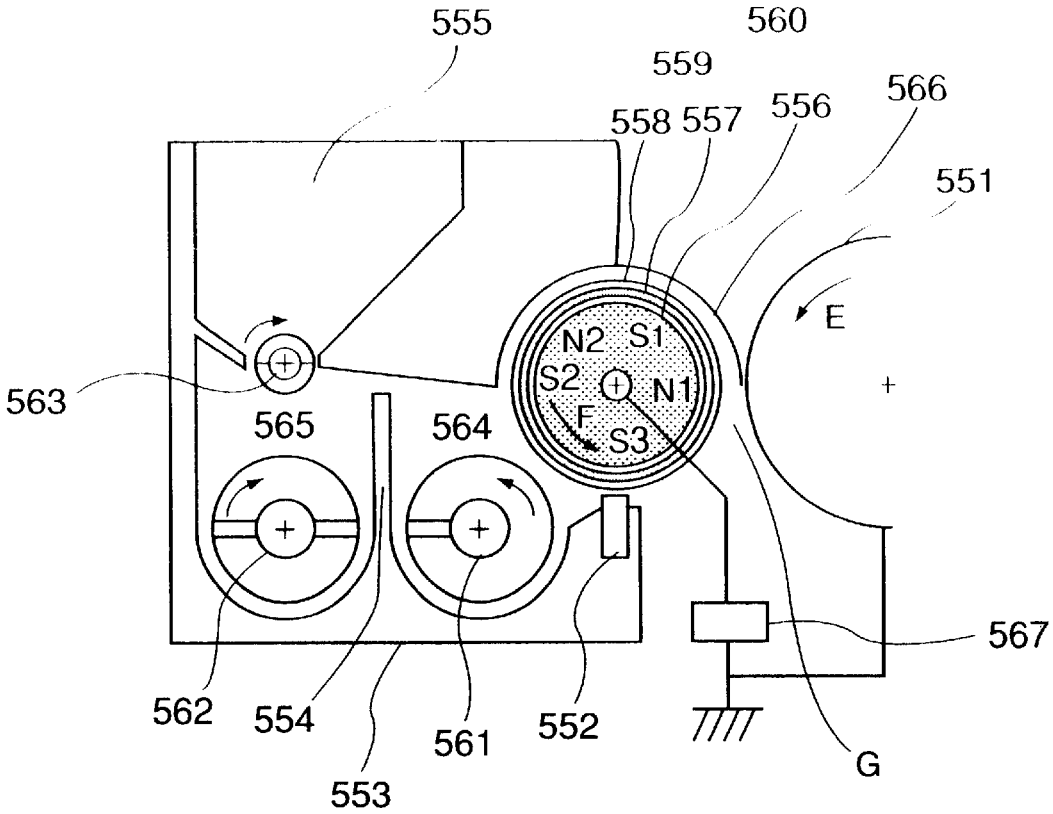

The resin coating layer on the developer-carrying member may preferably have a surface roughness in terms of a central line-average roughness Ra (according to JIS B0601) in a range of 0.3–3.5 μm, of which a further preferred value varies depending on the development scheme. For example, in a developing device as shown in FIG. 8, wherein a magnetic toner is used and its layer thickness is regulated by a magnetic blade 502 disposed with a gap from a developer-carrying member 508, Ra is preferably in the range of 0.3–1.5 μm. Below 0.3 μm, it becomes difficult to attain a sufficient developer conveying performance, thus being liable to cause image defects, such as a lower image density due to toner shortage, and scattering or blotches due to excessively charged toner. Further, toner melt-sticking onto the developer-carrying member is liable to occur. Above 1.5 μm, toner triboelectric charges are liable to be ununiform, thus causing image defects, such as streak irregularities, reversal fog and lower image density due to insufficient charge. On the other hand, in a developing device as shown in FIG. 9 wherein an elastic member 11 is pressed against a developer-carrying member 8, Ra is preferably in a range of 0.8–3.5 μm. Below 0.8 μm, it becomes difficult to attain a sufficient developer conveying performance, thus being liable to cause image defects, such as a lower image density due to toner shortage, and scattering or blotches due to excessively charged toner. Further, toner melt-sticking onto the developer-carrying member is liable to occur. Above 3.5 μm, toner triboelectric charges are liable to be ununiform, thus causing image defects, such as streak irregularities, reversal fog and lower image density due to insufficient charge. Further, in a two-component developing device as shown in FIG. 10, a surface roughness Ra may be selected from the above-mentioned range as the developer-conveying fore is varied depending on magnetic forces varying corresponding to carrier particles and magnetic disposition and also on carrier particle size and the gap between the developer-carrying member and the regulating member, whereas Ra may preferably in the range of 1.0–2.5 μm.

The surface roughness values described herein are based on values measured by using a surface roughness meter ("SE-3400", made by K.K. Kosaka Kenkyusho) under measurement conditions including a cut-off value of 0.8 mm, a measurement length of 8.0 mm, a feed rate of 0.1 mm/sec, and 12 measurement points for giving an average.

In order to further reduce the developer attachment onto the developer-carrying member surface, it is possible to further include a solid lubricant in the resin coating layer. The solid lubricants used for this purpose may include: molybdenum disulfide, boron nitride, graphite, fluorinated graphite, silver-selenium-niobium, calcium chloride-graphite and talc. Such a solid lubricant may preferably be added in an amount of 1–100 wt. parts per 100 wt. parts of the binder resin. Below 1 wt. part, the effect of improving the developer attachment onto the coating layer is scarce. Above 100 wt. parts, particularly in the case of using a material containing a large proportion of fine particles of sub-micron order, the coating layer is liable to have a lower strength (wear resistance). The lubricant particles may preferably have a number-average particle size of 0.2–20 μm, more preferably 1–15 μm. Below 0.2 μm, it becomes difficult to attain a sufficient lubricating effect. Above 20 μm, the particles largely affect the surface shape of the coating layer to result in an ununiform surface, thus adversely affecting the toner uniform charge, and the strength of the coating layer.

The resin coating layer may be formed by dispersing and mixing the respective components in a solvent to form a paint and applying the paint on the substrate. For the dispersion and mixing of the respective components, it is possible to suitably use a known dispersion device using dispersion beads, such as a sand mill, a paint shaker, a dynomill of a pearl mill. The paint application may be performed by a known method, such as dipping, spraying or roller coating.

Gap fluctuation of a developer-carrying member (developing sleeve) may be measured in the following manner.

Figure 5:
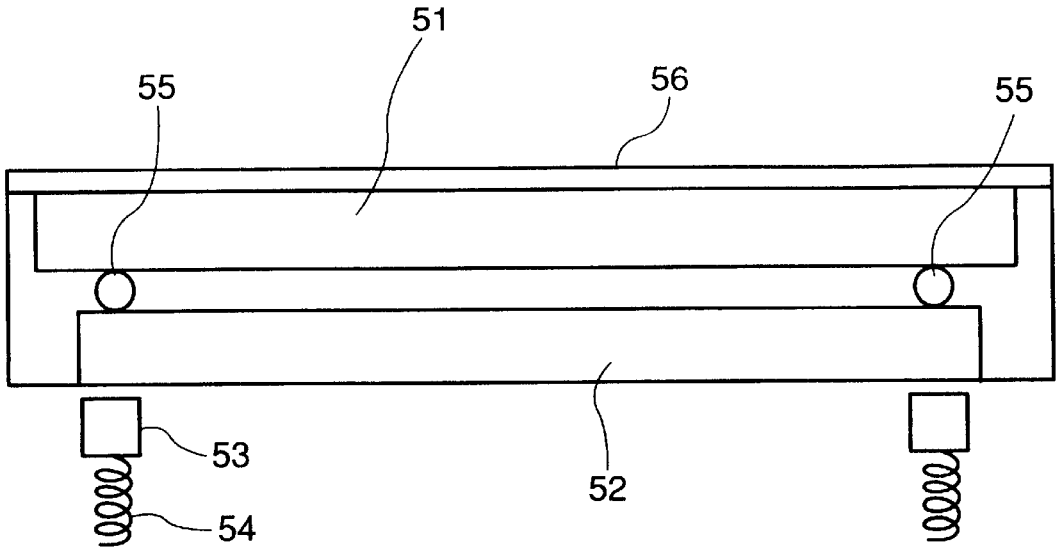
FIGS. 5 and 6 are a plan view and a right side view, respectively, of a gap fluctuation measurement apparatus.
Figure 6:
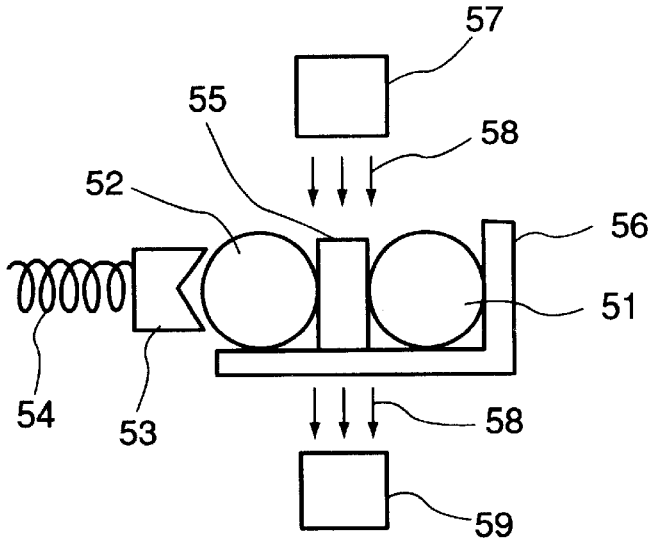

FIG. 5 is a plan view of a measurement apparatus for measuring a straightness and a gap fluctuation of a cylindrical substrate, and FIG. 6 is a right side view of the apparatus.

Referring to FIGS. 5 and 6, the apparatus includes a transparent member 56 of a right-angularly deflected sheet and a cylindrical master gauge 51 disposed at the right angle corner of the transparent member 56. At two parts close to both ends of the master gauge 51, two cylindrical spacers 55 of equal diameter are disposed to stand on a bottom surface of the transparent member 56. Further, a cylindrical substrate 52 is disposed in parallel with the master gauge 51 so as to sandwiched the spacers 55 together with the master gauge 51 by receiving a pressing force from a pressing sheet 53 energized by springs 54 attached to the pressing sheet 53.

Figure 7A:
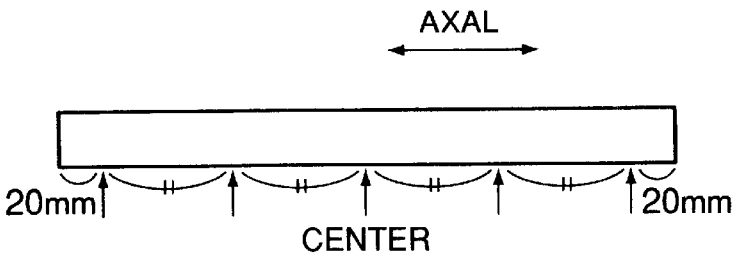
FIGS. 7A and 7B are a front view and a right side view, respectively, of a sleeve substrate for illustrating the manner of evaluating gap fluctuation.

For measurement, a gap between the cylindrical substrate 52 and the master gauge 51 is illuminated by laser light 58 emitted from a laser 57 disposed above, and the laser light having passed through the gap is received by a laser light-receiving unit 59 to measure a gap along an axial length of the cylindrical substrate 52. The measurement is repeated while successively rotating the cylindrical substrate 52. FIGS. 7A an 7B illustrate 80 points of measurement formed by axially selected 5 points (including two points each distant by 20 mm from an associated and three points equally driving the span into equal fourths) and axially 16 points at intervals of 22.5 deg. each.

Developing apparatus according to the present invention will now be described in detail.

FIG. 8 is a schematic sectional view of an embodiment of developing apparatus.

Referring to FIG. 8, an electrophotographic photosensitive drum 501 (as an electrostatic image-bearing member) produced through a known process is rotated in an indicated arrow B direction. A developing sleeve 508 (as a developer-carrying member) is rotated in an indicated arrow A direction while carrying a mono-component developer comprising a magnetic toner contained in a developer vessel to supply the developer to a developing region D where the developing sleeve 508 and the photosensitive drum 501 are opposite to each other. A developing roller 510 is formed by fixedly disposing a magnet roller 509 for magnetically attracting the developer to the developing sleeve 508 within the rotating developing sleeve 508.

The developing sleeve 508 comprises a metal cylindrical pipe 506 (as a sleeve substrate) and an electroconductive resin coating layer 507 coating the pipe 506. To the developer vessel 503, the developer is supplied from a developer replenishing vessel (not shown) by means of a developer supplying member 512 (such as a screw). The developer vessel 503 is divided into a first chamber 514 and a second chamber 515, and the developer fed to the first chamber 514 is sent by a stirring conveying member 505 to the second chamber 514 through a spacing formed between a partitioning member 504 and the developer vessel 503 bottom ridge. The developer sent to the second chamber is stirred by a stirring member 511 for preventing the stagnation and carried on the developing sleeve 508 under the action of a magnetic force exerted by the magnetic roller 509.

The developer on the developing sleeve 508 is provided with a triboelectric charge required for developing an electrostatic image on the photosensitive drum 501 due to friction between magnetic toner particles and friction with the conductive resin coating layer 507 on the sleeve 508. In the embodiment of FIG. 8, the layer thickness of the developer on the developing sleeve 508 supplied to the developing region D is regulated by a ferromagnetic metal-made magnetic regulation blade 502 disposed downwardly from the developer vessel 503 upper wall with a gap of ca. 50–500 μm spaced apart from the developing sleeve 508 surface. Under the action of lines of magnetic force caused by a magnetic pole N1 from the magnet roller 509 concentrated onto the magnetic regulation blade 502, a thin layer of the developer is formed on the developing sleeve 508. It is possible to use a non-magnetic blade instead of the magnetic regulation blade 502.

It is preferred that the developer layer formed on the developing sleeve 508 has a smaller thickness than a minimum gap between the developing sleeve 508 and the photosensitive drum 501 at the developing region.

The developer-carrying member of the present invention is advantageously incorporated in a type of developing apparatus wherein an electrostatic latent image is developed with such a thin layer of developer, i.e., a non-contact type developing apparatus, but can also be incorporated in a contact-type developing apparatus wherein the developer layer has a thickness larger than the minimum gap between the developing sleeve 508 and the photosensitive drum 501 at the developing region D.

For brevity of explanation, the following description will be made with reference such a non-contact-type developing apparatus.

The mono-component developer comprising a magnetic toner carried on the developing sleeve 508 is caused to jump onto the photosensitive drum 501 under the action of a developing bias voltage applied to the developing sleeve 508 from a developing bias voltage supply 513. In the case of using a DC voltage as the developing bias voltage, it is preferred to apply to the developing sleeve 508 a voltage which is intermediate a potential of an image-forming region (where a toner is attached to provide a visible image) and a potential at a background region.

In order to increase the developed image density or improve the gradation characteristic, it is possible to apply an alternating bias voltage to the developing sleeve 508 thereby forming an oscillating electric field of which the polarity is alternately inverted at the developing region D. In this case, it is preferred to apply to the developing sleeve 508 an alternating bias voltage superposed with a DC voltage component which is intermediate the above-mentioned image-forming region potential and the background region potential.

In the case of normal development mode wherein an electrostatic latent image having a higher potential region and a lower potential region is formed, and a toner is attached to the higher potential region, a toner charged to a polarity opposite to that of the electrostatic latent image is used. In the case of reversal development mode wherein a toner is attached to a lower potential part of an electrostatic latent image, a toner charged to a polarity which is identical to that of the electrostatic latent image is used. Herein, the higher potential and the lower potential are determined in terms of absolute values. In either case, the sleeve is charged through friction with at least the developing sleeve 508 surface (i.e., the electroconductive resin coating layer 507 thereon).

In the embodiment of FIG. 8, a magnetic blade 502 is used as a developer layer thickness regulating member for controlling the developer layer thickness on the developing sleeve 508. However, as shown in FIG. 9, it is also possible to use an elastic regulation blade 11 comprising an elastomer, such as urethane rubber or silicone rubber, or a metal elastic material, such as phosphor bronze or stainless steel, so as to press the elastic regulation blade 11 against a developing sleeve 8 via the developer.

In the case of the contact-type or pressing type regulation blade as shown in FIG. 9, the developer layer is formed in a layer while receiving a stronger regulation force, so that it is possible to form a thinner developer layer on the developing sleeve than in the case of non-contact developer layer regulation as shown in FIG. 8.

FIG. 8 schematically illustrates an embodiment of the developing apparatus according to the present invention, and in addition to the above-mentioned developer layer thickness regulation member, various modification are possible, inclusive of omission of the stirring blades 505, 511, the location of magnetic poles, the shape of the supply member 512, the omission of the toner replenishing vessel, etc.

Such a developing apparatus may also be composed to use a two-component developer comprising a toner and a carrier.

Next, a two-component developing apparatus to which the developer-carrying member of the present invention may be incorporated will be described. FIG. 10 is a schematic sectional illustration of a developing apparatus suitable for using a two-component developer. Referring to FIG. 10, within a developing chamber 564 of a developer vessel 553, a non-magnetic developing sleeve 559 (as a developer-carrying member) is disposed opposite to an electrostatic latent image-bearing member 551 rotated in an indicated arrow E direction. The developing sleeve 559 (as a developer-carrying member) is disposed opposite to an electrostatic latent image-bearing member 551 rotated in an indicated arrow E direction. The developing sleeve 559 is formed by disposing a resin coating layer 558 on the surface of a cylindrical non-magnetic metal substrate 157. Within the developing sleeve 509 is fixedly disposed a magnetic roller 556 as a magnetic field-generating means to provide a developing roller 560. The magnet roller 556 is magnetized to 5 poles of S1–S3 and N1 to N2. Within the developing chamber 564 is stored a two-component developer comprising a mixture of a toner and a magnetic carrier. A portion of the developer in the chamber 564 can be sent through an opening over a partitioning wall 554 to a stirring chamber 565 of the developer vessel 553, where a toner supplied from a toner chamber 555 is replenished via a toner supply regulation member 563 and is mixed with the developer by a first stirring and conveying means 562. The developer stirred in the stirring chamber 565 is then returned through another opening (not shown) over the partitioning wall 554 to the developing chamber 564, where the developer is stirred and conveyed by a second stirring and conveying means 561 to the developing sleeve 559. The developer supplied to the developing sleeve 559 is magnetically constrained under the action of a magnetic force exerted by the magnet roller 556 and carried on the developing sleeve 559 to be formed into a thin layer under the regulation by a developer regulating blade 552 disposed below the developing sleeve 559. Then, the thin layer of the developer on the developing sleeve 559 is conveyed to a developing region G opposite to the latent image-bearing member 551 along with the rotation in an indicated arrow F direction of the developing sleeve 559, and is then used for development of an electrostatic latent image on the latent image-bearing member 551. Residual developer not consumed by the development is recovered in the developing vessel 564 along with the rotation of the developing sleeve 559. In the developing vessel 564, magnetic poles S2 and S3 of an identical polarity are disposed so as to form a repulsive magnetic field for peeling off the residual developer magnetically constrained on the developing sleeve 559. Above the developing sleeve 559 is fixedly disposed a scattering prevention layer 556. FIG. 10 schematically shows an embodiment of such a developing apparatus, and various modifications are possible regarding vessel shape, the presence or absence of stirring member, disposition of magnetic poles and rotation directions.

Next, the developer (toner) used in the present invention will be described.

The developer (toner) used in the present invention may preferably have a weight-average particle size of 4–11 $\mu$m. By using such a toner, it becomes possible to provide a good balance among toner charge, image quality and image density. The toner particle size values described herein are based on values measured by using a Coulter counter ("Multisizer II", made by Beckman Coulter Co.) equipped with a 100 $\mu$m-aperture.

The binder resin for constituting the developer (toner) used in the present invention may comprise a known binder resin, such as vinyl resin, polyester resin, polyurethane resin, epoxy resin and phenolic resin. Among these, vinyl resins and polyester resins are particularly preferred.

Preferred examples of carboxylic acid group-containing monomers usable for constituting the vinyl resins may preferably comprise half-ester monomers of dicarboxylic acids inclusive of: half esters of α,β-unsaturated dicarboxylic acids, such as monomethyl maleate, monoethyl maleate, monobutylmaleate, monooctyl maleate, monoallyl maleate, monophenyl maleate, monomethyl fumarate, monobutyl fumarate and monophenyl fumarate; half esters of alkenyldicarboxylic acids, such as monobutyl n-butenylsuccinate, monomethyl n-octenylsuccinate, monoethyl n-butenylmalonate, monomethyl n-dodecenyl glutanate, and monobutyl n-butenyladipate; and half esters of aromatic dicarboxylic acids, such as monomethyl phthalate, monoethyl phthalate, and monobutyl phthalate.

Examples of vinyl monomers other than carboxylic acid group-containing monomers to be used for providing the vinyl resins may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide. These vinyl monomers may be used singly or in combination of two or more species.

Among these, a combination of monomers providing a styrene copolymer or a styrene-(meth)acrylate copolymer may be particularly preferred.

The vinyl resin can include a crosslinking structure obtained by using a crosslinking monomer, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an other bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)-propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylolethane triacrylate, trimethylolpropane triacrylate, tetramethylolmethane tetracrylate, oligoester acrylate, and compounds obtained by substituting methacrylate groups for the acrylate groups in the above compounds; triallyl cyanurate and triallyl trimellitate.

Such a crosslinking agent may be used in an amount of 0.01–5 wt. parts, preferably 0.03–3 wt. parts, of the other monomers for constituting the vinyl resin.

Among the crosslinking monomers, aromatic divinyl compounds, particularly divinylbenzene, and diacrylate compounds bonded by a chain including an aromatic group and an ether bond, are particularly preferred.

In order to provide a negatively chargeable developer (toner), it is for example preferred to use a polyester resin, which may preferably comprise a polycondensate of a polybasic acid component and a polyhydric alcohol component and may be produced from the following components.

Examples of dihydric alcohol component may include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and bisphenol derivatives represented by the following formula (A):

(A)

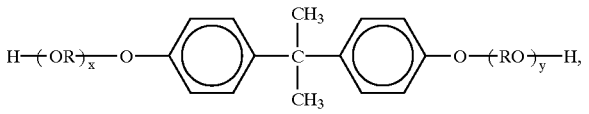

wherein R denotes an ethylene or propylene group, x and y are independently an integer of at least 0 with the proviso that the average of x+y is in the range of 0–10; diols represented by the following formula (2):

(2)

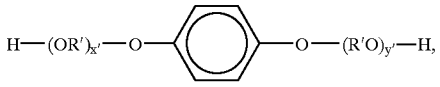

wherein R' denotes —$CH_2CH_2$—,

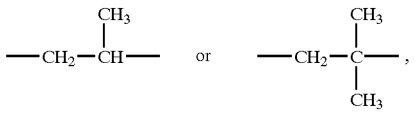

and x' and y' are independently an integer of at least 0 with the proviso that the average of x'+y' is in the range of 0–10.

Examples of a dibasic acid may include: benzenedicarboxylic acids and anhydrides and lower alkyl esters thereof, such as phthalic acid, terephthalic acid, isophthalic acid, and phthalic anhydride; alkyldicarboxylic acids, such as succinic acid, adipic acid, sebacic acid, and azelaic acid, and their anhydrides and lower alkyl esters thereof; and unsaturated dicarboxylic acids, such as fumaric acid, maleic acid, citraconic acid and itaconic acid, and their anhydrides and lower alkyl esters thereof.

It is possible to include a polycarboxylic acid and/or a polyhydric alcohol having three or more functional groups functioning as a crosslinking component.

Examples of the polyhydric alcohol having at least three hydroxyl groups may include: sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of the polycarboxylic acid having at least three carboxyl groups may include polycarboxylic acids and derivatives thereof inclusive of: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, empole trimmer acid, and anhydrides and lower alkyl esters of these; and tetracarboxylic acids represented by a formula below and, anhydrides and lower alkyl esters thereof:

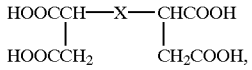

wherein X denotes an alkylene group or alkenylene group having 5–30 carbon atoms and having at least one side chain having at least 3 carbon atoms.

The polyester resin may preferably comprise 40–60 mol. %, more preferably 45–55 mol. %, of alcohol, and 60–40 mol. %, more preferable 55–45 mol. % of acid.

It is preferred to include the polyhydric alcohol and/or polybasic carboxylic acid having at least 3 functional groups in a proportion of 5–60 mol. % of the total alcohol and acid components.

For providing a polyester resin, it is preferred to use a bisphenol derivative of the above formula (A) as an alcohol component, and preferred acid components may include: phthalic acid, terephthalic acid, isophthalic acid and anhydrides of these; dicarboxylic acids, such as succinic acid, n-dodecenylsuccinic acid and anhydrides of these, fumaric acid, maleic acid, maleic anhydride; tricarboxylic acids, such as trimellitic acid and anhydride thereof, in view of excellent negative chargeability.

The binder resin thus obtained may suitably have a glass-transition temperature (Tg) of 45–75° C., preferably 50–70° C., a number-average molecular weight (Mn) of 1,500–30,000, preferably 2,000–15,000, and a weight-average molecular weight of 6,000–800,000, preferably 10,000–500,000.

The developer (toner) used in the developing apparatus of the present invention may contain a charge control agent in a form of inclusion in toner particles (internal addition) or blending with toner particles (external addition) for the purpose of enhancing the chargeability, particularly for allowing an optimum chargeability control adapted to a particular developing system.

Examples of the positive charge control agents may include: nigrosine, triaminotriphenylmethane dyes, and modified products of these with aliphatic acid metal salts, etc.; quaternary ammonium salts, such as tributylbenzylammonium 1-hydroxy-4-naphtholsulfonate and tetrabutylammonium tetrafluoroborate; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in mixture of two or more species. Among the above, it is preferred to use a nigrosine compound, a triaminotriphenylmethane compound or a quaternary ammonium salt.

Examples of the negative charge control agents may include: organic metal compounds and chelate compounds, more specifically aluminum acetylacetonate, iron (II) acetylatonate, and 3,5-di-t-butylsalicylic chromium complex or salt. Acetylacetone metal complexes, monoazo metal complexes, and naphthoic acid or salicylic acid metal complexes or salts are preferred, and particularly salicylic acid metal complexes, monoazo metal complexes and salicylic acid metal salts are preferred.

The above-mentioned charge control agents may preferably be used in a particulate form having a number-average particle size of at most 4 $\mu$m, more preferably at most 3 $\mu$m. In the case of internal addition to the toner particles, the charge control agent may preferably be used in an amount of 0.1–20 wt. parts, more preferably 0.2–10 wt. parts, per 100 wt. parts of the binder resin.

Examples of a magnetic material for providing a magnetic developer (toner) may include: iron oxides, such as magnetite, maghemite and ferrite, and iron oxides containing other metal oxides metals, such as Fe, Co and Ni, and alloys of these metals with Al, Co, Cu, Pb, Mg, Ni, Sn, Zn, Sb, Be, Bi, Cd, Ca, Mn, Se, Ti, W and V; and mixtures of these.

More specifically, examples of magnetic materials in terms of compositions may include: triiron tetroxide ($Fe_3O_4$), diiron trioxide (gamma-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), and nickel powder (Ni). These magnetic materials may be used singly or in combination of two or more species. Among the above, it is particularly preferred to use fine powder of triiron tetroxide or gamma-diiron trioxide. The magnetic material may preferably have an average particle size of 0.1–2 $\mu$m, and magnetic properties inclusive of a coercive force (Hc) of 1.6–16 kAm, a saturated magnetization ($\sigma s$) of 50–200 $Am^2/kg$ and a residual magnetization ($\sigma r$) of 2–20 $Am^2/kg$, when measured by applying a magnetic field of 795.8 kA/m (10 kilo-oersted).

The magnetic material may preferably be added in an amount of 10–200 wt. parts, more preferably 20-150 wt. parts, per 100 wt. parts of the binder resin. The magnetic material can also function as a colorant.

The developer (toner) used in the present invention may contain an arbitrary pigment or dye as a colorant.

Examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. Such a pigment may be used in 0.1–20 wt. parts, preferably 0.1–10 wt. parts, per 100 wt. parts of the binder resin. For a similar purpose, a dye may be used. Examples thereof may include: azo dyes, anthraquinone dyes, xanthene dyes, and methin dyes, and may be added in 0.1–20 wt parts, preferably 0.3–10 wt. parts, per 100 wt. parts of the binder resin.

The developer (toner) used in the present invention may contain one or more species of release agents therein.

Examples of the release agent used in the developer (toner) may include: aliphatic hydrocarbon waxes, such as low-molecular weight polyethylene, low-molecular weight polypropylene, microcrystalline wax and paraffin wax, oxides of aliphatic hydrocarbon waxes, such as oxidized polyethylene wax, and block copolymers of these; Fischer-Tropsche wax and Sasol wax; waxes principally comprising aliphatic acid esters, such as montaic acid ester wax and carnauba wax; partially or wholly de-acidified aliphatic acid esters, such as deacidified carnauba wax. Further examples may include: saturated linear aliphatic acids, such as palmitic acid, stearic acid and montaic acid and long-chain alkylcarboxylic acids having longer chain alkyl groups; unsaturated aliphatic acids, such as brassidic acid, eleostearic acid and valinaric acid; saturated alcohols, such as stearyl alcohol, eicosy alcohol, behenyl alcohol, carnaubyl alcohol, ceryl alcohol and melissyl alcohol; polybasic alcohols, such as sorbitol, aliphatic acid amides, such as linoleic acid amide, oleic acid amide, and lauric acid amide; saturated aliphatic acid bisamides, such as methylene-bisstearic acid amide, ethylene-biscopric acid amide, ethylene-bislauric acid amide, and hexamethylene-bisstearic acid amide; unsaturated aliphatic acid amides, such as ethylene-bisoleic acid amide, hexamethylene-bisoleic acid amide, N,N'-dioleyladipic acid amide, and N,N-dioleylsebacic acid amide; aromatic bisamides, such as m-xylene-bisstearic acid amide, and N,N'-distearylisophthalic acid amide; aliphatic acid metal soaps (generally called metallic soaps), such as calcium stearate, calcium stearate, zinc stearate and magnesium stearate; waxes obtained by grafting vinyl monomers such as styrene and acrylic acid onto aliphatic hydrocarbon waxes; partially esterified products between aliphatic acid and polyhydric alcohols, such as behenic acid monoglyceride; and methyl ester compounds having hydroxyl groups obtained by hydrogenating vegetable oil and fat.

The release agent may be added in 0.1–20 wt. parts, preferably 0.5–10 wt. parts, per 100 wt. parts of the binder resin.

Such a release agent may be mixed with or incorporated in the binder resin by adding it to a binder resin solution at an elevated temperature under stirring, or by adding it together with other additives, such as a colorant, at the time of melt-kneading of the binder resin.

The developer (toner) used in the present invention may preferably contain an inorganic fine powder of silica, titanium oxide, alumina, etc., externally added thereto, for the purpose of increasing toner performances, such as environmental stability, charging stability, developing characteristic, flowability, storage stability and cleaning performance. Among these, it is particularly preferred to use silica fine powder.

The silica fine powder may be either so-called dry-process silica or fumed silica formed by vapor-phase oxidation of a silicon halide, or so-called wet-process silica formed from water glass, but the dry-process silica is preferred because of less silanol groups on the surface or within silica fine powder and less production residue, such as $Na_2O$, $SO_2^{2-}$, etc. In the dry-process silica fine powder production, it is possible to use another metal halide compound, such as aluminum chloride or titanium oxide to obtain complex fine powder comprising silica and another metal oxide.

The inorganic fine powder may have been treated with an organic agent. Examples of such an organic agent may include organic metal compounds, such as silane coupling agents and titanium coupling agents, capable of reacting with or being physically adsorbed onto the inorganic fine powder. By effecting such an organic treatment, it is possible to hydrophobize the inorganic fine powder, thereby providing a toner exhibiting excellent environmental stability particularly in a high-humidity environment.

Example of such a silane coupling agent may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and containing each one hydroxyl group bonded to Si at the terminal units.

It is also possible to use one or more species of nitrogen-containing silane coupling agents, examples of which may include: aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopyldimethoxysilane, dibytylaminopropylmonomethoxysilane, dimethylaminophenyltriethoxysilane, trimethoxysilyl-gamma-propylphenylamine, and trimethoxysilyl-gamma-propylbenzylamine. These may be used singly or in combination of two or more species. As particularly preferred examples of silane coupling agent, hexamethyldisilazane (HMDS) and aminopropyltrimethoxysilane may be enumerated. The treatment of the inorganic fine powder may be effected by spraying or blending together with an organic solvent or water.

It is also possible to use inorganic fine powder treated with silicone oil. Silicone oil preferably used for this purpose may have a viscosity at 25° C. of 0.5–10000 $mm^2/s$ (centi-Stokes), preferably 1–1000 $mm^2/s$. Particularly preferred examples thereof may include: methylhydrogensilicone oil, dimethylsilicone oil, methylphenylsilicone oil, chloromethylsilicone oil, alkyl-modified silicone oil, fatty acid-modified silicone oil, polyoxyalkylene-modified silicone oil and fluorine-containing silicone oil. In the case of providing a positively chargeable developer, it is further preferred to use a silicone oil having a nitrogen atom in its side chain, such as amino-modified silicone oil.

The inorganic fine powder used in the present invention may preferably have a specific surface area as measured by the BET method using nitrogen adsorption ($S_{BET}$) of at least 30 $m^2/g$, particularly 50–400 m2/g, so as to provide good results. The inorganic fine powder may preferably be added in a proportion of 0.01–8 wt. parts, more preferably 0.1–5 wt. parts, particularly preferably 0.2 to 3 wt. parts, to 100 wt. parts of toner particles. Below 0.01 wt. parts, its effect of improving the agglomeration of the developer becomes scarce, and above 8 wt. parts, a substantial proportion of the inorganic fine powder is not attached to but is present in isolation from the toner particle surfaces, so that it becomes difficult for the developer (toner) to retain a uniform and appropriate level of charge.

The developer (toner) used in the present invention can further contain external additives other than the above-mentioned inorganic fine powder, inclusive of: lubricants, such as polytetrafluoroethylene, zinc stearate and polyvinylidene fluoride; abrasives, such as cerium oxide, strontium titanate, and strontium silicate; further, anticaking agents; electroconductivity-imparting agents, such as carbon black, zinc oxide, antimony oxide and tin oxide; and a minor amount of white or black fine particles of reverse charging polarity as a developing performance improver.

Such external additives may be added in a proportion of 0.01–10 wt. parts, preferably 0.1–7 wt. parts, per 100 wt. parts of toner particles.

Toner particles for constituting the developer (toner) may be produced through, e.g., a pulverization process wherein toner ingredients, inclusive of a binder resin, a pigment or dye as a colorant, a magnetic material, a release agent, and optionally a charge control agent and other additives, are sufficiently blended by means of a blender, such as a Henschel mixer or a ball mixer, and then melt-kneaded by a hot kneading means, such as a hot roller, a kneader or an extruder to disperse or dissolve the release agent, pigment or dye, magnetic material in melted resins, and the kneaded mixture, after being cooled, is pulverized and classified to provide toner particles. The toner particles are then blended with external additives, as desired, by a blender such as a Henschel mixer to obtain a developer (toner).

The toner particles may preferably be further subjected to a sphering and/or a surface-smoothing treatment for providing a better transferability. Such treatments may be performed, e.g., in an apparatus equipped with a stirring vane or blade and a liner or casing wherein toner particles are passed through a minute gap between the blade and the liner to be surface-smoothed or sphered under the action of a mechanical force exerted at the minute gavel; by a method of suspending the toner particles in a warm water; or by a method of exposing the toner particles to hot air stream. Such spherical toner particles may also be produced directly by suspension polymerization in an aqueous medium of a mixture comprising principally a monomer giving the binder resin. More specifically, toner ingredients inclusive of a polymerizable monomer, a colorant, a polymerization initiator, and optionally other additives, such as a crosslinking agent, a charge control agent and a release agent, are uniformly dissolved or dispersed to provide a monomer composition, which is then dispersed into an appropriate particle size by an appropriate stirrer in an aqueous medium containing a dispersion stabilizer, and then polymerized to provide toner particles having a desired particle size.

The toner can be blended with a carrier to provide a two-component developer. In this case, the carrier may for example comprise magnetic powder, such gas ferrite powder, optionally coated with a resin. In this case, 10 wt. parts of toner may preferably be blended with 10–1000 wt. parts, more preferably 30–500 wt. parts, of the carrier. The carrier may preferably have particle sizes of 4–100 $\mu$m, more preferably 10–90 $\mu$m, further preferably 20–80 $\mu$m, to be used in association with the toner having the above-mentioned particle size.

In order to provide the toner with an appropriate level of charge, the carrier may preferably be coated with a resin, particularly a vinyl resin, a fluorine-containing resin and/or a silicone resin. The surface resin coating is also effective for preventing the surface soiling of the carrier particles.

The present invention will be described more specifically based on specific examples.

Experimental Example A1

Prior to regeneration of an actually used product developing sleeve (developer-carrying member), the following scraping test was performed.

Figure 7B:
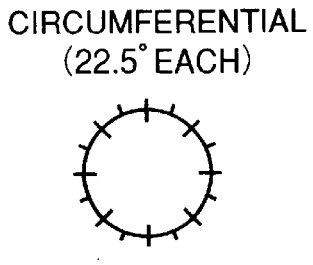

Aluminum sleeves having an outer diameter of 24.5 mm used for a developing roller of a commercially available copying machine ("NP-6350", made by Canon K.K.) were provided and subjected to measurement of a gap fluctuation in the manner described with reference to FIGS. 5 to 7. Among the sleeves, those exhibiting average values of gap fluctuation falling within the range 5.0±0.5 $\mu$m were collected. These Al sleeves were provided with a resin coating layer to be subjected to a scraping test. For reference, the sleeves provided with the resin coating layer exhibited substantially no change in gap fluctuation.

The resin coating layer was formed in the following manner.

Paint A was prepared by dispersing ingredients inclusive of 1000 wt. parts of prepolymer of thermosetting phenolic resin synthesized from phenol and formaldehyde by using an ammonium catalyst (in the form of a 50%—solution in methanol), 360 wt. parts of crystalline graphite having an average particle size (Dav.) of 8 $\mu$m, 40 wt. parts of electroconductive carbon black and 400 wt. parts of isopropyl alcohol. The dispersed materials in Paint A exhibited an average particle size (number average particle size, Dav) of 6.6 $\mu$m (as measured by using a particle size-distribution meter ("LS-320", made by Coulter Electronics, Inc.) equipped with a liquid module). Paint A was applied on an insulating sheet to form a dried and cured thin layer, which exhibited a volume resistivity of 3.5 ohm.cm. Paint A was diluted with isopropyl alcohol to a solid matter content of 36%. Then Paint A in the diluted form was ejected onto the Al sleeve held upright and rotated at 90 rpm from a spray gun while moving the spray gun downwards. A uniform coating film thus formed was dried and cured to form a resin coating layer of Paint A. The coating conditions were set to provide an averagely ca. 15 $\mu$m-thick resin coating Layer.

The thus obtained coated sleeve samples were subjected to a scraping test, i.e., a blasting treatment by using a blasting apparatus as illustrated in FIGS. 1, 2 and 4 including a blasting gun having a nozzle 31 of 7 mm in inner diameter. Thus, the nozzle inner diameter/sleeve outer diameter ratio was ca. 0.29. The nozzle discharge pressure was changed in a range of 0.5–6.0×$10^5$ Pa and 7 types of glass beads having average particle sizes ($D_{AP}$) in a range of 6–600 $\mu$m were used as abrasive particles to effect totally 49 runs of blasting test. These glass beads all had a true density (dp) of 2.5 g/$cm^3$.

Under the above-mentioned conditions, the coated sleeves were subjected to blasting basically until the resin coating layer was scraped off. The blasted sleeves were then each coated again with a resin coating layer of Paint A in the above described manner. The blasting time was measured as an indication of scraping performance and recorded in Table 1 below, and the test results of the scraping and re-coating, such as gap fluctuation and surface roughnesses before and after the coating, are summarized in Table 2.

TABLE 1

| Blast press. | Blasting time* (sec) | | | | | | |
|---|---|---|---|---|---|---|---|
| | Abrasive particle sizes $D_{AP}$ (μm) | | | | | | |
| (×10$^5$ Pa) | 6 | 15 | 35 | 50 | 125 | 250 | 600 |
| 0.5 | L | L | L | L | L | L | L |
| 1.0 | L | L | 880 | 720 | 670 | 660 | L |
| 2.0 | L | L | 520 | 400 | 360 | 360 | L |
| 3.0 | L | 550 | 320 | 240 | 210 | 200 | 250 |
| 4.0 | L | 490 | 190 | 150 | 135 | 130 | 130 |
| 5.0 | L | 460 | 160 | 120 | 115 | 110 | 110 |
| 6.0 | L | 420 | 130 | 100 | 100 | 100 | 100 |

*L in the table means a blasting time of over 1000 sec.

TABLE 2

| | | Scraping (blasting) performances | | | | |
|---|---|---|---|---|---|---|
| | Blast press | Gap fluctuation (μm) | | | Roughness Ra (μm) | |
| $D_{AP}$ (μm) | (×10$^5$ Pa) | before treatment | after treatment | after coating | after treatment | after coating |
| 15 | 3.0 | 5.2 | 5.2 | 5.6 | 0.36 | 0.75 |
| | 4.0 | 4.9 | 4.9 | 5.4 | 0.38 | 0.74 |
| | 5.0 | 5.1 | 6.2 | 6.8 | 0.38 | 0.76 |
| | 6.0 | 5.0 | 8.7 | 9.3 | 0.39 | 0.76 |
| 35 | 1.0 | 5.0 | 5.1 | 5.5 | 0.43 | 0.80 |
| | 2.0 | 4.8 | 5.0 | 5.4 | 0.45 | 0.79 |
| | 3.0 | 4.9 | 5.0 | 5.5 | 0.45 | 0.81 |
| | 4.0 | 5.3 | 5.2 | 5.5 | 0.49 | 0.79 |
| | 5.0 | 5.0 | 6.2 | 6.7 | 0.50 | 0.80 |
| | 6.0 | 5.0 | 8.7 | 9.5 | 0.52 | 0.81 |
| 50 | 1.0 | 5.1 | 4.9 | 5.3 | 0.50 | 0.80 |
| | 2.0 | 5.1 | 5.0 | 5.5 | 0.55 | 0.82 |
| (Sleeve A) | 3.0 | 5.0 | 5.1 | 5.6 | 0.57 | 0.82 |
| | 4.0 | 4.8 | 5.0 | 5.4 | 0.58 | 0.83 |
| (Sleeve B) | 5.0 | 4.9 | 6.3 | 6.8 | 0.60 | 0.84 |
| | 6.0 | 5.2 | 8.8 | 9.7 | 0.64 | 0.86 |
| 125 | 1.0 | 5.3 | 5.3 | 5.8 | 0.64 | 0.83 |
| | 2.0 | 5.2 | 5.1 | 5.6 | 0.71 | 0.84 |
| | 3.0 | 5.0 | 4.9 | 5.5 | 0.73 | 0.87 |
| | 4.0 | 4.8 | 5.0 | 5.6 | 0.77 | 0.90 |
| | 5.0 | 4.8 | 6.8 | 7.9 | 0.80 | 0.92 |
| | 6.0 | 5.0 | 9.0 | 10.1 | 0.94 | 1.08 |
| 250 | 1.0 | 5.1 | 4.9 | 5.5 | 0.72 | 0.84 |
| | 2.0 | 5.1 | 5.0 | 5.5 | 0.74 | 0.84 |
| | 3.0 | 5.0 | 5.2 | 5.7 | 0.76 | 0.86 |
| | 4.0 | 4.9 | 5.5 | 6.2 | 0.78 | 0.89 |
| | 5.0 | 4.9 | 7.2 | 8.4 | 0.80 | 0.94 |
| | 6.0 | 4.8 | 10.3 | 12.1 | 1.01 | 1.15 |
| 600 | 3.0 | 5.0 | 11.3 | 13.0 | 1.27 | 1.23 |
| | 4.0 | 4.9 | 15.0 | 17.0 | 1.35 | 1.27 |
| (Sleeve F) | 5.0 | 5.1 | 17.3 | 18.8 | 1.42 | 1.35 |
| | 6.0 | 5.0 | 21.5 | 23.7 | 1.47 | 1.39 |

From the results shown in Tables 1 and 2, satisfactory scraping and re-coating performances inclusive of gap fluctuation and surface roughness, could be achieved by blasting at appropriate blasting pressures by using glass beads of appropriate particle sizes ($D_{AP}$).

Experimental Example A2

The procedure of Experimental Example A1 was repeated except for using indefinite-shaped alumina particles having a true density (dp) of 3.9 g/cm$^3$ as abrasive particles instead of the glass beads. The results are shown in Tables 3 and 4 similarly as in Tables 1 and 2, respectively.

TABLE 3

| Blast press. | Blasting time* (sec) | | | | | | |
|---|---|---|---|---|---|---|---|
| | Abrasive particle sizes $D_{AP}$ (μm) | | | | | | |
| (×10$^5$ Pa) | 6 | 18 | 34 | 52 | 125 | 250 | 500 |
| 0.5 | L | L | L | L | L | L | L |
| 1.0 | L | 980 | 700 | 500 | 480 | 480 | 750 |
| 2.0 | L | 550 | 310 | 240 | 215 | 200 | 230 |
| 3.0 | 950 | 430 | 160 | 135 | 120 | 115 | 130 |
| 4.0 | 870 | 360 | 145 | 120 | 110 | 105 | 120 |
| 5.0 | 830 | 280 | 130 | 100 | 100 | 100 | 110 |
| 6.0 | 770 | 230 | 110 | 95 | 90 | 90 | 100 |

*: L > 100 sec.

TABLE 4

| | Blast press | Gap fluctuation (μm) | | | Roughness Ra (μm) | |
|---|---|---|---|---|---|---|
| $D_{AP}$ (μm) | (×10$^5$ Pa) | before treatment | after treatment | after coating | after treatment | after coating |
| 6 | 3.0 | 5.0 | 5.2 | 5.8 | 0.31 | 0.76 |
| | 4.0 | 4.8 | 5.0 | 5.5 | 0.33 | 0.78 |
| | 5.0 | 4.9 | 5.0 | 5.6 | 0.33 | 0.78 |
| | 6.0 | 5.3 | 8.8 | 9.3 | 0.36 | 0.79 |
| 18 | 1.0 | 5.0 | 5.0 | 5.3 | 0.35 | 0.77 |
| | 2.0 | 5.0 | 5.2 | 5.4 | 0.37 | 0.79 |
| | 3.0 | 5.2 | 5.3 | 5.6 | 0.38 | 0.79 |
| | 4.0 | 4.9 | 5.0 | 5.4 | 0.39 | 0.81 |
| | 5.0 | 5.1 | 6.3 | 6.8 | 0.40 | 0.80 |
| | 6.0 | 5.0 | 8.6 | 9.3 | 0.42 | 0.80 |
| 34 | 1.0 | 4.8 | 5.0 | 5.5 | 0.47 | 0.81 |
| | 2.0 | 4.9 | 5.0 | 5.4 | 0.53 | 0.82 |
| | 3.0 | 5.2 | 5.0 | 5.5 | 0.59 | 0.81 |
| (Sleeve C) | 4.0 | 5.3 | 5.4 | 5.5 | 0.62 | 0.83 |
| | 5.0 | 5.2 | 6.2 | 6.7 | 0.65 | 0.83 |
| | 6.0 | 5.0 | 8.8 | 9.5 | 0.69 | 0.86 |
| 52 | 1.0 | 5.1 | 5.0 | 5.3 | 0.50 | 0.80 |
| | 2.0 | 5.1 | 5.2 | 5.5 | 0.59 | 0.82 |
| | 3.0 | 5.0 | 5.1 | 5.6 | 0.61 | 0.82 |
| | 4.0 | 4.8 | 5.2 | 5.4 | 0.64 | 0.82 |
| | 5.0 | 4.9 | 6.4 | 6.8 | 0.76 | 0.90 |
| | 6.0 | 5.2 | 8.9 | 9.7 | 0.88 | 0.99 |
| 125 | 1.0 | 5.3 | 5.3 | 5.8 | 1.29 | 1.25 |
| | 2.0 | 5.2 | 6.9 | 7.9 | 1.96 | 1.89 |
| | 3.0 | 5.0 | 12.5 | 13.0 | 2.41 | 2.34 |
| | 4.0 | 4.8 | 17.5 | 19.0 | 2.53 | 2.45 |
| | 5.0 | 4.8 | 21.5 | 21.8 | 2.58 | 2.51 |
| | 6.0 | 5.0 | 25.0 | 26.3 | 2.60 | 2.52 |
| 250 | 1.0 | 5.1 | 6.4 | 7.1 | 1.58 | 1.55 |
| | 2.0 | 5.1 | 7.4 | 7.8 | 2.85 | 2.78 |
| | 3.0 | 5.0 | 13.8 | 14.3 | 3.12 | 3.04 |
| | 4.0 | 4.9 | 20.1 | 21.5 | 3.19 | 3.09 |
| | 5.0 | 5.0 | 27.0 | 28.5 | 3.24 | 3.13 |
| | 6.0 | 4.8 | 29.0 | 29.9 | 3.32 | 3.20 |
| 500 | 1.0 | 4.9 | 10.0 | 10.8 | 3.48 | 3.43 |
| | 2.0 | 4.9 | 18.0 | 21.5 | 3.96 | 3.87 |
| | 3.0 | 5.0 | 23.7 | 24.3 | 4.01 | 3.91 |
| | 4.0 | 4.9 | 29.0 | 31.2 | 4.09 | 3.99 |
| | 5.0 | 5.1 | 31.9 | 32.0 | 4.17 | 4.07 |
| | 6.0 | 5.0 | 35.2 | 35.3 | 4.26 | 4.22 |

From the results shown in Tables 3, and 4, it is understood that the use of abrasive particles having a larger true density tended to shorten the blasting time but also resulted in a broader region of causing a large gap fluctuation and a larger surface roughness.

Experimental Example A3

The procedure of Experimental Example A1 was repeated except for using indefinite-shaped alumina-zirconia particles having a true density of 4.3 g/cm$^3$ and particle sizes in a range of 52–100 μm as abrasive particles instead of the glass beads. The results are shown in Tables 5 and 6 similarly as in Tables 1 and 2, respectively.

TABLE 5

| Blast press. | Blasting time (sec) Abrasive particle sizes $D_{AP}$ (μm) | | | |
|---|---|---|---|---|
| ($\times 10^5$ Pa) | 52 | 125 | 250 | 600 |
| 0.5 | L | L | L | L |
| 1.0 | 420 | 400 | 375 | 730 |
| 2.0 | 190 | 180 | 165 | 210 |
| 3.0 | 130 | 120 | 110 | 135 |
| 4.0 | 120 | 115 | 110 | 120 |
| 5.0 | 100 | 100 | 100 | 110 |
| 6.0 | 90 | 90 | 90 | 100 |

TABLE 6

| $D_{AP}$ (μm) | Blast press ($\times 10^5$ Pa) | Gap fluctuation (82 m) before treatment | after treatment | after coating | Roughness Ra (μm) after treatment | after coating |
|---|---|---|---|---|---|---|
| 52 | 1.0 | 5.1 | 5.1 | 5.4 | 0.51 | 0.78 |
| | 2.0 | 5.1 | 5.2 | 5.6 | 0.61 | 0.80 |
| (Sleeve D) | 3.0 | 5.0 | 5.5 | 8.1 | 0.64 | 0.81 |
| | 4.0 | 4.8 | 6.0 | 7.3 | 0.08 | 0.81 |
| | 5.0 | 4.9 | 6.9 | 8.4 | 0.81 | 0.93 |
| | 6.0 | 5.2 | 9.2 | 10.3 | 0.93 | 1.15 |
| 125 | 1.0 | 5.1 | 5.3 | 5.8 | 1.29 | 1.26 |
| | 2.0 | 5.1 | 7.4 | 7.9 | 2.07 | 1.99 |
| | 3.0 | 5.0 | 13.3 | 14.9 | 2.53 | 2.45 |
| | 4.0 | 5.1 | 18.9 | 19.8 | 2.60 | 2.52 |
| | 5.0 | 5.0 | 23.0 | 23.9 | 2.62 | 2.53 |
| | 6.0 | 4.8 | 26.9 | 28.5 | 2.64 | 2.56 |
| 250 | 1.0 | 4.9 | 6.4 | 7.1 | 1.67 | 1.65 |
| | 2.0 | 4.9 | 8.8 | 9.7 | 2.95 | 2.89 |
| | 3.0 | 5.0 | 15.3 | 16.3 | 3.23 | 3.15 |
| | 4.0 | 4.9 | 22.8 | 23.9 | 3.27 | 3.17 |
| | 5.0 | 5.1 | 29.0 | 31.2 | 3.31 | 3.21 |
| | 6.0 | 5.0 | 33.0 | 35.8 | 3.40 | 3.24 |
| 600 | 1.0 | 5.1 | 11.6 | 12.6 | 3.50 | 3.44 |
| | 2.0 | 5.0 | 19.9 | 21.0 | 4.10 | 3.99 |
| | 3.0 | 4.8 | 25.8 | 27.2 | 4.21 | 4.08 |
| | 4.0 | 4.9 | 30.4 | 31.8 | 4.23 | 4.12 |
| | 5.0 | 4.9 | 33.1 | 34.7 | 4.30 | 4.22 |
| | 6.0 | 5.0 | 37.2 | 39.0 | 4.35 | 4.28 |

From the results shown in Tables 5 and 6, it is understood that the scraping was possible but an adequate region regarding gap fluctuation and surface roughness was further narrowed because of the use of abrasive particles having a still larger true density.

Experimental Example A4

The procedure of Experimental Example A1 was repeated except for using indefinite-shaped silicon carbide abrasive particles having a true density of 3.2 g/cm$^3$. The results are shown in Tables 7 and 8 similarly as in Tables 1 and 2.

TABLE 7

| Blast press. | Blasting time (sec) Abrasive particle sizes $D_{AP}$ (μm) | | | | | | |
|---|---|---|---|---|---|---|---|
| ($\times 10^5$ Pa) | 6 | 18 | 34 | 52 | 125 | 250 | 500 |
| 0.5 | L | L | L | L | L | L | L |
| 1.0 | L | 1000 | 870 | 560 | 530 | 520 | 750 |

TABLE 7-continued

| Blast press. | Blasting time (sec) Abrasive particle sizes $D_{AP}$ (μm) | | | | | | |
|---|---|---|---|---|---|---|---|
| ($\times 10^5$ Pa) | 6 | 18 | 34 | 52 | 125 | 250 | 500 |
| 2.0 | L | 570 | 380 | 320 | 280 | 240 | 300 |
| 3.0 | 1000 | 440 | 200 | 160 | 150 | 145 | 160 |
| 4.0 | 910 | 370 | 170 | 135 | 125 | 125 | 145 |
| 5.0 | 850 | 360 | 140 | 115 | 115 | 110 | 135 |
| 6.0 | 820 | 350 | 120 | 95 | 90 | 90 | 120 |

TABLE 8

| $D_{AP}$ (μm) | Blast press ($\times 10^5$ Pa) | Gap fluctuation (μm) before treatment | after treatment | after coating | Roughness Ra (μm) after treatment | after coating |
|---|---|---|---|---|---|---|
| 6 | 3.0 | 5.0 | 5.2 | 5.7 | 0.30 | 0.75 |
| | 4.0 | 5.0 | 5.0 | 5.5 | 0.35 | 0.76 |
| | 5.0 | 5.2 | 5.2 | 5.8 | 0.37 | 0.77 |
| | 6.0 | 4.9 | 8.6 | 9.2 | 0.39 | 0.77 |
| 15 | 1.0 | 5.0 | 5.0 | 5.3 | 0.33 | 0.76 |
| | 2.0 | 5.0 | 5.2 | 5.6 | 0.38 | 0.79 |
| | 3.0 | 5.2 | 5.3 | 5.6 | 0.40 | 0.79 |
| | 4.0 | 4.9 | 5.0 | 5.4 | 0.41 | 0.79 |
| | 5.0 | 5.0 | 5.8 | 6.6 | 0.42 | 0.78 |
| | 6.0 | 4.8 | 8.6 | 9.2 | 0.43 | 0.79 |
| 34 | 1.0 | 5.1 | 5.1 | 5.5 | 0.43 | 0.80 |
| | 2.0 | 5.1 | 5.2 | 5.7 | 0.51 | 0.80 |
| | 3.0 | 5.0 | 5.0 | 5.4 | 0.53 | 0.82 |
| (Sleeve E) | 4.0 | 4.8 | 5.2 | 5.5 | 0.56 | 0.81 |
| | 5.0 | 4.9 | 6.2 | 6.5 | 0.61 | 0.85 |
| | 6.0 | 5.2 | 8.8 | 8.9 | 0.68 | 0.86 |
| 50 | 1.0 | 4.8 | 5.0 | 5.3 | 0.50 | 0.79 |
| | 2.0 | 4.9 | 4.9 | 5.3 | 0.60 | 0.83 |
| | 3.0 | 5.2 | 5.2 | 5.6 | 0.62 | 0.84 |
| | 4.0 | 5.0 | 5.2 | 5.6 | 0.63 | 0.84 |
| | 5.0 | 4.9 | 6.4 | 6.8 | 0.72 | 0.89 |
| | 6.0 | 4.9 | 8.7 | 9.1 | 0.83 | 0.95 |
| 125 | 1.0 | 4.9 | 5.3 | 5.7 | 1.20 | 1.17 |
| | 2.0 | 5.2 | 6.4 | 6.9 | 1.66 | 1.59 |
| | 3.0 | 5.0 | 8.9 | 9.5 | 2.23 | 2.15 |
| | 4.0 | 5.1 | 11.3 | 12.0 | 2.31 | 2.22 |
| | 5.0 | 4.8 | 14.0 | 14.6 | 2.39 | 2.29 |
| | 6.0 | 5.0 | 23.5 | 23.5 | 2.43 | 2.31 |
| 250 | 1.0 | 4.9 | 6.2 | 7.0 | 1.40 | 1.38 |
| | 2.0 | 4.9 | 8.8 | 7.4 | 2.51 | 2.45 |
| | 3.0 | 5.0 | 10.5 | 11.0 | 2.93 | 2.89 |
| | 4.0 | 4.9 | 15.6 | 16.3 | 3.03 | 2.99 |
| | 5.0 | 5.1 | 21.3 | 22.9 | 3.08 | 3.01 |
| | 6.0 | 5.0 | 24.9 | 25.6 | 3.12 | 3.05 |
| 500 | 1.0 | 4.9 | 9.5 | 9.9 | 3.27 | 3.23 |
| | 2.0 | 4.9 | 16.2 | 16.9 | 3.70 | 3.65 |
| | 3.0 | 5.0 | 22.8 | 23.0 | 3.84 | 3.78 |
| | 4.0 | 5.2 | 26.7 | 28.3 | 4.01 | 3.91 |
| | 5.0 | 5.1 | 30.0 | 31.8 | 4.05 | 4.00 |
| | 6.0 | 5.1 | 31.8 | 33.0 | 4.09 | 4.02 |

The results in Tables 1–8 further shows that a true density of abrasive particles of ca. 4 g/cm$^3$ or lower is preferred.

Experimental Example A5

A blasting test was performed similarly as in Experimental Example A1 but by using ferrite particles of $D_{AP}$=100 μm or 150 μm and dp=5.2 g/cm$^3$ at a blasting pressure of $3.5\times 10^5$ Pa. The results are shown in Tables 9 and 10.

TABLE 9

| Blast press. | Blasting time (sec) $D_{AP}$ (μm) | |
|---|---|---|
| ($\times 10^5$ Pa) | 100 | 150 |
| 3.5 | 100 | 110 (sleeve G) |

TABLE 10

| $D_{AP}$ (μm) | Blast press ($\times 10^5$ Pa) | Gap fluctuation (μm) before treatment | after treatment | after coating | Roughness Ra (μm) after treatment | after coating |
|---|---|---|---|---|---|---|
| 150 | 3.5 | 5.1 | 33.4 | 37.2 | 3.25 | 3.10 |
| 100 | 3.5 | 5.0 | 32.1 | 34.9 | 2.84 | 2.67 |

As shown in Tables 9 and 10, the scraping was possible but resulted in a large gap fluctuation and a larger surface roughness. At a lower blasting pressure, the discharge state became unstable because of a large true density, thus resulting in a scraping irregularity while a large surface roughness was retained.

Experimental Example A6

A blasting test was performed in the same manner as in Experimental Example A1 except for changing the nozzle inner diameter to 3, 5, 7, 10, 20 and 27 mm while using glass beads of $D_{AP}$=50 μm and a constant blast pressure of $3.5\times10^5$ Pa. The results are shown in Table 11 below.

TABLE 11

| Dnozzle (mm) | Time (sec) | Blasting performances: Gap fluctuation (μm) before treatment | after treatment | after coating | Roughness Ra (μm) after treatment | Range | after coating |
|---|---|---|---|---|---|---|---|
| 3 (Sleeve H) | 470 | 5.0 | 8.4 | 10.2 | 0.56 | 0.47–0.60 | 0.79 |
| 5 | 240 | 4.9 | 5.0 | 5.5 | 0.56 | 0.53–0.59 | 0.79 |
| 7 | 210 | 4.8 | 5.0 | 5.4 | 0.56 | 0.53–0.59 | 0.80 |
| 10 | 200 | 5.1 | 5.2 | 5.6 | 0.57 | 0.53–0.60 | 0.80 |
| 20 | 190 | 5.0 | 8.3 | 9.9 | 0.68 | 0.62–0.74 | 0.93 |
| 27 (Sleeve J) | 180 | 4.9 | 14.8 | 14.8 | 0.87 | 0.64–1.05 | 1.01 |

At too small a nozzle diameter (Dnzl), the scraping performance was ununiform to result in a larger gap fluctuation and an ununiform roughness. On the other hand, at too large a nozzle diameter, the particle discharge state became unstable, and because of a larger air rate and a larger air pressure, a larger gap fluctuation and a larger surface roughness resulted. A nozzle inner diameter of 0.2–0.5 times the sleeve substrate outer diameter appeared to be appropriate.

Experimental Example A7

Aluminum sleeves having an outer diameter of 20 mm used for a developing roller of a commercially available laser beam printer ("LBP-2160", made by Canon K.K.) were provided and subjected to Measurement of a gap fluctuation in the manner described with reference to FIGS. 5 to 7. Among the sleeves, those exhibiting average values of gap fluctuation falling within the range 5.0±0.5 μm were collected. These Al sleeves were provided with a resin coating layer to be subjected to a scraping test. For reference, the sleeves provided with the resin coating layer exhibited substantially no change in gap fluctuation.

The resin coating layer was formed in the following manner.

Paint B was prepared by dispersing ingredients inclusive of 1000 wt. parts of 50%—solution in toluene of methyl methacrylate-dimethylaminoethyl methacrylate (mol ratio=95:5) copolymer having a weight average molecular weight (Mw) of ca. 10,000, 125 wt. parts of crystalline graphite having an average particle size (Dav.) of 6 μm, and 365 wt. parts of toluene. The dispersed materials in Paint B exhibited Dav=5.6 μm. Paint B was applied on an insulating sheet to form a dried and cured thin layer, which exhibited a volume resistivity of 12.5 ohm.cm. Paint B was diluted with toluene to a solid matter content of 38%. Then Paint B in the diluted form was ejected onto the Al sleeve held upright and rotated at 120 rpm from a spray gun while moving the spray gun downwards. A uniform coating film thus formed was dried to form a resin coating layer of Paint B. The coating conditions were set to provide an averagely ca. 10 μm-thick resin coating layer.

The thus obtained coated sleeve samples were subjected to a scraping test, i.e., a blasting treatment by using a blasting apparatus as illustrated in FIGS. 1, 2 and 4 including a blasting gun having a nozzle 31 of 10 mm in inner diameter. This, the nozzle inner diameter/sleeve outer diameter ratio was ca. 0.5. The nozzle discharge pressure was changed in a range of $0.5–6.0\times10^5$ Pa and 7 types of glass beads having average particle sizes ($D_{AP}$) in a range of 6–600 μm were used as abrasive particles to effect totally 49 runs of blasting test. These glass beads all had a true density (dp) of 2.5 g/cm$^3$.

Under the above-mentioned conditions, the coated sleeves were subjected to blasting basically until the resin coating layer was scraped off. The blasting time was measured as an indication of scraping performance and recorded in Table 12 below, and the test results of the scraping, such as gap fluctuation and surface roughnesses, are summarized in Table 13.

TABLE 12

| Blast press. | Blasting time* (sec) Abrasive particle sizes $D_{AP}$ (μm) | | | | | | |
|---|---|---|---|---|---|---|---|
| (×10^5 Pa) | 6 | 15 | 35 | 50 | 125 | 250 | 600 |
| 0.5 | L | L | L | L | L | L | L |
| 1.0 | L | L | 880 | 720 | 670 | 660 | L |
| 2.0 | L | L | 520 | 400 | 360 | 360 | L |
| 3.0 | L | 550 | 320 | 240 | 210 | 200 | 250 |
| 4.0 | L | 490 | 190 | 150 | 135 | 130 | 130 |
| 5.0 | L | 460 | 160 | 120 | 115 | 110 | 110 |
| 6.0 | L | 420 | 130 | 100 | 100 | 100 | 100 |

*: L in the table means a blasting time of over 1000 sec. similarly as in Tables 1 and so on.

TABLE 13

| $D_{AP}$ (μm) | Blast press (×10^5 Pa) | Gap fluctuation (μm) before treatment | after treatment | after coating | Roughness Ra (μm) after treatment | after coating |
|---|---|---|---|---|---|---|
| 15 | 2.0 | 5.0 | 5.1 | 5.3 | 0.38 | 0.63 |
| | 3.0 | 5.2 | 5.2 | 5.4 | 0.38 | 0.62 |
| | 4.0 | 4.9 | 4.9 | 4.9 | 0.38 | 0.64 |
| | 5.0 | 5.1 | 6.2 | 6.5 | 0.39 | 0.64 |
| | 6.0 | 5.0 | 8.7 | 9.0 | 0.40 | 0.64 |
| 35 | 1.0 | 5.0 | 5.1 | 5.5 | 0.41 | 0.63 |
| | 2.0 | 4.8 | 5.0 | 5.3 | 0.44 | 0.65 |
| | 3.0 | 4.9 | 5.0 | 5.2 | 0.44 | 0.65 |
| | 4.0 | 5.3 | 5.2 | 5.5 | 0.47 | 0.65 |
| | 5.0 | 5.0 | 6.2 | 6.5 | 0.48 | 0.66 |
| | 6.0 | 5.0 | 8.7 | 9.2 | 0.53 | 0.68 |
| 50 | 1.0 | 5.1 | 4.9 | 5.3 | 0.49 | 0.65 |
| | 2.0 | 5.1 | 5.0 | 5.2 | 0.54 | 0.68 |
| | 3.0 | 5.0 | 5.1 | 5.4 | 0.56 | 0.68 |
| | 4.0 | 4.8 | 5.1 | 5.4 | 0.57 | 0.69 |
| | 5.0 | 4.9 | 6.3 | 6.7 | 0.58 | 0.69 |
| | 6.0 | 5.2 | 8.8 | 9.3 | 0.62 | 0.69 |
| 125 | 1.0 | 5.3 | 5.4 | 5.7 | 0.64 | 0.68 |
| | 2.0 | 5.2 | 5.2 | 5.4 | 0.69 | 0.71 |
| | 3.0 | 5.0 | 5.0 | 5.2 | 0.71 | 0.72 |
| | 4.0 | 4.8 | 5.0 | 5.4 | 0.75 | 0.73 |
| | 5.0 | 4.8 | 6.9 | 7.2 | 0.78 | 0.75 |
| | 6.0 | 5.0 | 8.9 | 9.5 | 0.90 | 1.00 |
| 250 | 1.0 | 5.1 | 5.0 | 5.3 | 0.68 | 0.71 |
| | 2.0 | 5.1 | 5.1 | 5.4 | 0.75 | 0.72 |
| | 3.0 | 5.0 | 5.2 | 5.6 | 0.78 | 0.75 |
| | 4.0 | 4.9 | 5.5 | 5.9 | 0.79 | 0.84 |
| | 5.0 | 4.9 | 7.2 | 7.5 | 0.83 | 0.90 |
| | 6.0 | 4.8 | 10.3 | 10.9 | 1.00 | 1.09 |
| 600 | 2.0 | 5.1 | 6.4 | 6.8 | 0.86 | 0.92 |
| | 3.0 | 5.0 | 12.0 | 12.5 | 1.25 | 1.18 |
| | 4.0 | 4.9 | 14.8 | 15.8 | 1.30 | 1.21 |
| | 5.0 | 5.1 | 16.9 | 17.8 | 1.38 | 1.30 |
| | 6.0 | 5.0 | 22.3 | 23.4 | 1.44 | 1.34 |

From the results in Tables 12 and 13, it is understood that a similar scraping performance was achieved by blasting of a resin coating layer of thermoplastic resin.

Experimental Example A8

The procedure of Experimental Example A7 was repeated except for using thermoset phenolic resin particles having dp=1.3 g/cm$^3$. The results are shown in Tables 14 and 15.

TABLE 14

| Blast press. | Blasting time* (sec) Abrasive particle sizes $D_{AP}$ (μm) | | | |
|---|---|---|---|---|
| (×10^5 Pa) | 10 | 20 | 50 | 100 |
| 0.5 | L | L | L | L |
| 1.0 | L | L | L | L |
| 2.0 | L | L | L | L |
| 3.0 | L | 940 | 780 | 720 |
| 4.0 | L | 900 | 710 | 680 |
| 5.0 | L | 870 | 690 | 640 |
| 6.0 | L | 840 | 660 | 620 |

*L: > 1000 sec.

TABLE 15

| $D_{AP}$ (μm) | Blast press (×10^5 Pa) | Gap fluctuation (μm) before treatment | after treatment | after coating | Roughness Ra (μm) after treatment | after coating |
|---|---|---|---|---|---|---|
| 20 | 3.0 | 5.1 | 5.2 | 5.4 | 0.33 | 0.62 |
| | 4.0 | 5.1 | 4.9 | 5.2 | 0.34 | 0.63 |
| | 5.0 | 5.0 | 6.2 | 6.5 | 0.35 | 0.62 |
| | 6.0 | 4.9 | 8.7 | 9.1 | 0.33 | 0.61 |
| 50 | 3.0 | 5.0 | 5.0 | 5.2 | 0.34 | 0.62 |
| | 4.0 | 4.8 | 4.9 | 5.2 | 0.35 | 0.63 |
| | 5.0 | 4.9 | 6.1 | 6.5 | 0.34 | 0.63 |
| | 6.0 | 4.9 | 8.8 | 9.2 | 0.35 | 0.62 |
| 100 | 3.0 | 5.0 | 5.0 | 5.3 | 0.36 | 0.65 |
| | 4.0 | 4.9 | 4.8 | 5.3 | 0.37 | 0.65 |
| | 5.0 | 5.1 | 5.9 | 6.4 | 0.38 | 0.66 |
| | 6.0 | 5.0 | 9.0 | 9.7 | 0.37 | 0.66 |

As shown in Tables 14 and 15, the scraping was possible under appropriately set conditions. As a result of observation through an electron microscope (FE-SEM), a portion of the resin coating layer was left unremoved in an extent of not obstructing regenerative resin coating layer formation thereon. Unlike other abrasive particles, the difference in particle sizes of abrasive particles did not substantially affect the surface roughness after the scraping.

Experimental Example A9

A blasting test was performed similarly as in Experimental Example A7 but by using ferrite particles of $D_{AP}$=150 μm and dp=5.2 g/cm$^3$ similarly as in Experimental Example A5. However, the use of abrasive particles having a large true density resulted in somewhat larger gap fluctuation and larger surface roughness.

The results of Experimental Examples A8 and A9 also show the applicability of blasting for scraping of a thermoplastic resin coating layer somewhat softer than a thermoset resin coating layer.

Example A1

A used developer-carrying member (developing roller) having an outer diameter (OD) of 24.5 mm actually used in a commercial copying machine ("NP-6350", made by Canon K.K.) for copying on ca. 5×10$^5$ sheets (predominantly of A4-size), was provided. The developing roller was originally (before use) provided with a ca. 15 μm-thick resin coating layer principally comprising a thermoset phenolic resin and crystalline graphite and exhibiting a surface roughness Ra of ca. 0.8 μm. As a result of observation through a laser microscope of the used developing roller, tanner attachment was observed at both ends of the sleeve. After wiping the attached toner with solvent MEK (methyl ethyl ketone), the resin coating lazier exhibited a lowered surface roughness Ra of 0.40 μm. As a result of measurement of the outer diameter by laser light illumination, the remaining coating layer thickness was averagely ca. 7 μm at a central part and ca. 4 μm at both edge parts. At the edge parts, the lower aluminum substrate was recognized through a remaining small thickness of the resin layer.

The surface of the used developing roller was carefully wiped out with methyl ethyl ketone (MEK) so as to remove the attached toner. The developing roller was then re-assembled to form a developing apparatus and incorporated again in the copying machine ("NP-6350"), which was then subjected to image forming tests. As a result, images with practically lower limit level of image density could be obtained in a normal temperature/normal humidity (NT/NH=23° C./50% RH) environment and a high temperature/high humidity (HT/HH=30° C./80% RH) environment but the images formed in a normal temperature/low humidity (NT/LH=23° C./10% RH) environment were accompanied with ripple pattern irregularity at halftone parts corresponding ripple-pattern coating irregularity (blotches) at the sleeve edge parts.

Then, the developing roller was again taken out of the developing apparatus, the surface toner was removed, and the sleeve flange at one end and the magnet roller were removed therefrom. Further, the remaining sleeve was subjected to scraping of the resin coating layer by using the blasting apparatus of Experimental Example A1 above. As a result, the treated sleeve exhibited a gap fluctuation of 5.8 μm.

During the scraping operation, the blast gun used had a nozzle 31 having an inner diameter of 7 mm through which glass beads of $D_{AP}$=50 μm were discharged at a pressure of $3.0\times10^5$ Pa and at a discharge rate of 5.2 g/sec. The aluminum sleeve substrate held in an upright state was rotated at 90 rpm, and the blast gun was moved repetitively upwards and downwards at a rate of 5 mm/sec. The operation was continued for 240 sec to complete the scraping. The sleeve after the scraping treatment exhibited a gap fluctuation of 5.1 μm and a central line-average roughness of 0.52 μm on an average with fluctuations within ±0.05 μm with respect to values measured at 12 points.

Then, a fresh resin coating layer was formed in a thickness of 15.5 μm on the scraped sleeve by using Paint A prepared in Experimental Example A1. The resin coating layer exhibited a surface roughness Ra=0.82 μm, and the coated sleeve exhibited a gap fluctuation of 6.3 μm.

A magnet roller was again inserted in the sleeve and a flange was attached to form a developing apparatus for the copying machine ("NP-6350"), which was then subjected to an image forming test by using a magnetic toner (for "NP-6350", D4=ca. 8.5 μm, magnetic toner particles comprising principally 100 wt. parts of styrene-acrylate copolymer and 90 wt. parts of magnetic material, in mixture with externally added hydrophobic silica-fine powder) on 10,000 sheets on each of the NT/NH (23° C./60% RH), HT/HH (30° C./80% RH) and NT/LH (23° C./10% RH) environments. As a result, good images were formed in each environment. The results are inclusively shown in Table 16 (16–1 to 16–3) together with those of Examples described hereinafter. In the NT/NH (23° C./60% RH) environment, the continuous image forming test was continued up to $5\times10^5$ sheets, whereas no particularly abnormal images were formed.

Evaluation Items and Methods (1) Image Density (I.D.)

Reflection image densities of ten 6 mm-dia. solid black circle images on a test chart at an image areal percentage of 5.5% were measured by using a reflection densitometer ("RD 918", made by Macbeth Co.) and were averaged to provide an image density (I.D.).

(2) Density Fluctuation (ΔID)

For evaluating a density uniformity along the length of a developing roller, a halftone solid image at a reflection density of 0.4 reproduced as an image at a reflection density of 0.6, and the resultant reflection image densities along the length were measured by a reflection densitometer ("RD 918", made by Macbeth Co.) to obtain a density fluctuation (ΔID) as a difference between a maximum value and a minimum value. For the measurement, the pitch irregularity portion was removed from the object of evaluation.

(3) Pitch Irregularity (Pitch)

A solid black image and a halftone solid image (above-mentioned) on the reproduced image sample were observed with eyes with respect to density irregularity in the developing roller rotation and evaluated according to the following standard.

A: No pitch irregularity was observed at either of the solid black and halftone solid images.

B: Slight pitch irregularity was observed not in the solid black image but observed in the halftone solid image.

C: Pitch irregularities could be observed in both the solid black and halftone solid image but at a practically acceptable level.

D: Pitch irregularities were observed at a level not practically acceptable.

(4) Blotch

Solid black and halftone solid images were observed and compared with the result of observation of the developing roller surface for evaluation according to the following standard.

A: No blotch irregularity was observed on either the images or the developing roller.

B: Blotch irregularity was not observed on the images but observed on the developing roller.

C: Blotch irregularity was observed on the images.

The results of evaluation are inclusively shown in Table 16 together with those of the following Examples.

Example A2

The procedure of Example A1 including the resin coating layer formation, the assembling of a developing roller and a developing apparatus, the incorporation in an image forming apparatus ("NC 6350") and the image forming test was repeated except for using Sleeve sample A prepared in Experimental Example A1 (by using abrasive particles having an average particle size ($D_{AP}$) of 50 μm at a blasting pressure ($P_{BL}$) of $3.0\times10^5$ Pa) and exhibiting good gap fluctuation ($f_{gap}$) and surface roughness (Ra). The results are shown in Table 16 together with those of the following Examples.

Example A3

The procedure of Example A1 was repeated except for using Sleeve sample B prepared in Experimental Example A1 ($D_{AP}$=50 μm, $P_{BL}=5.0\times10^5$ Pa) showing somewhat worse gap fluctuation.

Example A4

The procedure of Example A1 was repeated except for using Sleeve sample C prepared in Experimental Example A2 ($D_{AP}$=34 μm, $P_{BL}$=4.0×10$^5$ Pa) showing good gap fluctuation and surface roughness.

Example A5

The procedure of Example A1 was repeated except for using Sleeve sample D prepared in Experimental Example A3 ($D_{AP}$=52 μm, $P_{BL}$=3.0×10$^5$ Pa) showing good gap fluctuation and surface roughness.

Example A6

The procedure of Example A1 was repeated except for using Sleeve sample E prepared in Experimental Example A4 ($D_{AP}$=34 μm, $P_{BL}$=4.0×10$^5$ Pa) showing good fluctuation and surface roughness.

Comparative Example A1

The procedure of Example A1 was repeated except for using Sleeve sample F prepared in Experimental Example A1 ($D_{AP}$=600 μm, $P_{BL}$=5.0×10$^5$ Pa) showing somewhat worse gap fluctuation.

Comparative Example A2

The procedure of Example A1 was repeated except for using Sleeve sample G prepared in Experimental Example A5 ($D_{AP}$=150 μm, $P_{BL}$=3.5×10$^5$ Pa) showing somewhat worse gap fluctuation and larger surface roughness.

Comparative Example A3

The procedure of Example A1 was repeated except for using Sleeve sample H prepared in Experimental Example A6 ($D_{AP}$=50 μm, $P_{BL}$=3.5×10$^5$ Pa, Dnzl=3 mm)).

Comparative Example A4

The procedure of Example A1 was repeated except for using Sleeve sample J prepared in Experimental Example A6 ($D_{AP}$=50 μm, $P_{BL}$=3.5×10$^5$ Pa, Dnzl=27 mm)).

TABLE 16-1

HT/HH (30° C./80% RH)

| | On 100th sheet | | | | After 10,000 sheets | | | |
|---|---|---|---|---|---|---|---|---|
| Example | I.D. | ΔID | Pitch | Blotch | I.D. | ΔID | Pitch | Blotch |
| MEK wash | 1.30 | 0.35 | D | A | — | — | — | — |
| Ex. A1 | 1.45 | 0.03 | A | A | 1.43 | 0.04 | A | A |
| Ex. A2 | 1.45 | 0.03 | A | A | 1.43 | 0.04 | A | A |
| Ex. A3 | 1.45 | 0.07 | A | A | 1.42 | 0.10 | A | A |
| Ex. A4 | 1.45 | 0.05 | A | A | 1.42 | 0.06 | A | A |
| Ex. A5 | 1.45 | 0.05 | A | A | 1.42 | 0.06 | A | A |
| Ex. A6 | 1.45 | 0.03 | A | A | 1.43 | 0.04 | A | A |
| Com. Ex. A1 | 1.18 | 0.18 | C | A | 1.18 | 0.27 | D | A |
| Com Ex. A2 | 1.01 | 0.29 | D | A | 0.97 | 0.38 | D | A |
| Com. Ex. A3 | 1.40 | 0.15 | B | A | 1.39 | 0.15 | B | A |
| Com. Ex. A4 | 1.34 | 0.18 | C | A | 1.32 | 0.22 | D | A |

TABLE 16-2

NT/NH (23° C./60% RH)

| | On 100th sheet | | | | After 10,000 sheets | | | |
|---|---|---|---|---|---|---|---|---|
| Example | I.D. | ΔID | Pitch | Blotch | I.D. | ΔID | Pitch | Blotch |
| MEK wash | 1.35 | 0.32 | C | B | — | — | — | — |
| Ex. A1 | 1.47 | 0.02 | A | A | 1.47 | 0.02 | A | A |
| Ex. A2 | 1.47 | 0.02 | A | A | 1.47 | 0.02 | A | A |
| Ex. A3 | 1.47 | 0.05 | A | A | 1.47 | 0.04 | A | A |
| Ex. A4 | 1.47 | 0.03 | A | A | 1.47 | 0.03 | A | A |
| Ex. A5 | 1.47 | 0.03 | A | A | 1.47 | 0.03 | A | A |
| Ex. A6 | 1.47 | 0.02 | A | A | 1.47 | 0.02 | A | A |
| Com. Ex. A1 | 1.35 | 0.15 | C | A | 1.36 | 0.18 | D | A |
| Com. Ex. A2 | 1.21 | 0.21 | D | A | 1.25 | 0.23 | D | A |
| Com. Ex. A3 | 1.44 | 0.12 | A | A | 1.44 | 0.11 | B | A |
| Com. Ex. A4 | 1.37 | 0.16 | B | A | 1.38 | 0.17 | C | A |

TABLE 16-3

NT/LH (23° C./10% RH)

| | On 100th sheet | | | | After 10,000 sheets | | | |
|---|---|---|---|---|---|---|---|---|
| Example | I.D. | ΔID | Pitch | Blotch | I.D. | ΔID | Pitch | Blotch |
| MEK wash | 1.15 | 0.28 | C | C | — | — | — | — |
| Ex. A1 | 1.48 | 0.02 | A | A | 1.48 | 0.02 | A | A |
| Ex. A2 | 1.48 | 0.02 | A | A | 1.48 | 0.02 | A | A |
| Ex. A3 | 1.48 | 0.05 | A | A | 1.48 | 0.05 | A | A |
| Ex. A4 | 1.48 | 0.03 | A | A | 1.48 | 0.03 | A | A |
| Ex. A5 | 1.48 | 0.03 | A | A | 1.48 | 0.03 | A | A |
| Ex. A6 | 1.48 | 0.02 | A | A | 1.48 | 0.02 | A | A |
| Com. Ex. A1 | 1.38 | 0.15 | C | A | 1.38 | 0.15 | C | A |
| Com. Ex. A2 | 1.24 | 0.27 | D | B | 1.30 | 0.31 | D | D |
| Com. Ex. A3 | 1.47 | 0.10 | B | A | 1.45 | 0.11 | B | A |
| Com. Ex. A4 | 1.45 | 0.17 | B | A | 1.44 | 0.16 | C | A |

Next, honing examples will be described.

Experimental Example B1

Prior to regeneration of an actually used product developing sleeve (developer-carrying member), the following scraping test was performed.

Aluminum sleeves having an outer diameter of 16 mm used for a developing roller of a commercially available laser beam printer ("LBP-1760", made by Canon K.K.) were provided and subjected to measurement of a gap fluctuation in the manner described with reference to FIGS. 5 to 7. Among the sleeves, those exhibiting average values of gap fluctuation falling within the range of 5.0±0.5 μm were collected. These Al sleeves were provided with a resin coating layer to be subjected to a scraping test. For reference, the sleeves provided with the resin coating layer exhibited substantially no change in gap fluctuation.

The resin coating layer was formed in the following manner.

Paint C was prepared by dispersing ingredients inclusive of 2000 wt. parts of prepolymer of thermosetting phenolic resin synthesized from phenol and formaldehyde by using an ammonium catalyst (in the form of a 50%—solution in methanol>, 360 wt. parts of crystalline graphite having an average particle size (Dav.) of 8 μm, 40 wt. parts of electroconductive carbon black, 4 wt. parts of spherical carbon particles (volume-average particle size (Dv)=5.3 μm) and 400 wt. parts of isopropyl alcohol. The dispersed materials in Paint C exhibited Dav=6.7 μm. Paint C was diluted with isopropyl alcohol to a solid matter content of 38%. Then Paint C in the diluted form was ejected onto the Al sleeve held upright and rotated from a spray gun while moving the spray gun downwards. A uniform coating film thus formed was dried and cured to form a resin coating layer of Paint C. The coating conditions were set to provide an averagely ca. 12 μm-thick resin coating layer.

The thus obtained coated sleeve samples were subjected to a scraping test, i.e., a scraping treatment by using a honing apparatus as illustrated in FIGS. 11, 13 and 14 including a honing gun having a nozzle 131 of 12 mm in inner diameter. Thus, the nozzle inner diameter/sleeve outer diameter ratio was ca. 0.75. The honing air discharge pressure was changed in a range of $0.5–6.0\times10^5$ Pa and 6 types of glass beads having average particle sizes ($D_{AP}$) in a range of 6–150 μm were used as abrasive particles each in the form of an aqueous dispersion at a bead concentration of 15% by volume to effect totally 42 runs of honing test. These glass beads all had a true density (dp) of 2.5 g/cm$^3$.

Under the above-mentioned conditions, the coated sleeves were subjected to honing basically until the resin coating layer was scraped off. The honed sleeves were then each coated again with a resin coating layer of Paint C in the above described manner. The honing time was measured as an indication of scraping performance and recorded in Table 17, and the test results of the scraping, such as gap fluctuation and surface roughnesses before and after the re-coating, are summarized in Table 18.

From the results shown in Tables 17 and 18, satisfactory scraping and re-coating performances, inclusive of gap fluctuation and surface roughness, could be achieved by honing using glass beads of appropriate particle sizes ($D_{AP}$) and an appropriate level of honing air pressure.

Experimental Example B2

The procedure of Experimental Example B1 was repeated except for changing a volume percentage of beads in the aqueous honing liquid in a range of 1 to 30% by volume at a constant air pressure of $3.0\times10^5$ Pa and a bead particle size ($D_{AP}$) of 50 μm. The results are shown in Tables 19 and 20. As a result, a larger bead volume percentage resulted in a higher scraping effect. However, in the case of a large particle size and a large volume percentage the discharge of particles and water became worse to show a rather lower scraping effect. In the case of large particle size, the particles were liable to cause precipitation and show poor dispersion, thefts resulting in a somewhat larger gap fluctuation. From the results shown in FIGS. 19 and 20, the honing treatments using beads of $D_{AP}$=15 to 100 μm and bead percentages of 2–20% by volume resulted in performances satisfying both gap fluctuation and surface roughness.

Experimental Example B3

The procedure of Experimental Example B1 was repeated except for using indefinite-shaped alumina ($Al_2O_3$) particles having a true density (dp) of 3.9 g/cm$^3$ as abrasive particles. The results are shown in Tables 21 and 22.

From the results of Tables 21 and 22, the use of abrasive particles having a larger true density showed a tendency of shorter treatment time but also a tendency of larger gap fluctuation.

Experimental Example B4

The procedure of Experimental Example B1 was repeated by using indefinite-shaped alumina-zirconia ($Al_2O_3.ZnO_2$) particles having a true density (dp) of 4.3 g/μm and average particle sizes ($D_{AP}$) ranging from 52 μm to 150 μm as abrasive particles. The results are shown in Tables 23 and 24.

From the result shown in Tables 23 and 24, the scraping was possible but the use of abrasive particles having still higher dp than in Experimental Examples B1 and B3 resulted in a narrower region of appropriate performances regarding the surface roughness and gap fluctuation. Further, some scraped substrates treated at a high air pressure were recognized to retain abrasive particles embedded at the substrate surface even after the washing.

Experimental Example B5

The procedure of Experimental Example B1 was repeated except for using silicon carbide (SiC) particles having dp=3.2 g/cm$^3$. The results are shown in Tables 25 and 26.

From the results shown in Tables 21 to 26, in the case of using indefinite shaped abrasive particles, those having a higher dp showed a tendency of shorter treatment time but were accompanied with difficulties as mentioned above in Experimental Example B4.

From the results shown in Tables 17 to 26 inclusively, a true density of at most ca. 4 g/cm$^3$ is appropriate for abrasive particles used in honing.

Experimental Example B6

A honing test was performed similarly as in Experimental Example B1 except for using ferrite particles of $D_{AP}$=80 μm or 100 μm and dp=5.2 g/cm$^3$ at an air pressure of $4.0\times10^5$ Pa. The results are shown in Tables 27 and 28. As shown in Tables 27 and 28, the scraping was possible but resulted in a larger gap fluctuation and a larger surface roughness. At a lower honing air pressure, the abrasive particles discharge state became unstable because of a large true density, thus resulting in a scraping irregularity and failing in obtaining a desired surface roughness.

Experimental Example B7

A honing test was performed in the same manner as in Experimental Example B1 except for changing the nozzle inner diameter (Dnzl) to 5, 8, 12, 16, 20 and 24 mm while using glass beads of $D_{AP}$=50 μm and a constant air pressure of $3.0\times10^5$ Pa. The results are shown in Table 29.

As shown in Table 29, at two small a nozzle diameter (Dnzl) relative to the sleeve diameter (=16 mm), the scraping performance was ununiform to result in a larger gap fluctuation and an ununiform surface roughness. At too large a nozzle diameter, the particle discharge state became ununiform, and because of a larger air pressure required, a larger gap fluctuation resulted. A nozzle inner diameter of 0.5–0.8 times the sleeve substrate outer diameter appeared to be further preferred.

Experimental Example B8

Aluminum sleeves having an outer diameter of 16 mm used for a developing roller of a commercially available laser beam printer ("LBP-2040", made by Canon K.K.) were provided and subjected to measurement of a gap fluctuation in the manner described with reference to FIGS. 5 to 7. Among the sleeves, those exhibiting average values of gap fluctuation falling within the range of 5.0±0.5 μm were collected. These Al sleeves were provided with a resin coating layer to be subjected to a scraping test. For reference, the sleeves provided with the resin coating layer exhibited substantially no change in gap fluctuation.

The resin coating layer was formed in the following manner.

Paint D was prepared by dispersing ingredients inclusive of 700 wt. parts of 50% solution in toluene of methyl methacrylate-dimethylaminoethyl methacrylate (mol ratio= 95:5, Mw=ca. 10,000), 85 wt. parts of crystalline graphite having an average particle size (Dav.) of 6 $\mu$m, 15 wt. parts of electroconductive carbon black and 300 wt. parts of toluene. The dispersed materials in Paint D exhibited Dav= 5.4 $\mu$m. Paint D was applied on an insulating sheet to form a dried and cured thin layer, which exhibited a volume resistivity of 7.5 ohm.cm. Paint D was diluted with toluene to a solid matter content of 35%. Then Paint D in the diluted form was ejected onto the Al sleeve held upright and rotated from a spray gun while moving the spray gun downwards. A uniform coating film thus formed was dried and cured to form a resin coating layer of Paint D. The coating conditions were set to provide an averagely ca. 10 $\mu$m-thick resin coating layer.

The thus obtained coated sleeve samples were subjected to a scraping test, i.e., a scraping treatment by using a blasting apparatus as illustrated in FIGS. 11, 13 and 14 including a honing gun having a nozzle 131 of 12 mm in inner diameter. Thus, the nozzle inner diameter/sleeve outer diameter ratio was ca. 0.75. The nozzle discharge pressure was changed in a range of 0.5–6.0×$10^5$ Pa and 6 types of glass beads having average particle sizes ($D_{AP}$) in a range of 6–160 $\mu$m were used as abrasive particles each in the form of an aqueous dispersion at a concentration of 15% by volume to effect totally 42 runs of honing test. These glass beads all had a true density (dp) of 2.5 g/$cm^3$.

Under the above-mentioned conditions, the coated sleeves were subjected to honing basically until the resin coating layer was scraped off. The results are shown in Tables 30 and 31.

From the results in Tables 30 and 31, it is understood that a similar scraping performance was achieved by honing of a resin coating layer of thermoplastic resin.

Example B1

A used developer-carrying member (developing sleeve) having an outer diameter (OD) of 16 mm actually used in a commercial laser beam printer ("LBP-1760", made by Canon K.K.) for printing on ca. $10^5$ sheets (predominantly of A4-size), was provided. The developing sleeve was originally (before use) provided with a ca. 12 $\mu$m thick resin coating layer principally comprising a thermoset phenolic resin and crystalline graphite and exhibiting a surface roughness Ra of ca. 1.1 $\mu$m. As a result of observation through a laser microscope of the used developing roller, toner attachment was observed at both ends of the substrate. After wiping the attached toner with solvent MEK, the resin coating layer exhibited a lowered surface roughness Ra of 0.65 $\mu$m. As a result of measurement of the outer diameter by laser light illumination, the remaining coating layer thickness was averagely ca. 10 $\mu$m at a central part and ca. 6 $\mu$m at both edge parts. At the edge parts, the lower aluminum substrate was recognized through a remaining small thickness of the resin layer.

The surface of the used developing sleeve was carefully wiped out with methyl ethyl ketone (MEK) so as to remove the attached toner. The developing sleeve was then re-assembled to form a cartridge ("EP-52" for "LBP-1760") and incorporated again in the laser beam printer ("LBP-1760"), which was then subjected to image forming tests. As a result, images with practically lower limit level of image density could be obtained in a normal temperature/normal humidity (NT/NH=23° C./50% RH) environment and a high temperature/high humidity (HT/HH=30° C./80% RH) environment, but the images formed in a normal temperature/low humidity (NT/LH=23° C./10% RH) were accompanied with ripple pattern irregularity at halftone parts corresponding ripple-pattern coating irregularity (blotches) at the sleeve edge parts.

Then, the developing sleeve was again taken out of the cartridge, the surface toner was removed, and the sleeve flange at one end and the magnet roller were removed therefrom. Further, the remaining sleeve was subjected to scraping of the resin coating layer by using the honing apparatus of Experimental Example B1 above. As a result, the treated sleeve exhibited a gap fluctuation of 5.3 $\mu$m.

During the scraping operation, the honing gun used had a nozzle 131 having an inner diameter of 12 mm through which glass beads of $D_{AP}$=80 $\mu$m and dp=2.5 g/$cm^3$ in the form of an aqueous dispersion at a bead/water percentage of 15% by volume were discharged at a pressure of 3.0×$10^5$ Pa. The aluminum sleeve substrate held in an upright state was rotated at 100 rpm, and the honing gun was moved repetitively upwards and downwards at a rate of 5 mm/sec. The operation was continued for 450 sec to complete the scraping. The sleeve after the scraping treatment exhibited a gap fluctuation of 5.3 $\mu$m and a centraline-average roughness of 0.63 $\mu$m on an average with fluctuations within ±0.05 $\mu$m with respect to values measured at 12 points.

Then, a fresh resin coating layer was formed in a thickness of 11 $\mu$m on the scraped sleeve by using Paint C prepared in Experimental Example B1. The resin coating layer exhibited a surface roughness Ra=1.08 $\mu$m, and the coated sleeve exhibited a gap fluctuation of 5.6 $\mu$m.

Some regeneration conditions and performance data are summarized in Table 32 together with those of the following Examples.

A magnet roller was again inserted in the sleeve and a flange was attached to form a Cartridge ("EP-52") containing a magnetic toner (for "EP-52", D4=ca. 6 $\mu$m; magnetic toner particles comprising principally 100 wt. parts of styrene-acrylate copolymer and 100 wt. parts of magnetic material in mixture with externally added hydrophobic silica fine powder) for the laser beam printer ("LBP-1750"), which was then subjected to an image forming test on 10,000 sheets on each of the NT/NH (23° C./60% RH), HT/HH (30° C./80% RH) and NT/LH (23° C./10% RH) environments. As a result, good images were formed in each environment. The results are inclusively shown in Table 33 (33–1 to 33–3) together with those of Examples described hereinafter.

Evaluation Items and Methods (1) Image Density (I.D.)

Reflection image densities of ten 5 mm-square solid black images were measured by using a reflection densitometer ("RD 918", made by Macbeth Co.) and were averaged to provide an image density (I.D.).

(2) Ghost

An image pattern of alternating solid white and solid black stripes was printed as a leading image (formed by a first rotation of the sleeve) and a halftone image was printed thereafter (by second and subsequent rotations of the sleeve), and a trace of density difference (attributable to the preceding solid black and solid white image formation)

appearing in the printed halftone image region was evaluated principally with eyes while making measured density data into account for reference and evaluated according to the following standard.

A: No density difference at all.

B: A slight image density difference is recognizable with eyes, but a measured value of image density difference is at most 0.01.

C: A density difference with vague image boundary is recognizable at a practically acceptable level.

D: Somewhat clear density difference at a practically acceptable lower limit level.

E: Clear density reference is recognizable an image density value difference and not acceptable.

(3) Pitch Irregularity (Pitch)

A solid black image and a halftone image on the reproduced image sample were observed with eyes with respect to density irregularity in the developing sleeve rotation and evaluated according to the following standard.

A: No pitch irregularity was observed at either of the solid black and halftone images.

B: Slight pitch irregularity was observed not in the solid black image but observed in the halftone image.

C: Pitch irregularities could be observed in both the solid black and halftone image but at a practically acceptable level.

D: Pitch irregularities were observed at a level not practically acceptable.

(4) Blotch

Solid black and halftone images we:re observed and compared with the result of observation of the developing roller surface for evaluation according to the following standard.

A: No blotch irregularity was observed on either the images or the developing roller.

B: Blotch irregularity was not observed on the images but observed on the developing roller.

C: Blotch irregularity was observed on the images.

The results of evaluation are inclusively shown in Table 33 together with those of the following Examples.

Examples B2 and B3

Two scraped sleeve samples having good gap fluctuation (fg) and surface roughness (Ra) among those prepared in Experimental Example B1 as a result of honing under conditions summarized in Table 32 were subjected to the formation of a resin coating layer, assembling into a cartridge and image forming test in the same manner as in Example B1.

Examples B4 and B5

Two scraped sleeve samples prepared in Experimental Example B1 as a result of honing under conditions summarized in Table 32 inclusive of abrasive particles of different particle sizes of $D_{AP}$=15 $\mu$m and 100 $\mu$m were subjected to the formation of a resin coating layer, assembling into a cartridge and image forming test in the same manner as in Example B1.

Examples B6 and B7

Two scraped sleeve samples prepared in Experimental Example B2 as a result of honing under conditions summarized in Table 32 inclusive of varying volume percentages of beads in the aqueous honing liquid were subjected to the formation of a resin coating layer, assembling into a cartridge and image forming test in the same manner as in Example B1.

Examples B8 and B10

Four scraped sleeve sample prepared in Experimental Examples B3 to B5 as a result of honing under conditions summarized in Table 32 including the use of different species of abrasive particles inclusive of abrasive particles of different particle sizes of $D_{AP}$=15 $\mu$m and 100 $\mu$m were subjected to the formation of a resin coating layer, assembling into a cartridge and image forming test in the same manner as in Example B1.

Examples B11 and B12

Two scraped sleeve samples prepared in Experimental Example B7 as a result of honing under conditions summarized in Table 32 including different honing nozzle diameters (nozzle/sleeve diameter ratios) were subjected to the formation of a resin coating layer, assembling into a cartridge and image forming test in the same manner as in Example B1.

Comparative Example B1

A scraped sleeve sample having a somewhat large gap fluctuation (fg) and a large surface roughness (Ra) among those prepared in Experimental Example B1 as a result of honing under conditions summarized in Table 32 was subjected to the formation of a resin coating layer, assembling into a cartridge and image forming test in the same manner as in Example B1.

Comparative Example B2

A scraped sleeve sample having good gap fluctuation (fg) and surface roughness (Ra) among those prepared in Experimental Example B2 as a result of honing under conditions summarized in Table 32 inclusive of a bead/concentration in the honing liquid of 30 vol. % was subjected to the formation of a resin coating layer, assembling into a cartridge and image forming test in the same manner as in Example B1.

Comparative Example B3

A scraped sleeve sample having a larger gap fluctuation and a large surface roughness prepared in Experimental Example B6 as a result of honing under conditions summarized in Table 32 inclusive of the use of ferrite abrasive particles was subjected to the formation of a resin coating layer, assembling into a cartridge and image forming test in the same-manner as in Example B1.

Comparative Examples B4 and B5

Two scraped sleeve samples prepared in Experimental Example B7 as a result of honing under conditions summarized in Table 32 inclusive of different honing nozzle sizes were subjected to the formation of a resin coating layer, assembling into a cartridge and image forming test in the same manner as in Example B1.

TABLE 17

| Air press | Honing time* (sec) Abrasive particle size $D_{AP}$ (μm) | | | | | |
|---|---|---|---|---|---|---|
| (×10^5 Pa) | 6 | 15 | 50 | 80 | 100 | 150 |
| 0.5 | L | L | L | L | L | L |
| 1.0 | L | L | L | 820 | 730 | 700 |
| 2.0 | L | L | 750 | 560 | 500 | 480 |
| 3.0 | L | 720 | 560 | 510 | 430 | 400 |
| 4.0 | L | 600 | 450 | 420 | 380 | 350 |
| 5.0 | L | 530 | 420 | 380 | 350 | 330 |
| 6.0 | L | 480 | 360 | 300 | 300 | 300 |

*L means a honing time of over 1000 sec.

TABLE 18

| | | Scraping (honing) performances | | | | |
|---|---|---|---|---|---|---|
| | Air. | Gap fluctuation (μm) | | | Roughness Ra (μm) | |
| $D_{AP}$ (μm) | press. (×10^5 Pa) | before treatment | after treatment | after coating | after treatment | after coating |
| 15 | 1.0 | 5.1 | — | — | — | — |
| | 2.0 | 4.9 | — | — | — | — |
| | 3.0 | 5.2 | 5.1 | 5.5 | 0.34 | 0.88 |
| | 4.0 | 5.0 | 5.0 | 5.4 | 0.36 | 0.90 |
| | 5.0 | 5.1 | 5.6 | 6.0 | 0.36 | 0.91 |
| | 6.0 | 4.8 | 8.2 | 8.7 | 0.38 | 0.92 |
| 50 | 1.0 | 5.2 | — | — | — | — |
| | 2.0 | 5.1 | 5.1 | 5.5 | 0.48 | 0.95 |
| | 3.0 | 5.0 | 5.0 | 5.4 | 0.53 | 1.02 |
| | 4.0 | 5.3 | 5.4 | 5.9 | 0.55 | 1.04 |
| | 5.0 | 4.8 | 6.0 | 6.5 | 0.58 | 1.08 |
| | 6.0 | 5.2 | 8.3 | 8.9 | 0.61 | 1.10 |
| 80 | 1.0 | 5.0 | 5.1 | 5.6 | 0.56 | 1.06 |
| | 2.0 | 5.1 | 5.1 | 5.5 | 0.58 | 1.09 |
| | 3.0 | 4.9 | 5.0 | 5.4 | 0.61 | 1.12 |
| | 4.0 | 4.8 | 4.8 | 5.3 | 0.62 | 1.12 |
| | 5.0 | 4.9 | 6.4 | 6.8 | 0.62 | 1.14 |
| | 6.0 | 5.0 | 8.2 | 8.6 | 0.63 | 1.13 |
| 100 | 1.0 | 5.1 | 5.1 | 5.5 | 0.61 | 1.10 |
| | 2.0 | 5.1 | 5.1 | 5.5 | 0.63 | 1.10 |
| | 3.0 | 5.0 | 5.0 | 5.4 | 0.66 | 1.13 |
| | 4.0 | 4.8 | 4.9 | 5.4 | 0.71 | 1.18 |
| | 5.0 | 5.3 | 6.8 | 6.2 | 0.73 | 1.21 |
| | 6.0 | 5.2 | 8.6 | 9.0 | 0.80 | 1.26 |
| 150 | 1.0 | 5.1 | 5.1 | 5.6 | 0.69 | 1.17 |
| | 2.0 | 5.0 | 5.0 | 5.7 | 0.75 | 1.24 |
| | 3.0 | 5.0 | 8.6 | 9.2 | 0.83 | 1.28 |
| | 4.0 | 4.9 | 13.8 | 14.7 | 0.89 | 1.35 |
| | 5.0 | 5.1 | 17.3 | 18.4 | 0.94 | 1.43 |
| | 6.0 | 5.2 | 20.2 | 21.4 | 0.98 | 1.48 |

TABLE 19

| | Honing time (sec) Abrasive particle size (μm) | | | | | |
|---|---|---|---|---|---|---|
| Volume % | 6 | 15 | 50 | 80 | 100 | 150 |
| 1 | L | L | L | L | L | L |
| 2 | L | L | 880 | 760 | 840 | L |
| 10 | L | 780 | 670 | 600 | 520 | 470 |
| 15 | L | 720 | 560 | 510 | 430 | 400 |
| 20 | L | 680 | 530 | 470 | 390 | 380 |
| 30 | L | L | 500 | 450 | 400 | L |

L: >100 sec.

TABLE 20

| | Bead | Gap fluctuation (μm) | | | Roughness Ra (μm) | |
|---|---|---|---|---|---|---|
| $D_{AP}$ (μm) | conc. (Vol. %) | before treatment | after treatment | after coating | after treatment | after coating |
| 15 | 2 | 5.0 | — | — | — | — |
| | 10 | 5.2 | 5.2 | 5.4 | — | — |
| | 15 | 5.2 | 5.1 | 5.5 | 0.34 | 0.88 |
| | 20 | 4.9 | 5.3 | 5.7 | 0.41 | 0.91 |
| | 30 | 5.0 | — | — | — | — |
| 50 | 2 | 5.0 | 5.0 | 5.2 | 0.51 | 0.97 |
| | 10 | 5.2 | 5.2 | 5.4 | 0.51 | 0.99 |
| | 15 | 5.0 | 5.0 | 5.4 | 0.53 | 1.02 |
| | 20 | 5.1 | 5.6 | 5.9 | 0.58 | 1.10 |
| | 30 | 5.0 | 10.8 | 12.6 | 0.62 | 1.16 |
| 80 | 2 | 5.1 | 5.1 | 5.4 | 0.58 | 1.08 |
| | 10 | 5.2 | 5.3 | 5.6 | 0.60 | 1.13 |
| | 15 | 4.9 | 5.0 | 5.4 | 0.61 | 1.12 |
| | 20 | 5.0 | 6.5 | 7.1 | 0.65 | 1.16 |
| | 30 | 5.2 | 12.1 | 13.5 | 0.75 | 1.26 |
| 100 | 2 | 5.0 | 5.1 | 5.4 | 0.63 | 1.12 |
| | 10 | 4.9 | 5.0 | 5.5 | 0.65 | 1.14 |
| | 15 | 5.0 | 5.0 | 5.4 | 0.66 | 1.13 |
| | 20 | 5.2 | 7.8 | 8.6 | 0.72 | 1.25 |
| | 30 | 5.1 | 15.4 | 17.6 | 0.83 | 1.32 |
| 150 | 2 | 5.0 | 5.3 | 5.7 | 0.82 | 1.29 |
| | 10 | 4.9 | 8.1 | 8.7 | 0.83 | 1.28 |
| | 15 | 5.0 | 8.6 | 9.2 | 0.83 | 1.28 |
| | 20 | 5.2 | 12.4 | 15.1 | 0.92 | 1.37 |
| | 30 | 5.1 | — | — | — | — |

TABLE 21

| Air press | Honing time (sec) Abrasive particle size $D_{AP}$ (μm) | | | | | |
|---|---|---|---|---|---|---|
| (×10^5 Pa) | 6 | 18 | 34 | 52 | 100 | 150 |
| 0.5 | L | L | L | L | L | L |
| 1.0 | L | L | 880 | 550 | 510 | 530 |
| 2.0 | L | 850 | 580 | 380 | 350 | 330 |
| 3.0 | L | 670 | 520 | 320 | 270 | 240 |
| 4.0 | 900 | 540 | 370 | 260 | 230 | 200 |
| 5.0 | 860 | 380 | 250 | 210 | 190 | 170 |
| 6.0 | 800 | 300 | 220 | 160 | 150 | 140 |

L: >1000 sec

TABLE 22

| | Air. | Gap fluctuation (μm) | | | Roughness Ra (μm) | |
|---|---|---|---|---|---|---|
| $D_{AP}$ (μm) | press. (×10^5 Pa) | before treatment | after treatment | after coating | after treatment | after coating |
| 6 | 1.0 | 5.1 | — | — | — | — |
| | 2.0 | 5.2 | — | — | — | — |
| | 3.0 | 5.1 | — | — | — | — |
| | 4.0 | 4.9 | 5.2 | 5.6 | 0.31 | 0.85 |
| | 5.0 | 5.2 | 5.3 | 5.9 | 0.33 | 0.56 |
| | 6.0 | 5.0 | 8.2 | 8.8 | 0.35 | 0.91 |
| 18 | 1.0 | 4.9 | — | — | — | — |
| | 2.0 | 5.0 | 5.1 | 5.3 | 0.33 | 0.84 |
| | 3.0 | 5.1 | 5.2 | 5.6 | 0.35 | 0.92 |
| | 4.0 | 5.2 | 5.2 | 5.6 | 0.36 | 0.95 |
| | 5.0 | 5.1 | 6.2 | 8.8 | 0.38 | 0.95 |
| | 6.0 | 5.0 | 8.2 | 9.1 | 0.41 | 0.94 |
| 34 | 1.0 | 4.8 | 5.1 | 5.3 | 0.45 | 0.96 |
| | 2.0 | 5.2 | 5.2 | 5.5 | 0.51 | 0.98 |
| | 3.0 | 5.1 | 5.0 | 5.6 | 0.57 | 1.05 |
| | 4.0 | 5.1 | 5.3 | 5.7 | 0.59 | 1.06 |
| | 5.0 | 5.2 | 6.3 | 6.8 | 0.62 | 1.12 |
| | 6.0 | 5.0 | 8.5 | 9.3 | 0.67 | 1.13 |
| 52 | 1.0 | 5.1 | 5.1 | 5.4 | 0.48 | 1.02 |

TABLE 22-continued

| $D_{AP}$ (μm) | Air. press. (×10^5 Pa) | Gap fluctuation (μm) before treatment | Gap fluctuation (μm) after treatment | Gap fluctuation (μm) after coating | Roughness Ra (μm) after treatment | Roughness Ra (μm) after coating |
|---|---|---|---|---|---|---|
| | 2.0 | 5.1 | 5.3 | 5.6 | 0.56 | 1.05 |
| | 3.0 | 5.2 | 5.1 | 5.6 | 0.61 | 1.08 |
| | 4.0 | 5.1 | 5.5 | 5.7 | 0.62 | 1.10 |
| | 5.0 | 5.0 | 6.4 | 6.8 | 0.73 | 1.22 |
| | 6.0 | 5.1 | 8.6 | 9.5 | 0.85 | 1.31 |
| 100 | 1.0 | 4.9 | 5.2 | 5.3 | 0.65 | 1.13 |
| | 2.0 | 5.1 | 5.3 | 5.7 | 0.69 | 1.15 |
| | 3.0 | 5.2 | 8.3 | 9.2 | 0.72 | 1.20 |
| | 4.0 | 5.0 | 15.1 | 16.6 | 0.83 | 1.25 |
| | 5.0 | 5.2 | 18.6 | 19.5 | 0.95 | 1.45 |
| | 6.0 | 5.1 | 21.2 | 23.8 | 1.15 | 1.53 |
| 150 | 1.0 | 5.0 | 5.1 | 6.6 | 1.24 | 1.55 |
| | 2.0 | 5.2 | 5.3 | 6.8 | 1.36 | 1.58 |
| | 3.0 | 5.1 | 9.8 | 9.2 | 1.57 | 1.73 |
| | 4.0 | 5.0 | 17.9 | 19.8 | 1.85 | 2.01 |
| | 5.0 | 5.0 | 20.8 | 23.2 | 2.13 | 2.24 |
| | 6.0 | 5.1 | 23.6 | 26.7 | 2.35 | 2.57 |

TABLE 23

| Air press (×10^5 Pa) | Honing time (sec) $D_{AP}$ (μm) 52 | 100 | 150 |
|---|---|---|---|
| 0.5 | L | L | L |
| 1.0 | 660 | 630 | 620 |
| 2.0 | 400 | 380 | 370 |
| 3.0 | 320 | 260 | 250 |
| 4.0 | 250 | 220 | 190 |
| 5.0 | 200 | 180 | 160 |
| 6.0 | 160 | 150 | 140 |

L: > 1000 sec.

TABLE 24

| $D_{AP}$ (μm) | Air. press. (×10^5 Pa) | Gap fluctuation (μm) before treatment | Gap fluctuation (μm) after treatment | Gap fluctuation (μm) after coating | Roughness Ra (μm) after treatment | Roughness Ra (μm) after coating |
|---|---|---|---|---|---|---|
| 52 | 1.0 | 5.0 | 5.1 | 5.5 | 0.51 | 1.01 |
| | 2.0 | 5.1 | 5.2 | 5.6 | 0.58 | 1.07 |
| | 3.0 | 5.1 | 5.4 | 6.1 | 0.65 | 1.16 |
| | 4.0 | 5.0 | 6.1 | 7.2 | 0.72 | 1.21 |
| | 5.0 | 5.2 | 7.0 | 8.2 | 0.77 | 1.24 |
| | 6.0 | 5.1 | 8.6 | 9.6 | 0.83 | 1.28 |
| 100 | 1.0 | 5.0 | 5.2 | 5.5 | 0.71 | 1.18 |
| | 2.0 | 5.1 | 7.3 | 7.7 | 0.78 | 1.26 |
| | 3.0 | 5.0 | 12.0 | 13.2 | 1.16 | 1.43 |
| | 4.0 | 5.1 | 17.4 | 18.5 | 1.28 | 1.55 |
| | 5.0 | 5.0 | 21.5 | 22.1 | 1.33 | 1.59 |
| | 6.0 | 5.0 | 24.8 | 25.5 | 1.38 | 1.62 |
| 150 | 1.0 | 5.1 | 5.5 | 5.9 | 0.95 | 1.51 |
| | 2.0 | 5.0 | 7.6 | 8.1 | 1.31 | 1.53 |
| | 3.0 | 5.0 | 13.7 | 15.1 | 1.59 | 1.77 |
| | 4.0 | 5.0 | 20.1 | 21.4 | 2.11 | 2.24 |
| | 5.0 | 5.1 | 24.3 | 25.6 | 2.37 | 2.52 |
| | 6.0 | 5.1 | 29.6 | 30.4 | 2.51 | 2.73 |

TABLE 25

| Air press (×10^5 Pa) | Abrasive particle size (μm) 6 | 18 | 34 | 52 | 100 | 150 |
|---|---|---|---|---|---|---|
| 0.5 | L | L | L | L | L | L |
| 1.0 | L | L | 700 | 520 | 480 | 500 |
| 2.0 | L | L | 540 | 360 | 340 | 320 |
| 3.0 | L | 610 | 520 | 340 | 330 | 310 |
| 4.0 | 950 | 570 | 390 | 280 | 250 | 220 |
| 5.0 | 860 | 400 | 260 | 230 | 210 | 190 |
| 6.0 | 820 | 320 | 230 | 160 | 160 | 150 |

L: >100 sec

TABLE 26

| $D_{AP}$ (μm) | Air. press. (×10^5 Pa) | Gap fluctuation (μm) before treatment | Gap fluctuation (μm) after treatment | Gap fluctuation (μm) after coating | Roughness Ra (μm) after treatment | Roughness Ra (μm) after coating |
|---|---|---|---|---|---|---|
| 6 | 1.0 | 4.9 | — | — | — | — |
| | 2.0 | 5.0 | — | — | — | — |
| | 3.0 | 5.2 | — | — | — | — |
| | 4.0 | 5.1 | 5.3 | 5.6 | 0.31 | 0.85 |
| | 5.0 | 5.0 | 5.1 | 5.5 | 0.32 | 0.87 |
| | 6.0 | 5.0 | 7.8 | 8.4 | 0.32 | 0.87 |
| 18 | 1.0 | 5.0 | — | — | — | — |
| | 2.0 | 5.1 | 5.2 | 5.4 | 0.30 | 0.84 |
| | 3.0 | 5.2 | 5.3 | 5.6 | 0.32 | 0.85 |
| | 4.0 | 5.1 | 5.3 | 5.7 | 0.33 | 0.89 |
| | 5.0 | 5.0 | 5.8 | 6.3 | 0.35 | 0.92 |
| | 6.0 | 4.9 | 7.7 | 8.3 | 0.37 | 0.95 |
| 34 | 1.0 | 5.0 | 5.1 | 5.2 | 0.41 | 0.94 |
| | 2.0 | 5.2 | 5.4 | 5.6 | 0.48 | 0.98 |
| | 3.0 | 5.2 | 5.3 | 5.7 | 0.53 | 1.03 |
| | 4.0 | 5.1 | 5.2 | 5.6 | 0.57 | 1.06 |
| | 5.0 | 5.0 | 5.7 | 6.1 | 0.63 | 1.13 |
| | 6.0 | 5.0 | 8.1 | 8.6 | 0.66 | 1.16 |
| 52 | 1.0 | 5.1 | 5.1 | 5.3 | 0.51 | 1.02 |
| | 2.0 | 5.0 | 5.1 | 5.4 | 0.58 | 1.08 |
| | 3.0 | 5.2 | 5.3 | 5.3 | 0.61 | 1.11 |
| | 4.0 | 5.0 | 5.3 | 5.2 | 0.63 | 1.14 |
| | 5.0 | 4.9 | 6.1 | 6.7 | 0.71 | 1.19 |
| | 6.0 | 5.1 | 8.3 | 8.9 | 0.77 | 1.22 |
| 100 | 1.0 | 5.2 | 5.3 | 5.6 | 0.69 | 1.15 |
| | 2.0 | 5.2 | 5.4 | 5.6 | 0.71 | 1.21 |
| | 3.0 | 5.0 | 5.3 | 5.7 | 0.73 | 1.25 |
| | 4.0 | 5.1 | 13.8 | 15.2 | 0.79 | 1.27 |
| | 5.0 | 5.0 | 16.7 | 18.1 | 0.88 | 1.31 |
| | 6.0 | 5.2 | 18.3 | 19.5 | 0.93 | 1.42 |
| 150 | 1.0 | 5.1 | 5.1 | 5.3 | 1.26 | 1.55 |
| | 2.0 | 5.0 | 5.2 | 5.4 | 1.35 | 1.61 |
| | 3.0 | 5.0 | 5.2 | 5.4 | 1.43 | 1.65 |
| | 4.0 | 4.9 | 16.5 | 17.7 | 1.52 | 1.71 |
| | 5.0 | 5.2 | 18.1 | 19.6 | 1.73 | 1.85 |
| | 6.0 | 5.2 | 20.9 | 22.4 | 1.98 | 2.14 |

TABLE 27

| Air press (×10^5 Pa) | $D_{AP}$ (μm) 80 | 100 |
|---|---|---|
| 4.0 | 150 | 180 |

TABLE 28

| $D_{AP}$ (μm) | Air. press. (×10$^5$ Pa) | Gap fluctuation (μm) before treatment | after treatment | after coating | Roughness Ra (μm) after treatment | after coating |
|---|---|---|---|---|---|---|
| 80 | 4.0 | 5.1 | 25.1 | 27.3 | 2.33 | 2.48 |
| 100 | ↑ | 5.0 | 29.4 | 30.1 | 2.58 | 2.73 |

TABLE 29

| Honing performances | | | | | | | |
|---|---|---|---|---|---|---|---|
| | | Gap fluctuation (μm) | | | Roughness Ra (μm) | | |
| Dnzl (mm) | Time (sec) | before treat-ment | after treat-ment | after coating | after treatment | Range | after coating |
| 5 | 800 | 5.0 | 8.1 | 9.7 | 0.53 | 0.45–0.61 | 0.96 |
| 8 | 700 | 5.1 | 5.2 | 5.5 | 0.54 | 0.51–0.56 | 0.98 |
| 12 | 560 | 5.0 | 5.0 | 5.4 | 0.53 | 0.50–0.56 | 1.02 |
| 16 | 520 | 5.2 | 5.4 | 5.9 | 0.58 | 0.52–0.64 | 1.08 |
| 20 | 470 | 5.0 | 15.3 | 16.6 | 0.63 | 0.55–0.71 | 1.15 |
| 24 | 470 | 5.1 | 16.1 | 15.3 | 0.77 | 0.55–1.01 | 1.26 |

TABLE 30

| Honing time (sec) | | | | | | |
|---|---|---|---|---|---|---|
| Air press | Abrasive particle size (μm) | | | | | |
| (×10$^5$ Pa) | 6 | 15 | 50 | 80 | 100 | 150 |
| 0.5 | L | L | L | L | L | L |
| 1.0 | L | L | 880 | 810 | 720 | 690 |
| 2.0 | L | 850 | 740 | 550 | 480 | 470 |
| 3.0 | L | 700 | 540 | 460 | 410 | 380 |
| 4.0 | L | 580 | 430 | 400 | 350 | 340 |
| 5.0 | L | 480 | 400 | 350 | 330 | 320 |
| 6.0 | L | 450 | 330 | 280 | 280 | 280 |

L: >1000 sec.

TABLE 31

| $D_{AP}$ (μm) | Air. press. (×10$^5$ Pa) | Gap fluctuation (μm) before treatment | after treatment | after coating | Roughness Ra (μm) after treatment | after coating |
|---|---|---|---|---|---|---|
| 15 | 1.0 | 5.0 | — | — | — | — |
| | 2.0 | 5.1 | 5.1 | 5.4 | 0.33 | 0.64 |
| | 3.0 | 5.0 | 5.0 | 5.5 | 0.33 | 0.65 |
| | 4.0 | 5.1 | 5.1 | 5.6 | 0.34 | 0.65 |
| | 5.0 | 5.1 | 5.7 | 6.2 | 0.35 | 0.56 |
| | 6.0 | 5.0 | 8.0 | 8.6 | 0.38 | 0.68 |
| 50 | 1.0 | 5.1 | — | — | — | — |
| | 2.0 | 5.0 | 5.0 | 5.4 | 0.46 | 0.71 |
| | 3.0 | 5.1 | 5.1 | 5.4 | 0.52 | 0.75 |
| | 4.0 | 5.0 | 5.2 | 5.7 | 0.54 | 0.76 |
| | 5.0 | 4.9 | 6.1 | 6.7 | 0.58 | 0.81 |
| | 6.0 | 5.0 | 8.4 | 8.9 | 0.62 | 0.83 |
| 80 | 1.0 | 5.1 | 5.0 | 5.3 | 0.55 | 0.75 |
| | 2.0 | 5.0 | 5.0 | 5.4 | 0.56 | 0.77 |
| | 3.0 | 5.0 | 5.0 | 5.6 | 0.59 | 0.81 |
| | 4.0 | 5.1 | 5.3 | 5.9 | 0.61 | 0.83 |
| | 5.0 | 5.0 | 6.1 | 6.9 | 0.64 | 0.85 |
| | 6.0 | 5.2 | 8.5 | 9.1 | 0.65 | 0.85 |
| 100 | 1.0 | 5.2 | 5.2 | 5.4 | 0.57 | 0.82 |
| | 2.0 | 5.1 | 5.1 | 5.5 | 0.62 | 0.85 |
| | 3.0 | 5.1 | 5.3 | 5.7 | 0.65 | 0.87 |
| | 4.0 | 5.0 | 5.2 | 5.6 | 0.69 | 0.91 |
| | 5.0 | 5.1 | 6.8 | 7.3 | 0.73 | 0.93 |
| | 6.0 | 5.1 | 8.5 | 9.2 | 0.82 | 0.98 |
| 150 | 1.0 | 5.0 | 5.0 | 5.4 | 0.72 | 0.92 |
| | 2.0 | 5.1 | 5.1 | 5.6 | 0.77 | 0.95 |
| | 3.0 | 5.2 | 5.3 | 5.8 | 0.82 | 1.01 |
| | 4.0 | 5.0 | 11.2 | 11.9 | 0.88 | 1.05 |
| | 5.0 | 5.2 | 15.3 | 16.4 | 0.96 | 1.13 |
| | 6.0 | 5.1 | 18.7 | 19.7 | 1.01 | 1.26 |

TABLE 32

| Regeneration conditions and performance data | | | | | | | | | | | | |
|---|---|---|---|---|---|---|---|---|---|---|---|---|
| | Abrasive particles | | | | Dia. ratio | Air | | Gap fluctuation (μm) | | | Roughness Ra (μm) | |
| Example | material | $d_p$ (g/cm$^3$) | $D_{AP}$ (μm) | Vol. % | nozzle/ sleeve | press. (×10$^5$ Pa) | Time (sec) | before treat-ment | after treat-ment | after coat-ing | after treat-ment | after coat-ing |
| B1 | glass | 2.5 | 80 | 15 | 0.75 | 3.0 | 450 | 5.3 | 5.3 | 5.6 | 0.63 | 1.08 |
| B2 | ↑ | ↑ | 50 | ↑ | ↑ | 2.0 | 750 | 5.1 | 5.1 | 5.5 | 0.48 | 0.95 |
| B3 | ↑ | ↑ | 50 | ↑ | ↑ | 5.0 | 420 | 4.8 | 6.0 | 6.5 | 0.58 | 1.08 |
| B4 | ↑ | ↑ | 15 | ↑ | ↑ | 4.0 | 600 | 5.0 | 5.0 | 5.4 | 0.36 | 0.90 |
| B5 | ↑ | ↑ | 100 | ↑ | ↑ | 4.0 | 380 | 4.8 | 4.9 | 5.4 | 0.71 | 1.18 |

TABLE 32-continued

| Regeneration conditions and performance data | | | | | | | | | | | | |
|---|---|---|---|---|---|---|---|---|---|---|---|---|
| | Abrasive particles | | | | Dia. ratio | Air | | Gap fluctuation (μm) | | | Roughness Ra (μm) | |
| Example | material | $d_p$ (g/cm$^3$) | $D_{AP}$ (μm) | Vol. % | nozzle/ sleeve | press. (×10$^5$ Pa) | Time (sec) | before treat-ment | after treat-ment | after coat-ing | after treat-ment | after coat-ing |
| B6 | ↑ | ↑ | 50 | 2 | ↑ | 3.0 | 880 | 5.0 | 5.0 | 5.2 | 0.51 | 0.97 |
| B7 | ↑ | ↑ | ↑ | 20 | ↑ | ↑ | 530 | 5.1 | 5.6 | 5.9 | 0.58 | 1.10 |
| B8 | $Al_2O_3$ | 3.9 | 52 | 15 | ↑ | 4.0 | 260 | 5.1 | 5.5 | 5.7 | 0.62 | 1.10 |
| B9 | $Al_2O_3.ZnO_2$ | 4.3 | 52 | ↑ | ↑ | ↑ | 250 | 5.0 | 6.1 | 7.2 | 0.72 | 1.21 |
| B10 | SiC | 3.2 | 52 | ↑ | ↑ | ↑ | 280 | 5.0 | 5.3 | 5.2 | 0.63 | 1.14 |
| B11 | glass | 2.5 | 50 | 15 | 0.5 | 3.0 | 700 | 5.1 | 5.2 | 5.5 | 0.54 | 0.98 |
| B12 | ↑ | ↑ | ↑ | ↑ | 1.0 | ↑ | 520 | 5.2 | 5.4 | 5.9 | 0.58 | 1.08 |
| Comp. B1 | glass | 2.5 | 150 | 15 | 0.75 | 5.0 | 300 | 5.1 | 17.3 | 18.4 | 0.94 | 1.43 |
| Comp. B2 | ↑ | ↑ | ↑ | 30 | ↑ | 3.0 | 400 | 5.1 | 15.4 | 17.6 | 0.83 | 1.32 |
| Comp. B3 | ferrite | 5.2 | 80 | ↑ | ↑ | 4.0 | 150 | 5.1 | 25.1 | 27.3 | 2.33 | 2.48 |
| Comp. B4 | glass | 2.5 | 50 | 15 | 0.31 | 3.0 | 800 | 5.0 | 8.1 | 9.7 | 0.53 | 0.96 |
| Comp. B5 | ↑ | ↑ | ↑ | ↑ | 1.25 | ↑ | 470 | 5.0 | 15.3 | 16.6 | 0.63 | 1.15 |

TABLE 33-1

| HT/HH (30° C./80% RH) | On 100th sheet | | | | After 10,000 sheets | | | |
|---|---|---|---|---|---|---|---|---|
| Example | I.D. | Ghost | Pitch | Blotch | I.D. | Ghost | Pitch | Blotch |
| MEK wash | 1.30 | E | D | A | — | — | — | — |
| Ex. B1 | 1.45 | A | A | A | 1.43 | A | A | A |
| Ex. B2 | 1.46 | A | A | A | 1.44 | A | A | A |
| Ex. B3 | 1.45 | A | A | A | 1.43 | A | A | A |
| Ex. B4 | 1.45 | B | A | A | 1.42 | B | A | A |
| Ex. B5 | 1.44 | B | A | A | 1.42 | B | A | A |
| Ex. B6 | 1.45 | B | A | A | 1.43 | B | A | A |
| Ex. B7 | 1.45 | B | A | A | 1.42 | B | A | A |
| Ex. B8 | 1.45 | A | A | A | 1.42 | A | A | A |
| Ex. B9 | 1.45 | A | A | A | 1.41 | A | A | A |
| Ex. B10 | 1.45 | A | A | A | 1.42 | A | A | A |
| Ex. B11 | 1.45 | B | A | A | 1.41 | B | A | A |
| Ex. B12 | 1.45 | B | A | A | 1.41 | B | A | A |
| Com. Ex. B1 | 1.23 | C | B | A | 1.13 | C | B | A |
| Com. Ex. B2 | 1.25 | C | B | A | 1.15 | D | C | A |
| Com. Ex. B3 | 1.27 | E | D | A | 1.15 | E | D | A |
| Com. Ex. B4 | 1.38 | C | B | A | 1.32 | D | B | A |
| Com. Ex. B5 | 1.41 | D | C | A | 1.35 | D | C | A |

TABLE 33-2

| NT/NH (23° C./60% RH) | On 100th sheet | | | | After 10,000 sheets | | | |
|---|---|---|---|---|---|---|---|---|
| Example | I.D. | Ghost | Pitch | Blotch | I.D. | Ghost | Pitch | Blotch |
| MEK wash | 1.34 | E | C | B | — | — | — | — |
| Ex. B1 | 1.46 | A | A | A | 1.44 | A | A | A |
| Ex. B2 | 1.45 | A | A | A | 1.44 | A | A | A |
| Ex. B3 | 1.46 | A | A | A | 1.43 | A | A | A |
| Ex. B4 | 1.44 | A | A | A | 1.44 | A | A | A |
| Ex. B5 | 1.45 | A | A | A | 1.43 | B | A | A |
| Ex. B6 | 1.46 | A | A | A | 1.44 | B | A | A |
| Ex. B7 | 1.45 | B | A | A | 1.44 | B | A | A |
| Ex. B8 | 1.45 | A | A | A | 1.43 | A | A | A |
| Ex. B9 | 1.45 | A | A | A | 1.42 | A | A | A |

TABLE 33-2-continued

| NT/NH (23° C./60% RH) | On 100th sheet | | | | After 10,000 sheets | | | |
|---|---|---|---|---|---|---|---|---|
| Example | I.D. | Ghost | Pitch | Blotch | I.D. | Ghost | Pitch | Blotch |
| Ex. B10 | 1.45 | A | A | A | 1.42 | A | A | A |
| Ex. B11 | 1.44 | B | A | A | 1.42 | B | A | A |
| Ex. B12 | 1.44 | B | A | A | 1.43 | B | A | A |
| Com. Ex. B1 | 1.32 | C | B | A | 1.26 | C | C | A |
| Com. Ex. B2 | 1.35 | C | B | A | 1.25 | C | C | A |
| Com. Ex. B3 | 1.31 | E | D | A | 1.22 | E | D | A |
| Com. Ex. B4 | 1.42 | B | B | A | 1.38 | D | A | A |
| Com. Ex. B5 | 1.41 | C | C | A | 1.37 | C | B | A |

TABLE 33-3

| NT/LH (23° C./10% RH) | On 100th sheet | | | | After 10,000 sheets | | | |
|---|---|---|---|---|---|---|---|---|
| Example | I.D. | Ghost | Pitch | Blotch | I.D. | Ghost | Pitch | Blotch |
| MEK wash | 1.14 | E | C | C | — | — | — | — |
| Ex. B1 | 1.46 | A | A | A | 1.45 | A | A | A |
| Ex. B2 | 1.46 | A | A | A | 1.45 | A | A | A |
| Ex. B3 | 1.46 | A | A | A | 1.45 | A | A | A |
| Ex. B4 | 1.46 | A | A | A | 1.44 | A | A | A |
| Ex. B5 | 1.46 | A | A | A | 1.45 | A | A | A |
| Ex. B6 | 1.46 | A | A | A | 1.45 | A | A | A |
| Ex. B7 | 1.45 | A | A | A | 1.45 | A | A | A |
| Ex. B8 | 1.45 | A | A | A | 1.45 | A | A | A |
| Ex. B9 | 1.45 | A | A | A | 1.44 | A | A | A |
| Ex. B10 | 1.45 | A | A | A | 1.45 | A | A | A |
| Ex. B11 | 1.45 | B | A | A | 1.44 | B | A | A |
| Ex. B12 | 1.45 | B | A | A | 1.45 | B | A | A |
| Com. Ex. B1 | 1.32 | D | C | B | 1.24 | C | D | B |
| Com. Ex. B2 | 1.35 | D | C | A | 1.22 | C | D | B |
| Com. | 1.31 | E | E | B | 1.18 | E | D | C |

TABLE 33-3-continued

| | NT/LH (23° C./10% RH) | | | | | | | |
|---|---|---|---|---|---|---|---|---|
| | On 100th sheet | | | | After 10,000 sheets | | | |
| Example | I.D. | Ghost | Pitch | Blotch | I.D. | Ghost | Pitch | Blotch |
| Ex. B3 | | | | | | | | |
| Com. | 1.42 | B | B | A | 1.35 | D | A | A |
| Ex. B4 | | | | | | | | |
| Com. | 1.41 | C | C | A | 1.36 | C | D | B |
| Ex. B5 | | | | | | | | |

Hereinbelow, some examples are described with reference to the use of an abrasive sheet wherein abrasive particles held movably on a support, for scraping of a developer-carrying member (developing sleeve). "Part(s)" used for describing a composition is by weight unless otherwise noted specifically.

Production of Developer C1

| | |
|---|---|
| Styrene | 70 part(s) |
| Butyl acrylate | 20 part(s) |
| Monobutyl maleate | 10 part(s) |
| Divinylbenzene | 1 part(s) |
| Benzoyl peroxide | 1 part(s) |
| Di-t-butyl peroxy-2-ethylhexanoate | 0.5 part(s) |

To the above mixture, 200 parts of water containing 0.8 part of polyvinyl alcohol (not completely saporified) was added, and vigorous stirring was performed to provide a suspension liquid. Into a reaction vessel containing 50 parts of water and aerated with nitrogen, the above-prepared suspension liquid was poured and subjected to suspension polymerization at 80° C. for 12 hours. After the reaction, the polymerizate was watched with water, dewatered and dried to obtain Vinyl resin (1).

| | |
|---|---|
| Vinyl resin (1) prepared above | 100 parts |
| Magnetite | 90 parts |
| Azo iron complex (negative charge control agent) | 2 parts |
| Low-molecular weight ethylene-propylene copolymer | 4 parts |

The above mixture was melt-kneaded through a twin-screw kneading extruder heated at 130° C. After being cooled, the kneaded product was coarsely crushed by a hammer mill and finely pulverized by a pulverizer utilizing a jet air stream, followed by classification by means of a multi-division pneumatic classifier utilizing the Coanda effect to obtain toner particles having a weight-average particle size (D4) of 7.8 μm.

To 100 parts of the toner particles, 1.2 parts of negatively chargeable hydrophobic silica fine powder ($S_{BET}$=300 $m^2/g$) treated with hexamethyldisilazane and 3.5 parts of strontium titanate were added and blended therewith bar a Henschel mixer to obtain a negatively chargeable magnetic mono-component developer (Developer, C1).

Preparation of Used Developer-carrying Member (Developing Roller)

An aluminum cylinder having an outer diameter of 24.5 mm and a thickness of 0.8 mm was blast-treated to obtain an aluminum sleeve showing a gap fluctuation of at most 5 μm and a central line-average roughness Ra of at most 0.4 μm. The aluminum sleeve was coated with a resin coating layer in the following manner.

Paint E was prepared by dispersing ingredients inclusive of 1000 wt. parts of prepolymer of thermosetting phenolic resin synthesized from phenol and formaldehyde by using an ammonium catalyst (in the form of a 50%—solution in methanol), 360 wt. parts of crystalline graphite having an average particle size (Dav.) of 8 μm, 40 parts of electroconductive carbon black and 400 parts of isopropyl alcohol, in a sand mill containing glass beads. The dispersed materials in Paint E exhibited Dav=6.3 μm. Paint E was applied on an insulating sheet to form a dried and cured thin layer, which exhibited a volume resistivity of 3.5 ohm.cm. Paint E was diluted with isopropyl alcohol to a solid matter content of 36 wt. %. Then Paint E in the diluted form was ejected onto the Al sleeve held upright, rotated at a constant speed and provided with a masking for 3 mm width at each end from a spray gun while moving the spray gun downwards. A uniform coating film thus formed was dried and cured at 160° C. for 20 min. to form a resin coating layer of Paint E. The coating conditions were set to provide an averagely ca. 15 μm-thick resin coating layer. Into the sleeve, a magnet roller was inserted, and flanges were attached to both ends to provide a developer-carrying member.

The thus-obtained developer-carrying member (developing roller) was incorporated in a developing apparatus of a digital copying machine ("iR6000", made by Canon K.K.) equipped with an amorphous silicon photosensitive drum and subjected to a continuous image formation on $5.5\times10^5$ sheets (of A4-size) by using the above-prepared Developer C1. The developing apparatus had an organization roughly as illustrated in FIG. 8. As a result of observation of the resin coating layer surface of the developer-carrying member through a laser microscope, toner melt-attachment was observed at both sleeve ends. The attached toner was wiped out with MEk to measure a surface roughness over the entire surface, whereby the central line-average roughness (Ra) of the resin coating layer was lowered to 0.35 μm compared with a value of ca. 0.8 μm of the as-produced state. As a result of measurement of outer diameter by laser light illumination, the remaining coating layer thickness was averagely ca. 6.5 μm at a central part and ca. 4 μm at both edge parts compared with an original value of ca. 15 μm. At the edge parts, the lower aluminum substrate was recognized through a remaining small thickness of the resin layer.

The surface of the used developing roller was carefully wiped out with methyl ethyl ketone (MEK) so as to remove the attached toner. The developing roller was then re-assembled to form a developing apparatus and incorporated again in the copying machine ("iR6000"), which was then subjected to image forming tests. As a result, images with practically lower limit level of image density could be obtained in a high temperature/high humidity (HT/HH=30° C./80% RH) environment, but the images formed in a low temperature/low humidity (LT/LH=15° C./10% RH) were accompanied with ripple pattern irregularity at halftone parts corresponding to ripple-pattern coating irregularity (blotches) at the sleeve edge parts.

Several developing rollers in the above-mentioned state after the continuous image formation on $5.5\times10^5$ A4-size sheets were subjected to cleaning of the surface attached toner, and the removal of a flange at one end and the magnetic roller therefrom. The thus-obtained used sleeves having a partially worn resin coating layer were subjected to preparation of regenerated developer-carrying member according to the following Examples.

Production Example C1

A used resin-coated sleeve sample prepared above was subjected to a scraping test as described below by using an abrasive sheet as shown in FIG. 15 prepared by impregnating a porous support sheet 251 with 10 ml of a liquid 253 containing 50 wt. parts of 25 abrasive particles 252 in 100 wt. parts of ethanol and carrying the abrasive particles 252 in a movable state relative to the support sheet 251. In this example, the support sheet 251 comprised unwoven cloth of 2 mm in thickness, 35 mm in width and 200 mm in length, the abrasive particles 252 comprised alumina particles (having an average primary particle size ($D_{AP}$)=20 μm and a Mohs hardness (Mh) of 91, and the liquid medium comprised ethanol. The used sleeve sample was set as a sleeve 244 and subjected to a scraping test with an abrasive sheet 255 prepared in the above-described manner and backed by a steel-made pressing belt 256. In this example, the sleeve 254 was rotated at a speed of 1100 rpm while the abrasive sheet 255 was moved in an axial direction of the sleeve 354 at a rate of 20 mm/sec, and the abrasive sheet 255 was pressed against the sleeve 254 at a pressing load of 40N by the pressing belt 256. After the scraping test, the scraped sleeve was placed in a drying oven at 160° C. for 15 min. to evaporate the attached ethanol, and the scraping refuse and abrasive particles attached on the sleeve surface were removed by air blowing. The sleeve thus treated was evaluated with respect to scraping performance, a gap fluctuation and a surface roughness. As a result, the sleeve exhibited a central line-average roughness (Ra) of 0.52 μm with a fluctuation of ±0.03 μm biased on measurement at 12 points, and a gap fluctuation (fg) of 5.9 μm.

Then, the thus-scraped sleeve was provided with a resin coating layer in the same manner as described above for preparation of a fresh developing sleeve by using Paint E in the diluted state at a solid content of 36%, thereby forming a 15.5 μm-thick resin coating layer showing Ra=0.82 μm and a gap fluctuation (fg) of 6.3 μm. The thus-obtained regenerated sleeve is called Sleeve A.

The conditions for the scraping test and regeneration performances are summarized in Table 34 together with those of the following Production Examples.

Production Example C2

The procedure of Production Example C1 was repeated except for using a support sheet 251 comprising unwoven cloth, abrasive particles 252 comprising silica particles ($D_{AP}$=15 μm, Mh=6) and a liquid 253 comprises water and scraping conditions including an abrasive sheet pressing load of 45N, a sleeve rotation speed of 1950 rpm and an abrasive sheet moving speed of 20 mm/sec. The regenerated sleeve is called Sleeve B.

Production Example C3

The procedure of Production Example C1 was repeated except for using a support sheet 251 comprising a foam sheet, abrasive particles 252 comprising silicon carbide particles ($D_{AP}$=5 μm, Mh=9) and a liquid 253 comprises isopropyl alcohol and scraping conditions including an abrasive sheet pressing load of 20N, a sleeve rotation speed of 1150 rpm and an abrasive sheet moving speed of 20 mm/sec. The regenerated sleeve is called Sleeve C.

Production Example C4

The procedure of Production Example C1 was repeated except for using an abrasive sheet using no liquid (ethanol) but carrying abrasive particles 252 directly attached to the support sheet 251. The scraping was performed well but resulted in a somewhat larger Ra. The regenerated sleeve is called Sleeve D.

Comparative Production Example C1

The procedure of Production Example C1 was repeated except for using an abrasive sheet not containing abrasive particles. The scraped sleeve resulted in a gap fluctuation and a surface roughness as shown in Table 34 but the resin coating Layer was not scraped off sufficiently. The regenerated sleeve is called Sleeve E.

Example C1

Sleeve A prepared in Production Example C1 was re-assembled into a developing roller by inserting a magnet roller and attaching a flange and incorporated again in the copying machine ("iR6000") and subjected to a continuous image forming test by using Developer C1 on 10,000 sheets each in various environments of HT/HH (30° C./80% RH) and LT/LH (15° C./10% RH). As a result, good images were obtained in each environment. The results are inclusively shown in Table 35 (35–1 and 35–2) together with those of Examples described hereinafter.

Evaluation Items and Methods (1) Image Density (I.D.)

Reflection image densities of ten 5 mm-dia. solid black circle images on a test chart at an image areal percentage of 5.5% were measured by using a reflection densitometer ("RD 918", made by Macbeth Co.) and were averaged to provide an image density (I.D.).

(2) Density Fluctuation (ΔID)

For evaluating a density uniformity along the length of a developing roller, a halftone solid image at a reflection density of 0.4 reproduced as an image at a reflection density of 0.6, and the resultant reflection image densities along the length were measured by a reflection densitometer ("RD 918", made by Macbeth Co.) to obtain a density fluctuation (ΔID) as a difference between a maximum value and a minimum value. For the measurement, the pitch irregularity portion was removed from the object of evaluation.

(3) Fog

Reflectance values of a reproduced solid white image are measured at randomly selected 10 points by using a reflective densitometer ("TC-6DS", measured by Tokyo Denshoku K.K.), and the lowest value is taken as Rs (%). Separately, reflectance values are measured at randomly selected 10 points on white black paper by using the same reflective densitometer, and an average thereof is taken as $R_B$ (%) to calculate a fog density (Dfog) as $R_B$–$R_S$ (%). Based on the measured fog density Dfog, the evaluation is performed according to the following standard.

A: <1.0% (Fog is not recognizable with eyes.)

B: 1.0–2.0% (Fog is not recognizable unless observed carefully.)

C: 2.0–4.0% (Fog is recognizable but at a practically acceptable level.)

D: >4.0% (Noticeable fog.)

(4) Image Quality

A: Clear images free from scattering even observed through a magnifying glass at a magnification of 10.

B: Clear images as far as observed with eyes.

C: Slight scattering is observed but at a practically acceptable level.

D: Scratchy character images in addition to scattering.

(5) Pitch Irregularity (Pitch)

A solid black image and a halftone solid image (above-mentioned) on the reproduced image sample were observed with eyes with respect to density irregularity in the developing roller rotation and evaluated according to the following standard.

A: No pitch irregularity was observed at either of the solid black and halftone solid images.

B: Slight pitch irregularity was observed not in the solid black image but observed in the halftone solid image.

C: Pitch irregularities could be observed in both the solid black and halftone solid image but at a practically acceptable level.

D: Pitch irregularities were observed at a level not practically acceptable.

(4) Blotch

Solid black and halftone solid images were observed and compared with the result of observation of the developing roller surface for evaluation according to the following standard.

A: No blotch irregularity was observed on either the images or the developing roller.

B: Blotch irregularity was not observed on the images but observed on the developing roller.

C: Blotch irregularity was observed on the images.

The results of evaluation are inclusively shown in Table 16 together with those of the following Examples.

Example C2

Sleeve B prepared in Production Example C2 was used for image formation on 10,000 sheets similarly as in Example C1. Good results were obtained as shown in Table 35.

Example C3

Sleeve C prepared in Production Example C3 was used for image formation on 10,000 sheets similarly as in Example C1. The results are shown in Table 35.

Example C4

Sleeve D prepared in Production Example C4 was used for image formation on 10,000 sheets similarly as in Example C1. As shown in Table 35, the performances were inferior than in Examples C1 to C3 but were at a practically acceptable level.

Comparative Example C1

Sleeve E prepared in Comparative Production Example C1 was used for image formation on 10,000 sheets similarly as in Example C1. As shown. in Table 35, similarly as in the case of using the sleeve after the continuous image formation and before regeneration, the resultant images were accompanied with ripple pattern in the LT/LH environment due to ripple coating irregularity of toner on the sleeve.

Production of Developer C2

| | |
|---|---|
| Styrene | 75 part(s) |
| Butyl acrylate | 25 part(s) |
| Divinylbenzene | 0.5 part(s) |
| Benzoyl peroxide | 1 part(s) |
| Di-t-butyl peroxy-2-ethylhexanoate | 0.5 part(s) |

To the above mixture, 180 parts of water containing 0.8 part of polyvinyl alcohol (not completely saponified) was added, and vigorous stirring was performed to provide a suspension liquid. Into a reaction vessel containing 50 parts of water and aerated with nitrogen, the above-prepared suspension liquid was poured and subjected to suspension polymerization at 85° C. for 10 hours. After the reaction, the polymerizate was washed with water, dewatered and dried to obtain Vinyl resin (2).

| | |
|---|---|
| Vinyl resin (2) prepared above | 100 parts |
| Triiron tetroxide | 90 parts |
| Triaminotriphenylmethane dye (positive charge control agent) | 2 parts |
| Low-molecular weight ethylene-propylene copolymer | 5 parts |

From the above mixture, toner particles having a weight-average particle size (D4) of 8.5 μm, were prepared otherwise in the same manner as in Production of Developer C1.

To 100 parts of the toner particles, 1.0 part of positively chargeable hydrophobic silica fine powder ($S_{BET}$=130 $m^2/g$) treated with amino-modified silicone oil (having a viscosity of 100 $m^2$/sec at 25° C.), 0.6 part of strontium titanate and 0.2 part of polyvinylidene fluoride fine powder were added and blended therewith by a Henschel mixer to obtain a positively chargeable magnetic mono-component developer (Developer C2).

Preparation of Used Developer-carrying Member (Developing Roller)

An aluminum cylinder having an outer diameter of 20 mm and a thickness of 0.8 mm was blast-treated to obtain an aluminum sleeve showing a gap fluctuation of at most 5 μm and a central line-average roughness Ra of at most 0.4 μm. The aluminum sleeve was coated with a resin coating layer in the following manner.

Paint F was prepared by dispersing ingredients inclusive of 1000 wt. parts of prepolymer of thermosetting phenolic resin synthesized from phenol and formaldehyde by using an ammonium catalyst (in the form of a 50%—solution in methanol), 360 wt. parts of crystalline graphite having an average particle size (Dav.) of 8 μm, 40 parts of electroconductive carbon black, 300 parts of quaternary ammonium salt compound and 400 parts of isopropyl alcohol, in a sand mill containing glass beads. The dispersed materials in Paint F exhibited Dav=5.9 μm. Paint F was applied on an insulating sheet to form a dried and cured thin layer, which exhibited a volume resistivity of 2.7 ohm.cm Paint F was diluted with isopropyl alcohol to a solid matter content of 35 wt. %. Then Paint F in the diluted form was ejected onto the Al sleeve held upright, rotated at a constant speed and provided with a masking for 3 mm width at each end from a spray gun while moving the spray gun downwards. A uniform coating film thus formed was dried and cured at 160° C. for 20 min. to form a resin coating layer of Paint F. The coating conditions were set to provide an averagely ca. 20 μm-thick resin coating layer. Into the sleeve, a magnet roller was inserted, and flanges were attached to both ends to provide a developer-carrying member.

The thus-obtained developer-carrying member (developing roller) was incorporated in a developing apparatus of an analog copying machine ("NP6035", made by Canon K.K.) equipped with an OPC photosensitive drum and subjected to a continuous image formation on $3\times10^5$ sheets (of A4-size) by using the above-prepared Developer C2. The developing apparatus had an organization roughly as illustrated in FIG. 8. As a result of observation of the resin coating layer surface of the developer-carrying member through a laser microscope, toner melt-attachment was observed at both sleeve ends. The attached toner was wiped out with MEk to measure a surface roughness over the entire surface, whereby the central line-average roughness (Ra) of the resin coating layer was lowered to 0.30 μm compared with a value of ca. 0.9 μm of the as-produced state. As a result of measurement of outer diameter by laser light illumination, the remaining coating layer thickness was averagely ca. 10.2 μm at a central part and ca. 8.8 μm at both edge parts compared with an original value of ca. 15 μm. At the edge parts, the lower aluminum substrate was not recognized but scars were recognized to be formed in the sleeve circumferential direction.

The surface of the used developing roller was carefully wiped out with methyl ethyl ketone (MEK) so as to remove the attached toner. The developing roller was then re-assembled to form a developing apparatus and incorporated again in the copying machine ("NP-6035"), which was then subjected to image forming tests by using the above-prepared Developer C2. As a result, images with practically lower limit level of image density, fog and image quality could be obtained in a high temperature/high humidity (HT/HH=30° C./80% RH) environment, but the images formed in a low temperature/low humidity (LT/LH=15° C./10% RH) were accompanied with ripple pattern irregularity at halftone parts corresponding to ripple-pattern coating irregularity (blotches) at the sleeve edge parts.

Several developing rollers in the above-mentioned state after the continuous image formation on $3\times10^5$ A4-size sheets were subjected to cleaning of the surface attached toner, and the removal of a flange at one end and the magnetic roller therefrom. The thus-obtained used sleeves having a partially worn resin coating layer were subjected to preparation of regenerated developer-carrying member according to the following Examples.

Production Example C5

A used resin-coated sleeve sample prepared above was subjected to a scraping test as described below by using an abrasive sheet as shown in FIG. 15 prepared by impregnating a porous support sheet 251 with a liquid 253 containing abrasive particles 252 and carrying the abrasive particles 252 in a movable state relative to the support sheet 251. In this example, the support sheet 251 comprised the same unwoven cloth as in Production Example 1, the abrasive particles 2 comprised soda glass particles (having an average primary particle size ($D_{AP}$)=8 μm and a Mohs hardness (Mh) of 6), and the liquid medium comprised methanol. The used sleeve sample was set as a sleeve 254 and subjected to a scraping test with an abrasive sheet 255 prepared in the above-described manner and backed by a steel-made pressing belt 256. In this example, the sleeve 254 was rotated at a speed of 1700 rpm while the abrasive sheet 255 was moved in an axial direction of the sleeve 254 at a rate of 15 mm/sec, and the abrasive sheet 255 was pressed against the sleeve 254 at a pressing load of 40N. After the scraping test, the scraped sleeve was placed in a drying oven at 160° C. for 15 min. to evaporate the attached ethanol, and the scraping refuse arid abrasive particles attached on the sleeve surface were removed by air blowing. The sleeve thus treated was evaluated with respect to scraping performance, a gap fluctuation and a surface roughness. As a result, the sleeve exhibited a central line-average roughness (Ra) of 0.48 μm with a fluctuation of ±0.03 μm based on measurement at 12 points, and a gap fluctuation (fg) of 5.9 μm.

Then, the thus-scraped sleeve was provided with a resin coating layer in the same manner as described above for preparation of a fresh developing sleeve by using Paint F in the diluted state. The thus-obtained regenerated sleeve is called Sleeve F.

The conditions for the scraping test and regeneration performances are also summarized in Table 34 together with those of the following Production Examples.

Production Example C6

The procedure of Production Example C5 was repeated except for using a support sheet 251 comprising a plastic film, abrasive particles 252 comprising $Fe_2O_3$ particles ($D_{AP}$=5 μm, Mh=6) and a liquid 253 comprises water and scraping conditions including an abrasive sheet pressing load of 45N, a sleeve rotation speed of 2050 rpm and an abrasive sheet moving speed of 20 mm/sec. The regenerated sleeve is called Sleeve G.

Production Example C7

The procedure of Production Example C5 was repeated except for using a support sheet 251 comprising fiber-planted film, abrasive particles 252 comprising $Cr_2O_3$ particles ($D_{AP}$=5 μm, Mh=7) and a liquid 253 comprises isopropylalcohol and scraping conditions including an abrasive sheet pressing load of 20N, a sleeve rotation speed of 1150 rpm and an abrasive sheet moving speed of 20 mm/sec. The regenerated sleeve is called Sleeve H.

Production Example C8

The procedure of Production Example C5 was repeated except for using abrasive particles 2 comprising soda particles ($D_{AP}$=0.008 μm). The scraped sheet resulted in a gap fluctuation and a surface roughness as shown in Table 34, but the abrasion and scraping performance was somewhat inferior. The regenerated sleeve is called Sleeve I.

Comparative Production Example C2

The procedure of Production Example C5 was repeated except for using an abrasive sheet not containing abrasive particles. The scraped sleeve resulted in a gap fluctuation and a surface roughness as shown in Table 34 but the resin coating layer was not scraped off sufficiently. The regenerated sleeve is called Sleeve J.

Example C5

Sleeve F prepared in Production Example C5 was re-assembled into a developing roller by inserting a magnet roller and attaching a flange and incorporated again in the copying machine ("NP6035") and subjected to a continuous image forming test by using the above-perpared Developer C2 on 10,000 sheets each. The results are inclusively shown in Table 35 (35–1 and 35–2) together with those of Examples described hereinafter.

Example C7

Sleeve H prepared in Production Example C7 was used for image formation on 10,000 sheets similarly as in Example C5.

Example C8

Sleeve I prepared in Production Example C8 was used for image formation on 10,000 sheets similarly as in Example C5.

Comparative Example C2

Sleeve J prepared in Comparative Production Example C2 was used for image formation on 10,000 sheets similarly as in Example C5. As shown in Table 35, similarly as in the case of using the sleeve after the continuous image formation and before regeneration, the resultant images were accompanied with ripple pattern in the LT/LH environment due to ripple coating irregularity of toner on the sleeve.

Production of Developer C3

Into a 2 liter-four-necked flask equipped with a high-speed stirrer ("TK-Homomixer" made by Tokushu Kika Kogyo K.K.), 880 parts of deionized water and 450 parts of 0.1 mol/1-$Na_3PO_4$ aqueous solution were added and warmed to 58° C. under stirring at 12000 rpm. Then, 68 parts of 0.1 mol/1-$CaCl_2$ aqueous solution was gradually added thereto to form a dispersion medium containing minute hardly water-soluble $Ca_3(PO_4)_2$.

On the other hand, as a disperse phase, a mixture of

| | |
|---|---|
| Styrene monomer | 170 parts |
| n-Butyl acrylate monomer | 30 parts |
| C.I. Pigment Blue 15:3 | 14 parts |
| Polyester resin (polycondensate between 50:50 mol mixture of terephthalic acid and propylene oxide-added bisphenol A) | 8 parts |
| Salicylic acid Cr compound (positive charge control agent) | 2 parts |
| Ester wax | 20 parts |

was dispersed for 3 hours in an attritor, and 10 parts of 2,2'-azobis(2,4-dimethylvaleronitrile) was added to form a polymerizable mixture, which was then charged in the dispersion medium and dispersed into particles in 12 minutes under stirring at the high stirring speed. Thereafter, the high-speed stirrer was changed to a propeller stirring blade, and at an elevated temperature of 80° C., polymerization was performed at 50 rpm for 10 hours. After the polymerization, the slurry was cooled, and dilute hydrochloric acid was added thereto dissolve the dispersing agent. Then, the polymerizate was washed and dried to recover cyan toner particles having a weight-average particle size (D4) of 8.3 μm. Then, 100 parts of the toner particles were blended with 1.3 parts of negatively chargeable silica fine powder ($S_{BET}$=300 $m^2/g$) treated with hexamethyldisilazane and 0.5 part of strontium titanate by means of a Henschel mixer to prepare a cyan toner.

Separately, a carrier was prepared in the following manner.

Phenol/formaldehyde (50/50 mixture) monomer was mixed and dispersed in water, and to 100 parts of the monomer, 400 parts of hematite particles (of 0.6 μm) and 600 parts of magnetite particles (of 0.25 μm) surface-treated with a titanate coupling agent were added thereto and uniformly dispersed therewith. The monomer in the system was then polymerized under appropriate addition of ammonia to prepare magnetic particle-containing spherical magnetic resin carrier core particles (average particle size=33 μm, saturation magnetization=38 $Am^2/kg$).

On the other hand, 20 parts of toluene, 20 parts of butanol and 40 parts of ice were placed in a four-necked flask, and under stirring, 40 parts of a mixture of $CH_3SiCl_3$ and $(CH_3)_2SiCl_2$ (15:10 by mol) was added thereto, followed by 30 min. of stirring and 1 hour of condensation reaction at 60° C. Thereafter, the resultant siloxane was sufficiently washed with water and dissolved in a toluene-methyl ethyl ketone-butanol mixture solvent to prepare silicone varnish at a solid matter content of 10%.

To the silicone varnish containing 100 parts of the solid matter content, 2.0 parts of deionized water, 2.0 parts of hardening agent, 1.0 part of aminosilane coupling agent and 5.0 parts of silane coupling agent were simultaneously added thereto to form a carrier-coating solution. Then, the solution was applied by a coating machine ("SPIRACOATER", made by Okada Seiko K.K.) onto the above-prepared carrier core particles at a coating rate of 1 part of coating resin per 100 parts of the core. The resultant coated carrier exhibited a volume resistivity of $4\times10^{13}$ ohm.cm and an impedance of $2\times10^{10}$ ohm.cm. The carrier was blended with the above-prepared cyan toner to prepare a two-component developer (Developer C3) having a toner concentration of 8 wt. %.

Preparation of Used Developer-carrying Member (Developing Roller)

An aluminum cylinder having an outer diameter of 20 mm and a thickness of 0.8 mm was blast-treated to obtain an aluminum sleeve showing a gap fluctuation of at most 5 μm and a central line-average roughness Ra of at most 0.4 μm. The aluminum sleeve was coated with a resin coating layer in the following manner.

Paint G was prepared by dispersing ingredients inclusive of 800 parts of prepolymer of thermosetting phenolic resin synthesized from phenol and formaldehyde by using an ammonium catalyst (in the form of a 50%—solution in methanol), 170 parts of methyl acrylate-dimethylaminoethyl methacrylate copolymer (mol ratio=90/10; solid matter=50%, Mw=10200, Mn=4500, Mw/Mn=2.3), 220 parts of crystalline graphite having an average particle size (Dav.) of 5 μm, 55 parts of electroconductive carbon black, 200 parts of spherical carbon particles (Dav=8 μm) and 280 parts of MEK, in a sand mill containing zirconia particles (of Dav=2 mm) for 3 hours, followed by removal of the zirconia particles by sieving. The dispersed materials in Paint G exhibited Dav=5.7 μm. Paint G was applied on an insulating sheet to form a dried and cured thin layer, which exhibited a volume resistivity of 13.5 ohm.cm. Paint G was diluted with MEK to a solid matter content of 40 wt. %. Then Paint G in the diluted form was ejected onto the Al sleeve held upright, rotated at a constant speed and provided with a masking for 3 mm width at each end from a spray gun while moving the spray gun downwards. A uniform coating film thus formed was dried and cured at 160° C. for 20 min. to form a resin coating layer of Paint G. The coating conditions were set to provide an averagely ca. 15 μm-thick resin coating layer. Into the sleeve, a magnet roller was inserted, and flanges were attached to both ends to provide a developer-carrying member.

The thus-obtained developer-carrying member (developing roller) was incorporated in a developing apparatus of a digital copying machine ("CP2100", made by Canon K.K., remodelled) equipped with an OPC photosensitive drum and subjected to a continuous image formation on $1.5\times10^5$ sheets (of A4-size) by using the above-prepared Developer C3. The developing apparatus had an organization roughly as illustrated in FIG. 10. As a result of observation of the resin coating layer surface of the developer-carrying member through a laser microscope, toner melt-attachment was observed at both sleeve ends. The attached toner was wiped out with MEk to measure a surface roughness over the entire surface, whereby the central line-average roughness (Ra) of the resin coating layer was lowered to 0.715 μm compared with a value of ca. 1.9 μm of the as-produced state. As a result of measurement of outer diameter by laser light illumination, the remaining coating layer thickness was averagely ca. 8.5 μm at a central part and ca. 6 μm at both edge parts compared with an original value of ca. 15 μm. At the edge parts, the lower aluminum substrate was recognized through a remaining small thickness of the resin layer.

The surface of the used developing roller was carefully wiped out with methyl ethyl ketone (MEK) so as to remove the attached toner. The developing roller was then re-assembled to form a developing apparatus and incorporated again in the copying machine ("CP2100" remodelled), which was then subjected to image forming tests by using the above-prepared Developer C3. As a result, images with practically lower limit level of image density could be obtained in a high temperature/high humidity (HT/HH=30° C./80% RH) environment, but the images formed in a low temperature/low humidity (LT/LH=15° C./10% RH) were accompanied with ripple pattern irregularity at halftone parts corresponding to ripple-pattern coating irregularity (blotches) at the sleeve edge parts.

Several developing rollers in the above-mentioned state after the continuous image formation on $1.5\times10^5$ A4-size sheets were subjected to cleaning of the surface-attached toner, and the removal of a flange at one end and the magnetic roller therefrom. The thus-obtained used sleeves having a partially worn resin coating layer were subjected to preparation of regenerated developer-carrying member according to the following Examples.

Production Example C9

A used resin-coated sleeve sample prepared above was subjected to a scraping test as described below by using an abrasive sheet as shown in FIG. 15 prepared by impregnating a porous support sheet 251 with a liquid 253 containing abrasive particles 252 and carrying the abrasive particles 252 in a movable state relative to the support sheet 251. In this example, the support sheet 251 comprised knit cloth, the abrasive particles 252 comprised spherical soda glass particles (having an average primary particle size ($D_{AP}$)=8 μm and a Mohs hardness (Mh) of 6), and the liquid medium comprised methanol. The used sleeve sample was set as a sleeve 254 and subjected to a scraping test with an abrasive sheet 255 prepared in the above-described manner. In this example the sleeve 254 was rotated at a speed of 1700 rpm while the abrasive sheet 255 was moved in an axial direction of the sleeve 254 at a rate of 15 mm/sec, and the abrasive sheet 255 was pressed against the sleeve 254 at a pressing load of 40N. After the scraping test, the scraped sleeve was placed in a drying oven at 160° C. for 15 min. to evaporate the attached methanol, and the scraping refuse and abrasive particles attached on the sleeve surface were removed by air blowing. The sleeve thus treated was evaluated with respect to scraping performance, a gap fluctuation and a surface roughness. As a result, the sleeve exhibited a central line-average roughness (Ra) of 0.38 μm with a fluctuation of ±0.04 μm based on measurement at 12 points, and a gap fluctuation (fg) of 5.1 μm.

Then, the thus-scraped sleeve was provided with a resin coating layer in the same manner as described above for preparation of a fresh developing sleeve by using Paint G in the diluted state. The thus-obtained regenerated sleeve is called Sleeve K.

The conditions for the scraping test and regeneration performances are summarized in Table 34 together with those of the following Production Examples.

Production Example C10

The procedure of Production Example C9 was repeated except for using a support sheet comprising a plastic film, abrasive particles comprising ZrC particles ($D_{AP}$=12 μm, Mh=9) and a liquid comprises water and scraping conditions including an abrasive sheet pressing load of 18N, a sleeve rotation speed of 2050 rpm and an abrasive sheet moving speed of 20 mm/sec. The regenerated sleeve is called Sleeve L.

Comparative Production Example C3

The procedure of Production Example C9 was repeated except for using an abrasive sheet carrying abrasive particles comprising indefinite-shaped alumina particles ($D_{AP}$=60 μm) and no liquid. As shown in Table 34, the scraped sleeve resulted in larger gap fluctuation and surface roughness, thus failing in uniform scraping but resulting in local scraping irregularity. The sleeve substrate after the scraping of the resin coating layer was accompanied with abrasion scars. As a results of observation of a fresh resin coating layer thereon, the resin coating layer showed a coating irregularity. The regenerated sleeve is called Sleeve M.

Example C9

Sleeve K prepared in Production Example C9 was re-assembled into a developing roller by inserting a magnet roller and attaching a flange and incorporated again in the copying machine ("CP 21000", remodelled) and subjected to a continuous image forming test by using the above-prepared Developer C3 on 10,000 sheets each in various environments of HT/HH (30° C./80% RH) and LT/LH (15° C./10% RH). As a result, good images were obtained in each environments. The results are inclusively shown in Table 35 (35–1 and 35–2) together with those of Examples described hereinafter.

Example C10

Sleeve L prepared in Production Example C10 was used for image formation on 10,000 sheets similarly as in Example C9. Good results were obtained as shown in Table 35.

Comparative Example C3

Sleeve M prepared in Comparative Production Example C3 was used for image formation on 10,000 sheets similarly as in Example C9. The resultant images were at practically unacceptable level in view of image density (ID) and pitch irregularity (Pitch).

Production of Developer C4

| | |
|---|---|
| Ethylene oxide-added bisphenol A | 29 mol. % |
| Propylene oxide-added bisphenol A | 22 mol. % |
| Terephthalic acid | 37 mol. % |
| Fumaric acid | 15 mol. % |
| Trimellitic acid | 5 mol. % |

The above ingredients were charged in a 5 liter-four-necked flask equipped with a reflux condenser, a water-separator, an $N_2$ gas-intake pipe, a thermometer and a stirring device, and subjected to polycondensation at 200° C. while introducing $N_2$ gas into the flask. After completion of the reaction, the polymerizate was washed with water, dewatered and dried to obtain Polyester resin (1), which exhibited Mn=5000, Mw=38000 and Tg=58.1° C.

| | |
|---|---|
| Polyester resin (1) prepared above | 100 parts |
| Triiron tetroxide | 90 parts |
| Azo-iron complex (negative charge control agent) | 2 parts |
| Fischer-Tropshe wax | 5 parts |

From the above ingredients, toner particles having a weight-average particle size (D4) of 6.7 μm were prepared otherwise in the same manner as in Production of Developer C1.

To 100 parts of the toner particles, 1.2 parts of negatively chargeable hydrophobic silica fine powder ($S_{BET}$=300 $m^2/g$) treated with hexamethyldisilazane and dimethylsilicone oil, and 3.0 parts of strontium titanate were added and blended therewith by a Henschel mixer to obtain a negatively chargeable magnetic mono-component developer (Developer C4).

Preparation of Used Developer-carrying Member (Developing Roller)

An aluminum cylinder having an outer diameter of 16 mm and a thickness of 0.7 mm was blast treated to obtain an aluminum sleeve showing a gap fluctuation of at most 5 μm and a central line-average roughness Ra of at most 0.4 μm. The aluminum sleeve was coated with a resin coating layer in the following tanner.

Paint H was prepared by dispersing ingredients inclusive of 1000 parts of prepolymer of thermosetting phenolic resin synthesized from phenol and formaldehyde by using an ammonium catalyst (in the form of a 50%—solution in methanol), 450 parts of crystalline graphite having an average particle size (Dav.) of 8 μm, 50 parts of electroconductive carbon black, 25 parts of imidazole compound, 75 parts of spherical carbon particles (Dav=5 μm), and 600 parts of isopropyl alcohol, in a sand mill containing glass beads. The dispersed materials in Paint H exhibited Dav 5.3 μm. Paint H was applied on an insulating sheet to form a dried and cured thin layer, which exhibited a volume resistivity of 2.5 ohm.cm. Paint H was diluted with isopropyl alcohol to a solid matter content of 35 wt. %. Then Paint H in the diluted form was ejected onto the Al sleeve held upright, rotated at a constant speed and provided with a masking for 3 mm width at each end from a spray gun while moving the spray gun downwards. A uniform coating film thus formed was dried and cured at 160° C. for 20 min. to form a resin coating layer of Paint H. The coating conditions were set to provide an averagely ca. 8 μm-thick resin coating layer. Into the sleeve, a magnet roller was inserted, and flanges were attached to both ends to provide a developer-carrying member.

The thus-obtained developer-carrying member (developing roller) was incorporated in a developing apparatus of a digital copying machine ("LP 3000, made by Canon K.K.) equipped with an OPC photosensitive drum and an elastic regulation blade comprising an elastomer and subjected to a continuous image formation on $2.0\times10^5$ sheets (of A4-size) by using the above-prepared Developer C4. The developing apparatus had an organization roughly as illustrated in FIG. 9. As a result of observation of the resin coating layer surface of the developer-carrying member through a laser microscope, toner melt-attachment was observed at both sleeve ends. The attached toner was wiped out with MEk to measure a surface roughness over the entire surface, whereby the central line-average roughness (Ra) of the resin coating layer was lowered to 0.55 μm compared with a value of ca. 1.1 μm of the as-produced state. As a result of measurement of outer diameter by laser light illumination, the remaining coating layer thickness was averagely ca. 3.5 μm at a central part and ca. 2 μm at both edge parts compared with an original value of ca. 8 μm. At the edge parts, the lower aluminum substrate was recognized through a remaining small thickness of the resin layer.

The surface of the used developing roller was carefully wiped out with methyl ethyl ketone (MEK) so as to remove the attached toner. The developing roller was then re-assembled to form a developing apparatus and incorporated again in the copying machine ("LP3000"), which was then subjected to image forming tests. As a result, image densities were insufficient in an HT/HH (30° C./80% RH) environment, and in an LT/LH (15° C./10% RH), images were accompanied with ripple pattern irregularity at halftone parts, corresponding to ripple-pattern coating irregularity (blotches) at the sleeve edge parts.

Several developing rollers in the above-mentioned state after the continuous image formation on $2.0\times10^5$ A4-size sheets were subjected to cleaning of the surface-attached toner, and the removal of a flange at one end and the magnetic roller therefrom. The thus-obtained used sleeves having a partially worn resin coating layer were subjected to preparation of regenerated developer-carrying member according to the following Examples using a system illustrated in FIGS. 15 and 16.

Production Example C11

A used sleeve sample as described above was subjected to a scraping test under the same conditions as in Production Example C2, and the scraped sleeve sample was further coated with a resin coating layer of Paint H otherwise in the same manner as in Production Example C1. The regenerated sleeve thus obtained is called Sleeve N. The scraping conditions and regeneration performances are also shown in Table 34.

Production Example C12

A used sleeve sample as described above was subjected to a scraping test under the same conditions as in Production Example C7, and the scraped sleeve sample was further coated with a resin coating layer of Paint H otherwise in the same manner as in Production Example C1. The regenerated sleeve thus obtained is called Sleeve O. The scraping conditions and regeneration performances are also shown in Table 34.

Comparative Production Example C4

A used sleeve sample as described above was subjected to a scraping test under the same conditions as in Comparative Production Example C2, and the scraped sleeve sample was further coated with a resin coating layer of Paint H otherwise in the same manner as in Production Example C1. The regenerated sleeve thus obtained is called Sleeve P. The scraping conditions and regeneration performances are also shown in Table 34. The scraped sleeve exhibited gap fluctuation and surface roughness values which appeared to be acceptable, but the scraping of the resin coating layer was insufficient.

Production Example C13

A fresh sleeve sample incorporated in a fresh developing apparatus for a digital copying machine ("LP3000", made by Canon K.K.) was subjected to a scraping test under the same conditions as in Production Example C1 except for using diamond particles ($D_{AP}$=20 μm, Mh=9) for industrial use as abrasive particles, and the scraped sleeve sample was further coated with a resin coating layer of Paint H otherwise in the same manner as in Production Example C1. The regenerated sleeve thus obtained is called Sleeve Q. The scraping conditions and regeneration performances are also shown in Table 34.

Example C11

Sleeve N prepared in Production Example C11 was re-assembled into a developing roller by inserting a magnet roller and attaching a flange and incorporated again in the copying machine ("LP3000") together with a fresh elastic regulation blade and subjected to a continuous image forming test by using the above-prepared Developer C4 on 10,000 sheets each in various environments of HT/HH (30° C./80% RH) and LT/LH (15° C./10% RH). As a result, good images were obtained in each environment. The results are also shown in Table 35 (35–1 and 35–2) together with those of Examples described hereinafter.

Example C12

Sleeve O prepared in Production Example C12 was used for image formation on 10,000 sheets similarly as in Example C11. Good results were obtained as shown in Table 35.

Comparative Example C4

Sleeve P prepared in Comparative Production Example C4 was used for image formation on 10,000 sheets similarly as in Example C11. As shown in Table 35, similarly as in the case of using the sleeve after the continuous image formation and before regeneration, the resultant images were accompanied with ripple pattern in the LT/LH environment due to ripple coating irregularity of toner on the sleeve.

Example C13

Sleeve Q prepared in Production Example C13 was used for image formation on 10,000 sheets similarly as in Example C1. The results are shown in Table 35.

TABLE 34

| | Regeneration conditions and performances | | | | | | | | |
|---|---|---|---|---|---|---|---|---|---|
| | Abrasive sheet | | | Before scraping | | After scraping | | | After coating |
| Sleeve | Support sheet | Abrasive particles | Liquid | fg(μm) | Ra(μm) | fg(μm) | Ra(μm) | range of Ra(μm) | Ra(μm) |
| A | woven cloth | alumina | ethanol | 5.8 | 0.35 | 5.9 | 0.52 | ±0.03 | 0.82 |
| B | unwoven cloth | spherical $SiO_2$ | water | 5.8 | 0.35 | 6.0 | 0.55 | ±0.04 | 0.78 |
| C | foam sheet | SiC | IPA | 5.8 | 0.35 | 5.7 | 0.51 | ±0.04 | 0.85 |
| D | woven cloth | alumina | none | 5.8 | 0.35 | 8.5 | 0.74 | ±0.09 | 0.91 |
| E | woven cloth | none | ethanol | 5.8 | 0.35 | 6.1 | 0.65 | ±0.06 | 1.11 |
| F | unwoven cloth | soda glass | methanol | 5.7 | 0.30 | 5.9 | 0.48 | ±0.05 | 0.89 |
| G | plastic film | $Fe_2O_3$ | water | 5.7 | 0.30 | 6.1 | 0.47 | ±0.06 | 0.88 |
| H | fiber-planted film | $Cr_2O_3$ | IPA | 5.7 | 0.30 | 6.0 | 0.49 | ±0.04 | 0.91 |
| I | unwoven cloth | soda glass *1 | methanol | 5.7 | 0.30 | 6.2 | 0.29 | ±0.08 | 0.99 |
| J | unwoven cloth | none | methanol | 5.7 | 0.30 | 6.6 | 0.73 | ±0.08 | 1.28 |
| K | woven cloth | soda glass | methanol | 4.1 | 0.75 | 5.1 | 0.58 | ±0.04 | 1.88 |
| L | plastic film | ZrC | water | 4.1 | 0.75 | 5.7 | 0.55 | ±0.06 | 1.84 |
| M | woven cloth | alumina *2 | none | 4.1 | 0.75 | 10.1 | 1.52 | ±0.44 | 2.12 |
| N | unwoven cloth | spherical $SiO_2$ | water | 5.8 | 0.55 | 6.1 | 0.45 | ±0.05 | 1.08 |
| O | woven cloth | soda glass | methanol | 5.8 | 0.55 | 6.5 | 0.49 | ±0.06 | 1.11 |
| P | unwoven cloth | none | methanol | 5.8 | 0.55 | 6.3 | 0.77 | ±0.08 | 1.21 |
| Q | woven cloth | diamond | ethanol | 5.5 | 1.09 | 6.4 | 0.55 | ±0.04 | 1.13 |

*1: small $D_{AP}$

*2: indefinite-shaped and large $D_{AP}$

TABLE 35-1

| | | HT/HH (30° C./80% RH) | | | | | | | | | | | |
|---|---|---|---|---|---|---|---|---|---|---|---|---|---|
| | | On 100-th sheet | | | | | | After 10,000 sheets | | | | | |
| Example | Sleeve | I.D. | ΔID | Fog | Quality | Pitch | Blotch | I.D. | ΔID | Fog | Quality | Pitch | Blotch |
| MEK wash | | 1.22 | 0.37 | B | C | C | A | — | — | — | — | — | — |
| C1 | A | 1.48 | 0.02 | A | A | A | A | 1.47 | 0.03 | A | A | A | A |
| C2 | B | 1.47 | 0.02 | A | A | A | A | 1.48 | 0.03 | A | A | A | A |
| C3 | C | 1.45 | 0.03 | A | A | A | A | 1.46 | 0.02 | A | A | A | A |
| C4 | D | 1.25 | 0.12 | B | C | C | A | 1.31 | 0.08 | A | C | B | A |
| Comp. C1 | E | 1.09 | 0.31 | B | D | D | B | 1.17 | 0.19 | B | C | C | B |
| C5 | F | 1.37 | 0.02 | A | A | A | A | 1.41 | 0.03 | A | A | A | A |
| C6 | G | 1.39 | 0.03 | A | A | A | A | 1.42 | 0.02 | A | A | A | A |
| C7 | H | 1.32 | 0.06 | A | A | B | A | 1.37 | 0.05 | A | A | A | A |
| C8 | I | 1.15 | 0.18 | B | C | C | A | 1.17 | 0.21 | B | C | C | A |
| Comp. C2 | J | 1.05 | 0.26 | B | D | C | B | 1.08 | 0.33 | B | C | D | B |
| C9 | K | 1.32 | 0.04 | A | A | A | A | 1.33 | 0.03 | A | A | A | A |
| C10 | L | 1.30 | 0.04 | A | A | A | A | 1.35 | 0.02 | A | A | A | A |
| Comp. C3 | M | 0.82 | 0.19 | C | D | D | A | 1.02 | 0.27 | B | C | D | A |
| C11 | N | 1.45 | 0.02 | A | A | A | A | 1.46 | 0.02 | A | A | A | A |
| C12 | O | 1.32 | 0.05 | A | A | A | A | 1.35 | 0.03 | A | A | A | A |

TABLE 35-1-continued

| | | HT/HH (30° C./80% RH) | | | | | | | | | | | |
|---|---|---|---|---|---|---|---|---|---|---|---|---|---|
| | | On 100-th sheet | | | | | | After 10,000 sheets | | | | | |
| Example | Sleeve | I.D. | ΔID | Fog | Quality | Pitch | Blotch | I.D. | ΔID | Fog | Quality | Pitch | Blotch |
| Comp. C4 | P | 1.08 | 0.24 | B | D | C | B | 1.18 | 0.26 | B | C | C | B |
| C13 | Q | 1.46 | 0.02 | A | A | A | A | 1.47 | 0.02 | A | A | A | A |

TABLE 35-2

| | | LT/LH (15° C./10% RH) | | | | | | | | | | | |
|---|---|---|---|---|---|---|---|---|---|---|---|---|---|
| | | On 100-th sheet | | | | | | After 10,000 sheets | | | | | |
| Example | Sleeve | I.D. | ΔID | Fog | Quality | Pitch | Blotch | I.D. | ΔID | Fog | Quality | Pitch | Blotch |
| MEK wash | | 1.25 | 0.29 | C | D | C | C | — | — | — | — | — | — |
| C1 | A | 1.42 | 0.02 | A | A | A | A | 1.43 | 0.04 | A | A | A | A |
| C2 | B | 1.50 | 0.03 | A | A | A | A | 1.47 | 0.05 | A | A | A | A |
| C3 | C | 1.41 | 0.04 | A | A | A | A | 1.45 | 0.03 | A | A | A | A |
| C4 | D | 1.33 | 0.10 | B | C | C | B | 1.37 | 0.09 | B | B | B | A |
| Comp. C1 | E | 1.13 | 0.26 | C | D | C | C | 1.19 | 0.28 | C | C | B | C |
| C5 | F | 1.39 | 0.02 | A | A | A | A | 1.42 | 0.03 | A | A | A | A |
| C6 | G | 1.41 | 0.04 | A | A | A | A | 1.40 | 0.05 | A | A | A | A |
| C7 | H | 1.35 | 0.02 | A | A | A | A | 1.39 | 0.05 | A | A | A | A |
| C8 | I | 1.21 | 0.19 | B | C | C | B | 1.27 | 0.18 | A | B | C | B |
| Comp. C2 | J | 0.95 | 0.32 | C | D | C | C | 1.14 | 0.29 | C | D | C | C |
| C9 | K | 1.40 | 0.02 | A | A | A | A | 1.42 | 0.03 | A | A | A | A |
| C10 | L | 1.42 | 0.04 | A | A | A | A | 1.38 | 0.07 | A | B | A | A |
| Comp. C3 | M | 1.20 | 0.27 | C | D | D | B | 1.30 | 0.35 | B | C | D | A |
| C11 | N | 1.38 | 0.05 | A | A | A | A | 1.37 | 0.05 | A | A | A | A |
| C12 | O | 1.36 | 0.04 | A | A | A | A | 1.39 | 0.05 | A | A | A | A |
| Comp. C4 | P | 1.25 | 0.27 | D | D | C | C | 1.21 | 0.24 | C | D | B | B |
| C13 | Q | 1.38 | 0.04 | A | A | A | A | 1.41 | 0.04 | A | A | A | A |

Hereinbelow, some specific examples are submitted regarding the use of an abrasive tape for scraping resin coating layers on used developer-carrying members.

Experimental Example D1

Prior to regeneration of an actually used product developing sleeve (developer-carrying member), the following scraping test was performed.

Aluminum sleeves having an outer diameter of 24.5 mm used for a developing roller of a commercially available copying machine ("NP-6350", made by Canon K.K.) were provided and subjected to measurement of a gap fluctuation in the manner described with reference to FIGS. 5 to 7. Among the sleeves, those exhibiting average values of gap fluctuation falling within the range 5.0±0.5 μm were collected. These Al sleeves were provided with a resin coating layer to be subjected to a scraping test. For reference, the sleeves provided with the resin coating layer exhibited substantially no change in gap fluctuation.

The resin coating layer was formed in the following manner.

Paint J was prepared by dispersing ingredients inclusive of 1000 wt. parts of prepolymer of thermosetting phenolic resin synthesized from phenol and formaldehyde by using an ammonium catalyst (in the form of a 50%—solution in methanol), 360 wt. parts of crystalline graphite particles (Dav=7.5 μm), 40 wt. parts of electroconductive carbon black and 400 wt. parts of isopropyl alcohol. The dispersed materials in Paint J exhibited Dav=6.2 μm. Paint J was applied on an insulating sheet to form a dried and cured thin layer, which exhibited a volume resistivity of 3.2 ohm.cm. Paint J was diluted with isopropyl alcohol to a solid matter content of 35%. Then Paint J in the diluted form was ejected onto the Al sleeve held upright and rotated at a constant speed from a spray gun while moving the spray gun downwards. A uniform coating film thus formed was dried and cured to form a resin coating layer of Paint J. The coating conditions were set to provide an averagely ca. 12 μm-this resin coating layer.

Figure 18:
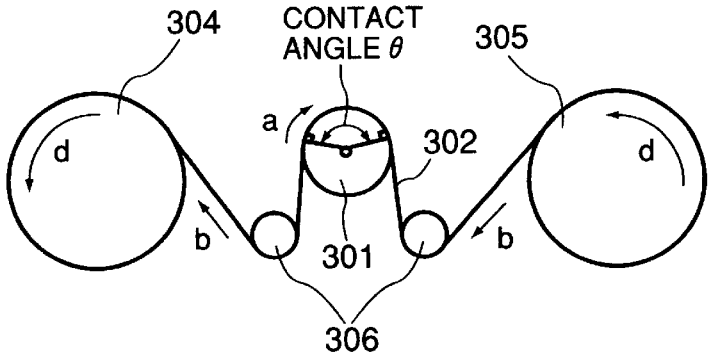

The thus obtained coated sleeve samples were subjected to a scraping test, i.e., a tape abrasion treatment by using an apparatus as illustrated in FIGS. 17 and 18 including a 5 cm-wide abrasive tape 302 comprising alumina particles firmly attached onto a polyester film and continually fed at a rate of 15 mm/sec. The tape feed unit was vertically moved at a speed of 15 mm/sec in an axial direction of a sleeve 301. The abrasive tape 302 was abutted against the sleeve 31 rotated at 1200 rpm at abutting pressures ranging from $0.5\times10^5$–$6.0\times10^5$ Pa so as to provide a contact angle θ of 180 deg. Various lots of abrasive tapes 302 were used having thicknesses in a range of 23–75 μm corresponding to surface roughnesses Rz of 3.0–40 μm.

Under the above-mentioned conditions, the coated sleeves were subjected to tape abrasion basically until the resin coating layer was scraped off. The abrasion time was measured as an indication of scraping performance and recorded in Table 36 below, and the test results of the scraping, such as gap fluctuation and surface roughnesses, measured after wiping with soft cloth wetted with methyl ethyl ketone, are summarized in Tables 37–1 and 37–2.

TABLE 36

| Abut. press. | Scraping time* (sec) by alumina abrasive tape — Tape surface roughness Rz (μm) | | | | | | |
|---|---|---|---|---|---|---|---|
| (Pa) | 3.0 | 6.0 | 8.0 | 10 | 20 | 30 | 40 |
| 0.5 | L | L | L | L | L | L | L |
| 1.0 | L | 820 | 660 | 540 | 240 | 195 | 135 |
| 2.0 | L | 710 | 570 | 450 | 180 | 135 | 90 |
| 3.0 | L | 640 | 510 | 390 | 150 | 105 | 75 |
| 4.0 | L | 600 | 480 | 360 | 120 | 90 | 60 |
| 5.0 | L | 570 | 450 | 330 | 90 | 75 | 45 |
| 6.0 | L | 540 | 435 | 300 | 75 | 60 | 45 |

*L: >900 sec until scraping-off.

TABLE 37-1

| Conditions | | Scraping (abrasive tape) performances | | | | |
|---|---|---|---|---|---|---|
| Tape | Abut. | Gap fluctuation (μm) | | | Roughness Ra (μm) | |
| Rz (μm) | press (×10$^5$ Pa) | before treatment | after treatment | after coating | after treatment | after coating |
| 6.0 | 1.0 | 4.8 | 4.9 | 5.4 | 0.29 | 0.64 |
| | 2.0 | 5.1 | 5.2 | 5.7 | 0.31 | 0.66 |
| | 3.0 | 5.0 | 5.1 | 5.6 | 0.32 | 0.67 |
| | 4.0 | 5.1 | 5.3 | 5.9 | 0.34 | 0.68 |
| | 5.0 | 4.9 | 6.2 | 6.8 | 0.36 | 0.69 |
| | 6.0 | 4.7 | 8.8 | 9.4 | 0.39 | 0.73 |
| 8.0 | 1.0 | 4.9 | 5.0 | 5.5 | 0.37 | 0.70 |
| | 2.0 | 5.0 | 5.1 | 5.6 | 0.38 | 0.72 |
| | 3.0 | 4.9 | 5.0 | 5.5 | 0.39 | 0.73 |
| | 4.0 | 5.2 | 5.3 | 5.8 | 0.41 | 0.75 |
| | 5.0 | 4.8 | 6.4 | 7.0 | 0.43 | 0.77 |
| | 6.0 | 4.7 | 8.9 | 9.5 | 0.46 | 0.78 |
| 10 | 1.0 | 4.8 | 4.9 | 5.4 | 0.43 | 0.77 |
| | 2.0 | 4.9 | 5.0 | 5.5 | 0.44 | 0.79 |
| | 3.0 | 5.1 | 5.2 | 5.7 | 0.46 | 0.80 |
| | 4.0 | 5.0 | 5.3 | 5.9 | 0.48 | 0.81 |
| | 5.0 | 4.8 | 6.5 | 7.1 | 0.50 | 0.82 |
| | 6.0 | 5.2 | 9.1 | 9.7 | 0.53 | 0.84 |

TABLE 37-2

| Conditions | | Scraping (alumina abrasive tape) performances | | | | |
|---|---|---|---|---|---|---|
| | Abut. press | Gap fluctuation (μm) | | | Roughness Ra (μm) | |
| Tape Rz (μm) | (×10$^5$ Pa) | before treatment | after treatment | after coating | after treatment | after coating |
| (Sleeve B) | 1.0 | 5.1 | 5.2 | 5.7 | 0.62 | 0.83 |
| 20 | 2.0 | 5.2 | 5.3 | 5.8 | 0.66 | 0.84 |
| | 3.0 | 4.9 | 5.1 | 5.6 | 0.68 | 0.86 |
| | 4.0 | 5.0 | 5.2 | 5.7 | 0.72 | 0.87 |
| (Sleeve C) | 5.0 | 4.8 | 6.7 | 7.2 | 0.77 | 0.89 |
| | 6.0 | 4.7 | 9.4 | 10.0 | 0.85 | 0.95 |
| 30 | 1.0 | 5.2 | 5.3 | 5.8 | 0.71 | 0.86 |
| | 2.0 | 5.1 | 5.2 | 5.7 | 0.73 | 0.88 |
| | 3.0 | 5.3 | 5.6 | 6.1 | 0.75 | 0.89 |
| | 4.0 | 5.2 | 5.7 | 6.3 | 0.77 | 0.91 |
| | 5.0 | 5.0 | 7.3 | 7.8 | 0.80 | 0.96 |
| | 6.0 | 4.8 | 10.5 | 11.2 | 0.91 | 1.01 |
| 40 | 1.0 | 4.7 | 8.3 | 9.0 | 1.18 | 1.14 |

TABLE 37-2-continued

| Conditions | | Scraping (alumina abrasive tape) performances | | | | |
|---|---|---|---|---|---|---|
| | Abut. press | Gap fluctuation (μm) | | | Roughness Ra (μm) | |
| Tape Rz (μm) | (×10$^5$ Pa) | before treatment | after treatment | after coating | after treatment | after coating |
| (Sleeve E) | 2.0 | 4.9 | 10.7 | 11.4 | 1.22 | 1.18 |
| | 3.0 | 5.0 | 13.8 | 14.6 | 1.26 | 1.21 |
| | 4.0 | 5.1 | 16.4 | 17.2 | 1.32 | 1.27 |
| | 5.0 | 5.3 | 19.7 | 20.5 | 1.42 | 1.37 |
| (Sleeve F) | 6.0 | 5.1 | 22.5 | 23.3 | 1.61 | 1.56 |

Experimental Example D2

The procedure of Experimental Example D1 was repeated except or using various abrasive tapes carrying silicon carbide (SiC) abrasive particles instead of alumina abrasive particles. The scraping conditions and performances are inclusively shown in Tables 38, 39–1 and 39–2.

TABLE 38

| Abut. press. | Scraping time* (sec) (SiC abrasive tapes) — Tape surface roughness Rz (μm) | | | | | | |
|---|---|---|---|---|---|---|---|
| (×10$^5$ Pa) | 3.0 | 6.0 | 8.0 | 10 | 20 | 30 | 40 |
| 0.5 | L | L | L | L | L | L | L |
| 1.0 | L | 900 | 720 | 620 | 300 | 240 | 180 |
| 2.0 | L | 770 | 620 | 540 | 240 | 180 | 135 |
| 3.0 | L | 710 | 570 | 510 | 210 | 150 | 105 |
| 4.0 | L | 670 | 540 | 480 | 180 | 135 | 90 |
| 5.0 | L | 640 | 510 | 450 | 150 | 120 | 75 |
| 6.0 | L | 610 | 480 | 420 | 135 | 105 | 60 |

*L: >900 sec.

TABLE 39-1

| Conditions | | Scraping (SiC abrasive tape) performances | | | | |
|---|---|---|---|---|---|---|
| Tape | Abut. | Gap fluctuation (μm) | | | Roughness Ra (μm) | |
| Rz (μm) | press (×10$^5$ Pa) | before treatment | after treatment | after coating | after treatment | after coating |
| 6.0 | 1.0 | 4.9 | 5.1 | 5.6 | 0.28 | 0.59 |
| | 2.0 | 5.0 | 5.2 | 5.7 | 0.29 | 0.61 |
| | 3.0 | 5.1 | 5.3 | 5.8 | 0.30 | 0.62 |
| | 4.0 | 5.1 | 5.4 | 5.9 | 0.32 | 0.64 |
| | 5.0 | 4.9 | 6.1 | 6.6 | 0.33 | 0.64 |
| | 6.0 | 4.9 | 8.4 | 9.0 | 0.35 | 0.66 |
| 8.0 | 1.0 | 4.9 | 5.1 | 5.6 | 0.36 | 0.67 |
| | 2.0 | 5.0 | 5.2 | 5.7 | 0.37 | 0.69 |
| | 3.0 | 4.8 | 4.9 | 5.4 | 0.38 | 0.70 |
| | 4.0 | 4.9 | 5.0 | 5.5 | 0.39 | 0.71 |
| | 5.0 | 5.0 | 6.2 | 6.7 | 0.41 | 0.71 |
| | 6.0 | 5.1 | 8.6 | 9.0 | 0.44 | 0.73 |
| 10 | 1.0 | 4.9 | 5.1 | 5.7 | 0.40 | 0.70 |
| | 2.0 | 5.0 | 5.1 | 5.6 | 0.41 | 0.71 |
| | 3.0 | 5.1 | 5.2 | 5.7 | 0.43 | 0.72 |
| | 4.0 | 4.9 | 5.2 | 5.8 | 0.44 | 0.73 |
| | 5.0 | 4.8 | 6.4 | 6.9 | 0.45 | 0.73 |
| | 6.0 | 5.0 | 8.9 | 9.5 | 0.46 | 0.74 |

TABLE 39-2

| Scraping (SiC abrasive tape) performances | | | | | | |
|---|---|---|---|---|---|---|
| Conditions | | Gap fluctuation (μm) | | | Roughness Ra (μm) | |
| Tape Rz (μm) | Abut. press ($\times 10^5$ Pa) | before treat-ment | after treat-ment | after coat-ing | after treat-ment | after coat-ing |
| 20 (Sleeve D) | 1.0 | 5.2 | 5.3 | 5.8 | 0.56 | 0.74 |
| | 2.0 | 5.3 | 5.4 | 5.9 | 0.59 | 0.76 |
| | 3.0 | 5.1 | 5.2 | 5.7 | 0.60 | 0.76 |
| | 4.0 | 5.2 | 5.4 | 5.9 | 0.61 | 0.77 |
| | 5.0 | 5.0 | 6.8 | 7.4 | 0.63 | 0.78 |
| | 6.0 | 4.8 | 9.2 | 9.8 | 0.71 | 0.80 |
| 30 | 1.0 | 4.8 | 5.0 | 5.5 | 0.65 | 0.78 |
| | 2.0 | 4.9 | 5.2 | 5.7 | 0.68 | 0.79 |
| | 3.0 | 5.2 | 5.6 | 6.1 | 0.70 | 0.80 |
| | 4.0 | 4.9 | 5.6 | 6.2 | 0.72 | 0.81 |
| | 5.0 | 5.1 | 7.2 | 7.8 | 0.74 | 0.83 |
| | 6.0 | 5.0 | 10.3 | 11.0 | 0.82 | 0.93 |
| 40 | 1.0 | 5.1 | 8.1 | 8.8 | 1.09 | 1.02 |
| | 2.0 | 5.0 | 10.5 | 11.2 | 1.12 | 1.05 |
| | 3.0 | 4.9 | 13.5 | 14.3 | 1.15 | 1.10 |
| | 4.0 | 4.8 | 16.0 | 16.8 | 1.18 | 1.12 |
| | 5.0 | 4.7 | 18.9 | 19.6 | 1.23 | 1.18 |
| | 6.0 | 4.9 | 21.6 | 22.4 | 1.28 | 1.22 |

From the results shown in Tables 38, 39–1 and 39–2 in comparison with Tables 36, 37–1 and 37–2, it is understood that good scraping performances including satisfactory gap fluctuation and surface roughness could be obtained by using SiC abrasive tapes while somewhat longer processing time was required than the alumina ($Al_2O_3$) abrasive tapes.

Experimental Example D3

Aluminum sleeves having an outer diameter of 20 mm used for a developing roller of a commercially available laser beam printer ("LBP-2160", made by Canon K.K.) were provided and subjected to measurement of a gap fluctuation in the manner described with reference to FIGS. 5 to 7. Among the sleeves, those exhibiting average values of gap fluctuation falling within the range 5.0±0.5 μm were collected. These Al sleeves were provided with a resin coating layer to be subjected to a scraping test. For reference, the sleeves provided with the resin coating layer exhibited substantially no change in gap fluctuation.

The resin coating layer was formed in the following manner.

Point B was prepared by dispersing ingredients inclusive of 1000 wt. parts of 50%—solution in toluene of methyl methacrylate-dimethylaminoethyl methacrylate (mol ratio=95:5) copolymer having a weight average molecular weight (Mw) of ca. 10,000, 125 wt. parts of crystalline graphite having an average particle size (Dav.) of 5.5 μm, and 365 wt. parts of toluene. The dispersed materials in Paint K exhibited Dav=5.6 μm. Paint K was applied on an insulating sheet to form a dried and cured thin layer, which exhibited a volume resistivity of 12.5 ohm.cm. Paint K was diluted with toluene to a solid matter content of 40%. Then, Paint K in the diluted form was ejected onto the Al sleeve held upright and rotated at a constant speed from a spray gun while moving the spray gun downwards. A uniform coating film thus formed was dried to form a resin coating layer of Paint K. The coating conditions were set to provide an averagely ca. 10 μm-this resin coating layer.

The thus obtained coated sleeve samples were subjected to a scraping test, in the same manner as in Experimental Example D1. The results are inclusively shown in Tables 40 and 41.

TABLE 40

| Scraping time* (sec) by alumina abrasive tape | | | | | |
|---|---|---|---|---|---|
| Abut. press. | Tape surface roughness Rz (μm) | | | | |
| ($\times 10^5$ Pa) | 3.0 | 6.0 | 10 | 30 | 40 |
| 0.5 | L | L | L | L | L |
| 1.0 | L | 680 | 390 | 150 | 120 |
| 2.0 | L | 560 | 270 | 90 | 60 |
| 3.0 | L | 480 | 240 | 75 | 45 |
| 4.0 | L | 450 | 210 | 60 | 45 |
| 5.0 | L | 420 | 195 | 45 | 30 |
| 6.0 | L | 390 | 165 | 45 | 30 |

*L: > 700 sec.

TABLE 41

| Scraping (abrasive tape) performances | | | | | | |
|---|---|---|---|---|---|---|
| Conditions | | Gap fluctuation (μm) | | | Roughness Ra (μm) | |
| Tape Rz (μm) | Abut. press ($\times 10^5$ Pa) | before treat-ment | after treat-ment | after coat-ing | after treat-ment | after coat-ing |
| 6.0 | 1.0 | 5.0 | 5.2 | 5.7 | 0.36 | 0.63 |
| | 2.0 | 4.9 | 5.0 | 5.5 | 0.37 | 0.64 |
| | 3.0 | 5.0 | 5.0 | 5.5 | 0.38 | 0.65 |
| | 4.0 | 5.1 | 5.1 | 5.6 | 0.39 | 0.65 |
| | 5.0 | 5.0 | 5.5 | 6.0 | 0.41 | 0.66 |
| | 6.0 | 5.1 | 6.9 | 7.5 | 0.43 | 0.67 |
| 10 | 1.0 | 4.8 | 4.9 | 5.4 | 0.42 | 0.66 |
| | 2.0 | 4.8 | 4.9 | 5.5 | 0.44 | 0.66 |
| | 3.0 | 4.9 | 5.1 | 5.6 | 0.46 | 0.67 |
| | 4.0 | 5.0 | 5.2 | 5.7 | 0.47 | 0.67 |
| | 5.0 | 5.1 | 5.9 | 6.5 | 0.49 | 0.70 |
| | 6.0 | 5.2 | 8.1 | 8.7 | 0.51 | 0.71 |
| 30 | 1.0 | 4.9 | 5.2 | 5.7 | 0.70 | 0.72 |
| | 2.0 | 4.8 | 5.1 | 5.6 | 0.72 | 0.73 |
| | 3.0 | 4.9 | 5.4 | 5.9 | 0.74 | 0.75 |
| | 4.0 | 5.0 | 5.5 | 6.1 | 0.76 | 0.76 |
| | 5.0 | 5.1 | 6.8 | 7.5 | 0.79 | 0.78 |
| | 6.0 | 5.1 | 9.7 | 10.5 | 0.89 | 0.87 |
| 40 | 1.0 | 5.0 | 7.7 | 8.4 | 1.14 | 1.10 |
| | 2.0 | 5.2 | 9.9 | 10.5 | 1.18 | 1.14 |
| | 3.0 | 5.1 | 12.6 | 13.3 | 1.21 | 1.16 |
| | 4.0 | 4.9 | 15.1 | 15.9 | 1.23 | 1.19 |
| | 5.0 | 4.8 | 18.6 | 19.4 | 1.32 | 1.28 |
| | 6.0 | 4.7 | 21.3 | 22.1 | 1.41 | 1.36 |

The results shown in Tables 40 and 41 indicates the applicability of the abrasive tape scraping to a thermoplastic resin coating layer.

Experimental Example D4

SUS sleeves having an outer diameter of 20.0 mm used for a developing roller of a commercially available copying machine ("NP-6035", made by Canon K.K.) were provided and subjected to measurement of a gap fluctuation. Among the sleeves, those exhibiting average values of gap fluctuation falling within the range 5.0±0.5 μm were collected. These Al sleeves were provided with a resin coating layer to be subjected to a scraping test. For reference, the sleeves provided with the resin coating layer exhibited substantially no change in gap fluctuation.

The resin coating layer was formed in the following manner.

Paint L was prepared by dispersing ingredients inclusive of 1000 wt. parts of prepolymer of thermosetting phenolic resin synthesized from phenol and formaldehyde by using an ammonium catalyst (in the form of a 50%—solution in methanol) 360 wt. parts of crystalline graphite (Dav.=7.5 μm), 40 wt. parts of electroconductive carbon black, 300 wt. parts of a quaternary ammonium salt compound, 200 wt. parts of spherical carbon particles (Dav.=5.0 μm) and 900 wt. parts of methanol. The dispersed materials in Paint L exhibited Dav=5.9 μm. Paint L was applied on an insulating sheet to form a dried and cured thin layer, which exhibited a volume resistivity of 4.2 ohm.cm. Paint L was diluted with isopropyl alcohol to a solid matter content of 40%. Then Paint L in the diluted form was ejected onto the Al sleeve held upright and rotated from a spray gun while moving the spray gun downwards. A uniform coating film thus formed was dried and cured to form a resin coating layer of Paint L. The coating conditions were set to provide an averagely ca. 15 μm-thick resin coating layer.

The thus obtained coated sleeve samples were subjected to a scraping test, i.e., a tape abrasion treatment by using an apparatus a illustrated in FIGS. 17 and 18 including a 5 cm-wide and 75 μm-thick abrasive tape 302 comprising alumina particles firmly attached onto a polyester film and continually fed at a rate of 15 mm/sec. The tape feed unit was vertically moved at a speed of 15 mm/sec in an axial direction of a sleeve 301. The abrasive tape 302 was abutted against the sleeve 31 rotated at 1200 rpm at abutting pressures ranging from $0.5\times10^{5-6.0\times105}$ Pa so as to provide a contact angle θ of 180 deg. Various lots of abrasive tapes 302 were used having surface roughnesses Rz of 10–40 μm.

Under the above-mentioned conditions, the coated sleeves were subjected to tape abrasion basically until the resin coating layer was scraped off. The abrasion time was measured as an indication of scraping performance and recorded in Table 42 below, and the test results of the scraping, such as gap fluctuation and surface roughnesses, measured after wiping with soft cloth wetted with methyl ethyl ketone, are summarized in Table 43.

TABLE 42

Scraping time* (sec) by alumina abrasive tape

| Abut. press. | Tape surface roughness Rz (μm) | | | |
|---|---|---|---|---|
| ($\times10^5$ Pa) | 10 | 20 | 30 | 40 |
| 0.5 | L | L | L | L |
| 1.0 | 710 | 625 | 555 | 480 |
| 2.0 | 650 | 585 | 525 | 450 |
| 3.0 | 680 | 540 | 495 | 465 |
| 4.0 | 570 | 510 | 465 | 420 |
| 5.0 | 540 | 480 | 435 | 390 |
| 6.0 | 510 | 435 | 405 | 360 |

*L: >800 sec.

TABLE 43

Scraping (alumina abrasive tape) performances

| Conditions | | Gap fluctuation (μm) | | | Roughness Ra (μm) | |
|---|---|---|---|---|---|---|
| Tape Rz (μm) | Abut. press ($\times10^5$ Pa) | before treat-ment | after treat-ment | after coat-ing | after treat-ment | after coat-ing |
| 10 | 1.0 | 5.0 | 5.4 | 5.9 | 0.38 | 0.96 |
| | 2.0 | 4.9 | 5.3 | 5.8 | 0.38 | 0.96 |
| | 3.0 | 4.9 | 5.6 | 6.1 | 0.39 | 0.98 |
| | 4.0 | 5.0 | 6.9 | 7.5 | 0.40 | 0.97 |
| | 5.0 | 5.1 | 8.1 | 8.7 | 0.41 | 1.00 |
| | 6.0 | 5.2 | 9.5 | 10.1 | 0.41 | 1.01 |
| 20 | 1.0 | 5.0 | 5.4 | 5.9 | 0.41 | 0.98 |
| | 2.0 | 5.1 | 5.5 | 6.0 | 0.41 | 0.98 |
| | 3.0 | 5.2 | 6.0 | 6.5 | 0.42 | 0.99 |
| | 4.0 | 5.1 | 7.2 | 7.7 | 0.43 | 1.01 |
| | 5.0 | 5.0 | 8.6 | 9.2 | 0.44 | 1.03 |
| | 6.0 | 4.9 | 10.8 | 11.3 | 0.44 | 1.02 |
| 30 | 1.0 | 5.0 | 5.8 | 6.3 | 0.42 | 0.99 |
| | 2.0 | 5.1 | 6.4 | 6.9 | 0.43 | 1.01 |
| | 3.0 | 5.2 | 7.6 | 8.2 | 0.45 | 1.03 |
| | 4.0 | 5.0 | 9.3 | 9.9 | 0.46 | 1.05 |
| | 5.0 | 5.1 | 11.9 | 12.7 | 0.47 | 1.04 |
| | 6.0 | 5.1 | 14.8 | 15.5 | 0.49 | 1.06 |
| 40 | 1.0 | 5.0 | 9.5 | 10.1 | 0.53 | 1.06 |
| | 2.0 | 4.9 | 11.7 | 12.3 | 0.55 | 1.08 |
| | 3.0 | 5.2 | 14.0 | 14.7 | 0.56 | 1.07 |
| | 4.0 | 4.8 | 16.9 | 17.8 | 0.61 | 1.09 |
| | 5.0 | 5.0 | 20.2 | 21.1 | 0.63 | 1.09 |
| | 6.0 | 4.9 | 24.6 | 25.6 | 0.68 | 1.10 |

The results shown in Tables 42 and 43 indicates the applicability of the abrasive tape scraping to a resin coating layer containing spherical carbon particles as a reinforcing filler while a somewhat longer processing time was required. Further, the change from aluminum to SUS of the sleeve substrate material exhibited a tendency of suppressing the increase in surface roughness after the treatment.

Example D1

A used developer-carrying member (developing roller) having an outer diameter (OD) of 24.5 mm actually used in a commercial copying machine ("NP-6350", made by Canon K.K.) for copying on ca. $5\times10^5$ sheets (predominantly of A4-size), was provided. The developing roller was originally (before use) provided with a ca. 12 μm thick resin coating layer principally comprising a thermoset phenolic resin and crystalline graphite and exhibiting a surface roughness Ra of ca. 0.8 μm. As a result of observation through a laser microscope of the used developing roller, toner attachment was observed at both ends of the sleeve. After wiping the attached toner with solvent MEK, the resin coating layer exhibited a lowered surface roughness Ra of 0.40 μm. As a result of measurement of the outer diameter by laser light illumination, the remaining coating layer thickness was averagely ca. 6 μm at a central part and ca. 4 μm at both edge parts. At the edge parts, the lower aluminum substrate was recognized through a remaining small thickness of the resin layer.

The surface of the used developing roller was carefully wiped out with methyl ethyl ketone (MEK) so as to remove the attached toner. The developing roller was then re-assembled to form a developing apparatus and incorporated again in the copying machine ("NP-6350"), which was then subjected to image forming tests. As a result, images with practically lower limit level of image density could be obtained in a normal temperature/normal humidity (NT/NH=23° C./50% RH) environment and a high temperature/ high humidity (HT/HH=30° C./80% RH) environment, but the images formed in a normal temperature/low humidity (NT/LH=23° C./10% RH) environment were accompanied with ripple pattern irregularity at halftone parts corresponding ripple-pattern coating irregularity (blotches) at the sleeve edge parts.

Then, the developing roller was again taken out of the developing apparatus, the surface toner was removed, and the sleeve flange at one end and the magnet roller were removed therefrom. Further, the remaining sleeve was subjected to scraping of the resin coating layer by using the blasting apparatus of Experimental Example D1 above. As a result, the treated sleeve exhibited a gap fluctuation of 6.2 μm.

More specifically, during the scraping operation, a 5 cm-wide and 75 μm-thick alumina abrasive tape comprising alumina particles firmly attached to a polyester film and having a surface roughness Rz of 20 μm. The sleeve was rotated at 1200 rpm, the tape was fed at a rate of 15 mm/sec and abutted against the sleeve at an abutting pressure of $2.0\times10^5$ Pa so as to provide a contact angle θ of 180 deg. The tape feed unit was moved at a rate of 15 mm/sec in the sleeve axial direction. Under the conditions, the scraping operation was continued for 90 sec., and the scraped surface of the sleeve was cleanly wiped out with soft cloth impregnated with methyl ethyl ketone to complete the scraping treatment. The sleeve after the scraping treatment exhibited a gap fluctuation of 6.3 μm and a central line-average roughness of 0.65 μm on an average with fluctuations within ±0.05 μm with respect to values measured at 12 points.

Then, a fresh resin coating layer wins formed in a thickness of 12.4 μm on the scraped sleeve by using Paint L prepared in Experimental Example D1. The resin coating layer exhibited a surface roughness Ra=0.84 μm, and the coated sleeve exhibited a gap fluctuation of 6.8 μm.

A magnet roller was again instead in the sleeve and a flange was attached to form a developing apparatus for the copying machine ("NP-6350"), which was then subjected to an image forming test on 10,000 sheets on each of the NT/NH (23° C./60% RH), HT/HH (30° C./80% RH) and NT/LH (23° C./10% RH) environments. As a result, good images were formed in each environment. The results are inclusively shown in Tables 44 to 46 together with those of Examples described hereinafter. In the NT/NH (23° C./60% RH) environment, the continuous image forming test was continued up to $5\times10^5$ sheets, whereas no particularly abnormal images were formed.

Evaluation Items and Methods

Image forming performance evaluation was performed with respect to identical items in identical manners as in Example A1.

Example D2

The procedure of Example D1 including the resin coating layer formation, the assembling of a developing roller and a developing apparatus the incorporation in an image forming apparatus ("NP 6350") and the image forming test was repeated except for using Sleeve sample B prepared in Experimental Example D1 (by using an abrasive tape having Rz=20 μm at an abutting pressure (Pab) of $2.0\times10^5$ Pa) and exhibiting good gap fluctuation ($f_{gap}$) and surface roughness (Ra). The results are shown in Tables 44–46 together with those of the following Examples.

Example D3

The procedure of Example D1 was repeated except for using Sleeve sample D prepared in Experimental Example D1 (Rz=20 μm, Pab=$5.0\times10^5$ Pa) showing somewhat worse gap fluctuation.

Example D4

The procedure of Example D1 was repeated except for using Sleeve sample D prepared in Experimental Example D2 (SiC tape, Rz=20 μm, Pab=$4.0\times10^5$ Pa) showing good gap fluctuation and surface roughness.

Comparative Example D1

The procedure of Example D1 was repeated except for using Sleeve sample E prepared in Experimental Example D1 (Rz=40 μm, Pab=$4.0\times10^5$ Pa) showing somewhat worse gap fluctuation and larger surface roughness.

Comparative Example D2

The procedure of Example D1 was repeated except for using Sleeve sample F prepared in Experimental Example D1 (Rz=40 μm, Pab=$6.0\times10^5$ Pa) showing worse gap fluctuation and larger surface roughness.

TABLE 44

HT/HH (30° C./80% RH)

| Example | On 100th sheet | | | | After 10,000 sheets | | | |
|---|---|---|---|---|---|---|---|---|
| | I.D. | ΔID | Pitch | Blotch | I.D. | ΔID | Pitch | Blotch |
| MEK wash | 1.25 | 0.32 | D | A | — | — | — | — |
| Ex. D1 | 1.41 | 0.03 | A | A | 1.39 | 0.04 | A | A |
| Ex. D2 | 1.41 | 0.03 | A | A | 1.39 | 0.04 | A | A |
| Ex. D3 | 1.40 | 0.06 | A | A | 1.38 | 0.08 | A | A |
| Ex. D4 | 1.41 | 0.03 | A | A | 1.39 | 0.04 | A | A |
| Com. Ex. D1 | 1.18 | 0.15 | B | A | 1.15 | 0.18 | C | A |
| Com. Ex. D2 | 1.03 | 0.21 | C | A | 1.01 | 0.24 | C | A |

TABLE 45

NT/NH (23° C./60% RH)

| Example | On 100th sheet | | | | After 10,000 sheets | | | |
|---|---|---|---|---|---|---|---|---|
| | I.D. | ΔID | Pitch | Blotch | I.D. | ΔID | Pitch | Blotch |
| MEK wash | 1.3 | 0.29 | C | B | — | — | — | — |
| Ex. D1 | 1.43 | 0.02 | A | A | 1.42 | 0.03 | A | A |
| Ex. D2 | 1.43 | 0.02 | A | A | 1.42 | 0.03 | A | A |
| Ex. D3 | 1.42 | 0.05 | A | A | 1.41 | 0.07 | A | A |
| Ex. D4 | 1.43 | 0.02 | A | A | 1.42 | 0.03 | A | A |

TABLE 45-continued

| NT/NH (23° C./60% RH) | | | | | | | | |
|---|---|---|---|---|---|---|---|---|
| Example | On 100th sheet | | | | After 10,000 sheets | | | |
| | I.D. | ΔID | Pitch | Blotch | I.D. | ΔID | Pitch | Blotch |
| Com. Ex. D1 | 1.22 | 0.12 | A | A | 1.21 | 0.15 | B | A |
| Com. Ex. D2 | 1.06 | 0.18 | B | A | 1.04 | 0.22 | C | A |

TABLE 46

| NT/LH (23° C./5% RH) | | | | | | | | |
|---|---|---|---|---|---|---|---|---|
| Example | On 100th sheet | | | | After 10,000 sheets | | | |
| | I.D. | ΔID | Pitch | Blotch | I.D. | ΔID | Pitch | Blotch |
| MEK wash | 1.15 | 0.25 | C | C | — | — | — | — |
| Ex. D1 | 1.46 | 0.02 | A | A | 1.46 | 0.03 | A | A |
| Ex. D2 | 1.46 | 0.02 | A | A | 1.46 | 0.03 | A | A |
| Ex. D3 | 1.45 | 0.05 | A | A | 1.45 | 0.06 | A | A |
| Ex. D4 | 1.46 | 0.03 | A | A | 1.45 | 0.03 | A | A |
| Com. Ex. D1 | 1.25 | 0.11 | A | A | 1.23 | 0.14 | B | A |
| Com. Ex. D2 | 1.09 | 0.17 | B | A | 1.07 | 0.21 | C | A |

What is claimed is:

1. A method of regenerating a used developer-carrying member having a resin coating layer on a substrate, comprising:

a step of scraping the resin coating layer of the used developer-carrying member to form a developer-carrying member surface having an unevenness; and a step of coating the developer-carrying member surface having the unevenness with a coating layer of a resinous composition comprising at least a binder resin and electroconductive fine powder, wherein the scraping step is selected from a group of steps consisting of:

(A) a step of scraping the resin coating layer of the used developer-carrying member with abrasive particles to scrape off at least a portion of the resin coating layer and forming the unevenness on the developer-carrying member surface showing a central line-average roughness Ra of at most 0.8 μm;

(B) a step of blasting the resin coating layer of the used developer-carrying member having a cylindrical substrate with particles having an average particle size of 15–250 μm together with air at a discharge pressure of $1\times10^5$ Pa–$5\times10^5$ Pa through a nozzle having an inner diameter which is 0.15–1 times the outer diameter of the substrate to scrape off at least a portion of the resin coating layer, thereby forming a surface having the unevenness showing a central line-average roughness Ra of at most 0.8 μm;

(C) a honing step of subjecting the used developer-carrying member having a cylindrical substrate to a liquid honing treatment of ejecting a liquid containing honing particles having an average of 15–100 μm together with air at a discharge pressure of $1\times10^5$ Pa–$5\times10^5$ Pa through a nozzle having an inner diameter of 0.5–1.0 times the substrate outer diameter onto the resin coating layer of the developer-carrying member to scrape off at least a portion of the resin coating layer, thereby forming a surface having the unevenness showing a central line-average roughness Ra of at most 0.8 μm:

(D) a step of disposing abrasive particles on the resin coating layer of the used developer-carrying member so that at least a portion of the abrasive particles are movable relative to a support therefor, moving the abrasive particles relative to the resin coating layer to scrape off at least a portion of the resin coating layer, thereby forming a surface having the unevenness showing a central line-average roughness Ra of at most 0.8 μm; and (E) a tape abrasion step of scraping the resin coating layer of the used developer-carrying member having a cylindrical substrate with an abrasive tape having a surface showing a ten point-average roughness of 6.0–30 μm formed by binding abrasive particles with a binder resin abutted against the resin coating layer at an abutting pressure of $1.0\times10^5$–$5.0\times10^5$ Pa to scrape off at least a portion of the resin coating layer, thereby forming a surface having the unevenness showing a central line-average roughness Ra of at most 0.8 μm.

2. The method according to claim 1, wherein in the scraping step, the resin coating layer is scraped off completely to expose the substrate, thereby forming the unevenness showing the central line-average roughness Ra of at most 0.8 μm.

3. The method according to claim 1, wherein in the scraping step, the resin coating layer is scraped off substantially but leaving a portion thereof, thereby forming the unevenness showing the central line-average roughness Ra of at most 0.8 μm.

4. The method according to claim 1, wherein prior to performing the scraping step, a developer remaining on the used developer-carrying member is removed therefrom.

5. The method according to claim 1, wherein after performing the scraping step, a portion of abrasive particles and/or powdery scraping refuse remaining on the developer-carrying member is removed from the developer-carrying member.

6. The method according to claim 1, wherein in the blasting step (B), the blasting particles have a true density of 0.8–5.0 g/cm$^3$.

7. The method according to claim 6, wherein the blasting particles have a true density of 1.0–4.0 g/cm$^3$.

8. The method according to claim 6, wherein the cylindrical substrate of the developer-carrying member is rotated about a cylindrical axis thereof at a constant speed, and the nozzle is moved in a direction of the cylindrical axis.

9. The method according to claim 6, wherein prior to performing the blasting step (B), a developer remaining on the developer-carrying member is removed.

10. The method according to claim 6, wherein after performing the blasting step (B), a portion of abrasive particles and/or powdery scraping refuse remaining on the developer-carrying member is removed from the developer-carrying member.

11. The method according to claim 6, wherein the regenerated developer-carrying member shows a gap fluctuation of at most 30 μm.

12. The method according to claim 1, wherein in the honing step (C), the honing particles are present in a volume percentage of 2–20% of the liquid.

13. The method according to claim 12, wherein the honing particles have a true density of 0.8–5.0 g/cm$^3$.

14. The method according to claim 12, wherein the honing particles have a true density of 1.0–4.0 g/cm$^3$.

15. The method according to claim 12, wherein the cylindrical substrate of the developer-carrying member is rotated about a cylindrical axis thereof at a constant speed, and the nozzle is moved in a direction of the cylindrical axis.

16. The method according to claim 12, wherein prior to performing the honing step (C), a developer remaining on the developer-carrying member is removed.

17. The method according to claim 12, wherein after performing the honing step (C), a portion of abrasive particles and/or powdery scraping refuse remaining on the developer-carrying member is removed from the developer-carrying member.

18. The method according to claim 12, wherein the regenerated developer-carrying member shows a gap fluctuation of at most 30 $\mu$m.

19. The method according to claim 1, wherein the scraping step includes the steps of:

providing an abrasive sheet comprising a support sheet impregnated with a liquid containing abrasive particles dispersed therein;

carrying the abrasive particles so that at least a portion of the abrasive particles are movable relative to the support sheet, disposing the abrasive sheet in contact with the resin coating layer of the used developer-carrying member comprising a cylindrical substrate; and moving the abrasive sheet relative to the resin coating layer of the developer-carrying member, thereby scraping off at least a portion of the resin coating layer and forming a surface having unevenness showing the central line-average roughness Ra of at most 0.8 $\mu$m.

20. The method according to claim 19, wherein the abrasive particles have an average primary particle size of 0.01–50 $\mu$m.

21. The method according to claim 19, wherein the abrasive particles have a Mohs hardness of at least 3.

22. The method according to claim 19, wherein the liquid containing abrasive particles dispersed therein includes one of water and an organic solvent.

23. The method according to claim 19, wherein the support sheet includes one of a porous structure, a foam sheet, unwoven cloth, woven cloth, fiber planted film, paper, pulp sheet, and a plastic film.

24. The method according to claim 1, wherein in the tape abrasion step (E), the abrasive particles have an average particle size of 3.0–30 $\mu$m.

25. The method according to claim 24, wherein the abrasive particles have a hardness higher than a hardness of the resin coating layer.

26. The method according to claim 24, wherein the cylindrical substrate of the developer-carrying member is rotated about a cylindrical axis thereof at a constant speed, and the abrasive tape is moved in a direction of a circumference of the cylindrical substrate.

27. The method according to claim 24, wherein in the cylindrical substrate of the developer-carrying member is rotated about a cylindrical axis thereof at a constant speed, and the abrasive tape is moved in a direction of the cylindrical axis.

28. The method according to claim 24, wherein the cylindrical substrate of the developer-carrying member is rotated about a cylindrical axis thereof at a constant speed, and the abrasive tape is caused to contact the developer-carrying member over a circumference forming a contact angle of at least 90 deg. with respect to the cylindrical axis.

29. The method according to claim 24, wherein prior to performing the scraping step, a developer remaining on the developer-carrying member is removed.

30. The method according to claim 24, wherein prior to performing the tape abrasion step (B), an upper layer portion of the resin coating layer of the developer-carrying member is scraped by one or more of blasting, liquid honing, cuttings, and abrasion.

31. The method according to claim 24, wherein prior to performing the coating step, a portion of abrasive particles and/or powdery scraping refuse remaining on the developer-carrying member is removed from the developer-carrying member.

32. The method according to claim 24, wherein the regenerated developer-carrying member shows a gap fluctuation of at most 30 $\mu$m.

33. A regenerated developer-carrying member, comprising:

a substrate, and an electroconductive resin coating layer formed on the substrate, wherein the electroconductive resin coating layer has been formed by a method including the steps of:

scraping a resin coating layer of a used developer-carrying member to form a developer-carrying member surface having an unevenness; and coating the developer-carrying member surface having the unevenness with a coating layer of a resinous composition comprising at least a binder resin and electroconductive fine powder, wherein the scraping step is selected from a group of steps consisting of:

(A) a step of scraping the resin coating layer of the used developer-carrying member with abrasive particles to scrape off at least a portion of the resin coating layer and forming the unevenness on the developer-carrying member surface showing a central line-average roughness Ra of at most 0.8 $\mu$m;

(B) a step of blasting the resin coating layer of the used developer-carrying member having a cylindrical substrate with particles having an average particle size of 15–250 $\mu$m together with air at a discharge pressure of $1\times10^5$ Pa–$5\times10^5$ Pa through a nozzle having an inner diameter which is 0.15–1 times the outer diameter of the substrate to scrape off at least a portion of the resin coating layer, thereby forming a surface having the unevenness showing a central line-average roughness Ra of at most 0.8 $\mu$m;

(C) a step of subjecting the used developer-carrying member having a cylindrical substrate to a liquid honing treatment of ejecting a liquid containing particles having an average of 15–100 $\mu$m together with air at a discharge pressure of $1\times10^5$ Pa–$5\times10^5$ Pa through a nozzle having an inner diameter of 0.5–1.0 times the substrate outer diameter onto the resin coating layer of the developer-carrying member to scrape off at least a portion of the resin coating layer, thereby forming a surface having the unevenness showing a central line-average roughness Ra of at most 0.8 $\mu$m;

(D) a step of disposing abrasive particles on the resin coating layer of the used developer-carrying member so that at least a portion of the abrasive particles are movable relative to a support therefor, moving the abrasive particles relative to the resin coating layer to scrape off at least a portion of the resin coating layer, thereby forming a surface having the unevenness showing a central line-average roughness Ra of at most 0.8 $\mu$m; and (E) a step of scraping the resin coating layer of the used developer-carrying member having a cylindrical substrate with an abrasive tape having a surface showing a ten point-average roughness of 6.0–30 $\mu$m formed by binding abrasive particles with a binder resin abutted against the resin coating layer at an abutting pressure of $1.0\times10^5$–$5.0\times10^5$ Pa to scrape off at least a portion of the resin coating layer, thereby forming a surface having the unevenness showing a central line-average roughness Ra of at most 0.8 $\mu$m.

34. The regenerated developer-carrying member according to claim 33, which has been regenerated through a method according to any one of claims 2 to 32.

35. A developing apparatus, comprising:

a developer vessel for containing a developer used for developing a latent image to form a toner image;

a developer-carrying member for carrying the developer and conveying the developer to a developing region;

a developer layer-regulation member for forming a layer of the developer on the developer-carrying member; and a latent image-bearing member for bearing thereon the latent image, wherein the developer-carrying member is a regenerated developer-carrying member, comprising:

a substrate; and an electroconductive resin coating layer formed on the substrate, and wherein the electroconductive resin coating layer has been formed through steps of:

scraping a resin coating layer of a used developer-carrying member to form a developer-carrying member surface having unevenness; and coating the developer-carrying member surface having the unevenness with a coating layer of a resinous composition comprising at least a binder resin and electroconductive fine powders, wherein the scraping step is selected from a group of steps consisting of:

(A) a step of scraping the resin coating layer of the used developer-carrying member with abrasive particles to scrape off at least a portion of the resin coating layer and forming the unevenness on the developer-carrying member surface showing a central line-average roughness Ra of at most 0.8 $\mu$m;

(B) a step of blasting the resin coating layer of the used developer-carrying member having a cylindrical substrate with particles having an average particle size of 15–250 $\mu$m together with air at a discharge pressure of $1\times10^5$ Pa–$5\times10^5$ Pa through a nozzle having an inner diameter which is 0.15–1.0 times the outer diameter of the substrate to scrape off at least a portion of the resin coating layer, thereby forming a surface having the unevenness showing a central line-average roughness Ra of at most 0.8 $\mu$m:

(C) a step of subjecting the used developer-carrying member having a cylindrical substrate to a liquid honing treatment of ejecting a liquid containing particles having an average of 15–100 $\mu$m together with air at a discharge pressure of $1\times10^5$ Pa–$5\times10^5$ Pa through a nozzle having an inner diameter of 0.5–1.0 times the substrate outer diameter onto the resin coating layer of the developer-carrying member to scrape off at least a portion of the resin coating layer, thereby forming a surface having the unevenness showing a central line-average roughness Ra of at most 0.8 $\mu$m;

(D) a step of disposing abrasive particles on the resin coating layer of the used developer-carrying member so that at least a portion of the abrasive particles are movable relative to a support therefor, moving the abrasive particles relative to the resin coating layer to scrape off at least a portion of the resin coating layer, thereby forming a surface having the unevenness showing a central line-average roughness Ra of at most 0.8 $\mu$m; and (E) a step of scraping the resin coating layer of the used developer-carrying member having a cylindrical substrate with an abrasive tape having a surface showing a ten point-average roughness of 6.0–30 $\mu$m formed by binding abrasive particles with a binder resin abutted against the resin coating layer at an abutting pressure of $1.0\times10^5$–$5.0\times10^5$ Pa to scrape off at least a portion of the resin coating layer, thereby forming a surface having the unevenness showing a central line-average roughness Ra of at most 0.8 $\mu$m.

36. The developing apparatus according to claim 35, wherein the developer-carrying member has been regenerated through a method according to any one of claims 1 and 2 through 32.

* * * * *

UNITED STATES PATENT AND TRADEMARK OFFICE

CERTIFICATE OF CORRECTION

PATENT NO. : 6,687,476 B2
DATED : February 3, 2004
INVENTOR(S) : Yasuhide Goseki et al.

It is certified that error appears in the above-identified patent and that said Letters Patent is hereby corrected as shown below:

Drawings,
Sheet 6, Figure 7A, "AXAL" should read -- AXIAL --.

Column 1,
Line 17, "electrographic" should read -- electrophotographic --.

Column 2,
Line 4, "less" should read -- smaller --.

Column 3,
Line 2, "the." should read -- the --.

Column 4,
Line 53, "intention" should read -- invention --;
Line 58, "Introduction" should read -- production --; and
Line 67, "$\mu$m" should read -- $\mu$m), --.

Column 6,
Line 39, "resinous;" should read -- resinous --;
Line 46, "$1.0\times 10^{5-5.0\times10}$" should read -- $1.0\times 10^{5}$-$5.0\times10^{5}$ --; and
Line 60, "member" should read -- members --.

Column 8,
Line 5, "sent" should read -- are sent --.

Column 9,
Line 1, "is caused to" should be deleted;
Line 11, "resulting" should read -- result --;
Line 15, "ssible" should read -- possible --;
Line 22, "is" should read -- be --; and
Line 40, "$0.8g/cm^{3-5.0}$" should read -- $0.8g/cm^{3}$-5.0 --.

Column 10,
Line 60, "FIG." (first occurrence) should read -- (FIG. --.

Column 11,
Line 41, "10-400" should read -- 10-400 mm --;
Line 49, "of' should be deleted; and
Line 50, "is" should read -- are --.

UNITED STATES PATENT AND TRADEMARK OFFICE

CERTIFICATE OF CORRECTION

PATENT NO. : 6,687,476 B2
DATED : February 3, 2004
INVENTOR(S) : Yasuhide Goseki et al.

It is certified that error appears in the above-identified patent and that said Letters Patent is hereby corrected as shown below:

Column 12,
Line 33, "is caused to" should be deleted; and
Line 56, "is" should read -- be --.

Column 13,
Line 49, "an pressures" should read -- the pressures --; and "thath" should read -- that --.

Column 14,
Line 32, "belows," should read -- below, --; and
Line 57, "sing" should read -- using --.

Column 15,
Line 4, "is" should read -- be --.

Column 16,
Line 5, "is" (second occurrence) should read -- be --;
Line 41, "my" should read -- may; and
Line 66, "is" should read -- be --.

Column 17,
Line 12, "per" should be deleted; and
Line 45, "picth" should read -- pitch --.

Column 18,
Line 15 ; "is" should read -- be --; and--
Line 21, "contacts" should read -- contact --.

Column 20,
Line 9, "divinyltetramthyldisiloxane," should read -- divinyltetramethyldisiloxane, --; and
Line 54, "$10^{-}$" should read -- $10^{-3}$ to --.

Column 21,
Line 57, "knead" should read -- kneaded --.

Column 22,
Line 34, "controls" should read -- control --.

Column 23,
Line 3, "fore" should read -- force --;
Line 7, "may" should read -- may be --; and
Line 59, "sandwiched" should read -- sandwich --.

UNITED STATES PATENT AND TRADEMARK OFFICE

CERTIFICATE OF CORRECTION

PATENT NO. : 6,687,476 B2
DATED : February 3, 2004
INVENTOR(S) : Yasuhide Goseki et al.

It is certified that error appears in the above-identified patent and that said Letters Patent is hereby corrected as shown below:

Column 24,
Line 58, "has" should read -- have --.

Column 25,
Line 5, "reference" should read -- reference to --; and
Line 59, "modification" should read -- modifications --.

Column 26,
Line 12, "substrate 157." should read -- substrate 557. --.

Column 27,
Line 46, "methacryronitrile" should read -- methacrylonitrile --; and
Line 64, "other" should read -- ether --.

Column 29,
Line 40, "%," (second occurrence) should read -- % --.

Column 31,
Line 35, "calium stearate," should be deleted.

Column 32,
Line 37, "dibutylaminopyldimethoxysilane," should read
-- dibutylaminopropyldimethoxysilane, --; and
Line 63, "m2/g," should read -- $m^2$/g, --.

Column 33,
Line 42, "a" (first occurrence) should be deleted.

Column 34,
Line 46, "Layer." should read -- layer. --.

Column 36,
Table 3, "*:L>100 sec." should read -- *:L>1000 sec. --.

Column 37,
In Table 6, "8.1 0.64 -- 6.1 0.64
7.3 0.08" should read 6.1 0.68 --.

UNITED STATES PATENT AND TRADEMARK OFFICE

CERTIFICATE OF CORRECTION

PATENT NO. : 6,687,476 B2
DATED : February 3, 2004
INVENTOR(S) : Yasuhide Goseki et al.

It is certified that error appears in the above-identified patent and that said Letters Patent is hereby corrected as shown below:

Column 38,
In Table 8, "8.8 7.4 -- 6.8 7.4
10.5 11.0" should read 10.5 11.0 --; and
Line 56, "shows" should read -- show --.

Column 39,
In Table 11, "0.80 --0.79
0.80" should read 0.80 --; and
"190" --190
180" should read 180 --; and
Line 67, "Measurement" should read -- measurement --.

Column 40,
Line 34, "This," should read -- Thus, --.

Column 42,
Line 67, "tanner" should read -- toner --.

Column 43,
Line 2, "lazier" should read -- layer --.

Column 44,
Line 2, "6 mm.dia." should read -- 5 mm.dia. --.

Column 47,
Line 29, "above described" should read -- above-described --.

Column 48,
Line 7, "result" should read -- results --; and
Line 38, "particles" should read -- particle --.

Column 50,
Line 48, "("LBP-1750")," should read -- ("LBP-1760"), --.

Column 51,
Line 2, "making" should read -- taking --;
Line 14, "an" should read -- in --; and
Line 31, "we,re" should read -- were --.

UNITED STATES PATENT AND TRADEMARK OFFICE

CERTIFICATE OF CORRECTION

PATENT NO. : 6,687,476 B2
DATED : February 3, 2004
INVENTOR(S) : Yasuhide Goseki et al.

It is certified that error appears in the above-identified patent and that said Letters Patent is hereby corrected as shown below:

Column 52,
Line 7, "sample" should read -- samples --.

Column 53,
Table 19, "L:100 sec." should read -- L:>l000 sec. --.

Column 54,
In Table 22, "8.8 --6.8
9.1 should read 9.1 --; and
"0.56 0.86
0.91 " should read 0.91 --.

Column 56,
Table 25, "L:>100 sec" should read -- L:>1000 sec. --.

Column 58,
Table 31, "0.56 -- 0.66
0.68 should read 0.68 --.

Column 61,
Line 18, "is" should read -- is care) --;
Line 37, "watched" should read -- washed --; and
Line 59, "bar" should read -- by --.

Column 62,
Line 36, "MEk" should read -- MEK --.

Column 63,
Line 30, "biased" should read -- based --.

Column 64,
Line 11, "Layer" should read -- layer --; and
Line 48, "white black" should read -- white blank --.

Column 65,
Line 12, "image" should read -- images --.

Column 67,
Line 5, "MEk" should read -- MEK --; and
Line 61, "arid" should read -- and --.

UNITED STATES PATENT AND TRADEMARK OFFICE

CERTIFICATE OF CORRECTION

PATENT NO. : 6,687,476 B2
DATED : February 3, 2004
INVENTOR(S) : Yasuhide Goseki et al.

It is certified that error appears in the above-identified patent and that said Letters Patent is hereby corrected as shown below:

Column 70,
Line 61, "MEk" should read -- MEK --.

Column 72,
Line 18, "results" should read -- result --; and
Line 32, "environments." should read -- environment. --.

Column 73,'
Line 26, "tanner." should read -- manner. --;
Line 36, "Dav 5.3 $\mu$m" should read -- Dav = 5.3 $\mu$m. --; and
Line 63, "MEk" should read -- MEK --.

Column 78,
Line 43, "$\mu$m-this" should read -- $\mu$m-thin --.

Column 80,
Line 21, "or" should read -- for --.

Column 81,
Line 67, "$\mu$m-this" should read -- $\mu$m-thin --.

Column 82,
Line 52, "indicates" should read -- indicate --.

Column 83,
Line 30, "a" (first occurrence) should read -- as --; and
Line 38, "$0.5\times10^{5-6.0\times105}$" should read -- $0.5\times10^{5}$-$6.0\times10^{5}$ --.

Column 84,
Line 31, "indicates" should read -- indicate --.

Column 85,
Line 9, "were" should read -- was --;
Line 33, "wins" should read -- was --;
Line 38, "instead" should read -- inserted --; and
Line 60, "apparatus" should read -- apparatus, --.

Column 88,
Line 9, "$\mu$m," should read -- $\mu$m; --.

UNITED STATES PATENT AND TRADEMARK OFFICE

CERTIFICATE OF CORRECTION

PATENT NO. : 6,687,476 B2
DATED : February 3, 2004
INVENTOR(S) : Yasuhide Goseki et al.

It is certified that error appears in the above-identified patent and that said Letters Patent is hereby corrected as shown below:

Column 89,
Line 29, "sheet," should read -- sheet; --; and
Line 63, "in" should be deleted.

Column 90,
Line- 13, "cuttings," should read -- cutting --; and
Line 24, "substrate," should read -- substrate; --.

Column 92,
Line 13, "$\mu$m:" should read -- $\mu$m; --;
Line 52, "and" should be deleted; and
Line 53, "2 through" should read -- through --.

Signed and Sealed this

Thirty-first Day of August, 2004

JON W. DUDAS
*Director of the United States Patent and Trademark Office*